US010635009B2

(12) United States Patent
Shimizu

(10) Patent No.: US 10,635,009 B2
(45) **Date of Patent: *Apr. 28, 2020**

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventor: Tomofumi Shimizu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/003,329

(22) Filed: Jun. 8, 2018

(65) Prior Publication Data

US 2018/0356743 A1 Dec. 13, 2018

(30) Foreign Application Priority Data

Jun. 12, 2017 (JP) ..... 2017-114930

(51) Int. Cl.
*G03G 5/05* (2006.01)
*G03G 5/06* (2006.01)
(Continued)

(52) U.S. Cl.
CPC ..... *G03G 5/0564* (2013.01); *G03G 5/0589* (2013.01); *G03G 5/0603* (2013.01);
(Continued)

(58) Field of Classification Search
CPC .. G03G 5/0564; G03G 5/0603; G03G 5/0607; G03G 5/0609; G03G 5/0612;
(Continued)

(56) References Cited

U.S. PATENT DOCUMENTS 5,430,526 A * 7/1995 Ohkubo ..... G03G 15/0233 399/159
6,649,315 B1 * 11/2003 Takasaki ..... G03G 9/0819 430/110.3
(Continued)

FOREIGN PATENT DOCUMENTS

JP 2012-051983 A 3/2012
JP 2017-178845 A1 * 10/2017

OTHER PUBLICATIONS

Japanese Patent Office machine-assisted English-language translation of JP 2017-178845 (filed on 2017). (Year: 2017).*

*Primary Examiner* — Janis L Dote

(74) *Attorney, Agent, or Firm* — Studebaker & Brackett PC

(57) ABSTRACT

An electrophotographic photosensitive member includes a conductive substrate and a photosensitive layer having a single-layer structure. The photosensitive layer contains a charge generating material, an electron transport material, a polycarbonate resin, and a hole transport material. The electron transport material includes a compound having a halogen atom and represented by general formula (1), (2), (3), (4), or (5). The polycarbonate resin has a terminal group having a fluoro group and represented by general formula (10). The hole transport material includes a compound represented by general formula (20), (21), (22), (23), (24), (25), (26), or (27). A charge of calcium carbonate as measured by charging the calcium carbonate through friction with the photosensitive layer is at least +6.5 μC/g. The photosensitive layer has a Vickers hardness of at least 17.0 HV at 45° C.

(1)

(2)

(3)

(Continued)

-continued
(4)
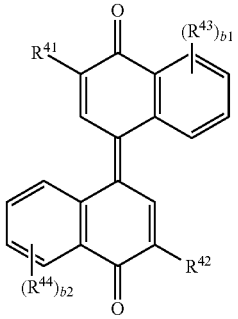
(5)
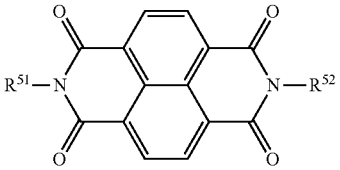
(10)
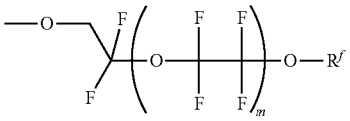
(20)
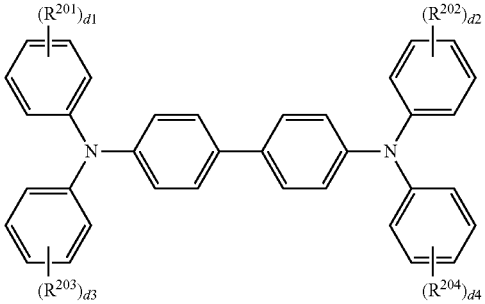
(21)
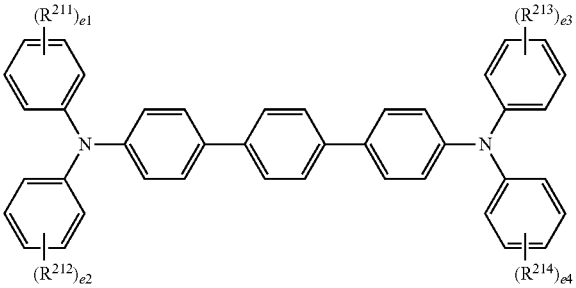
-continued
(22)
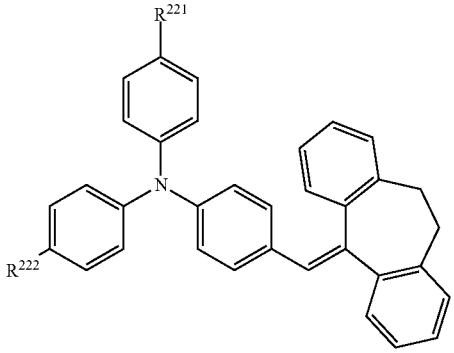
(23)
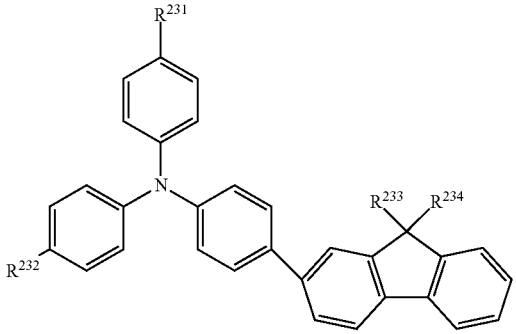
(24)
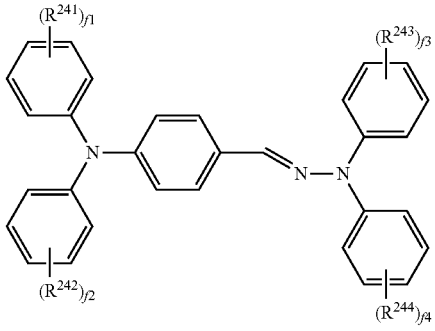

-continued
(25)
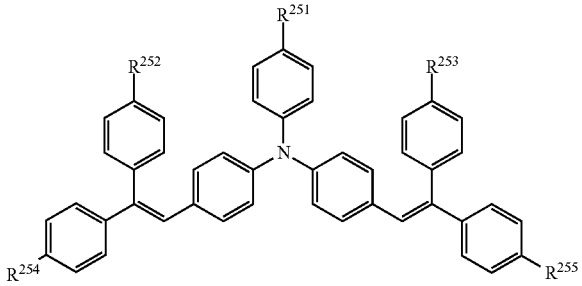
(26)
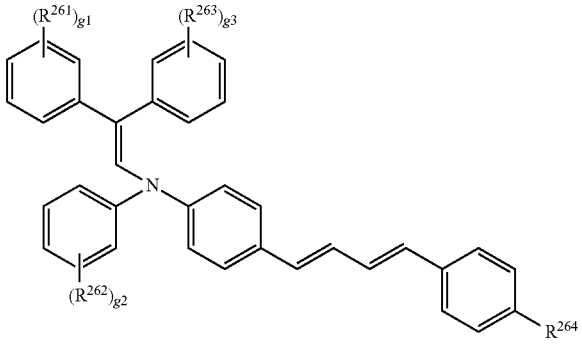
-continued
(27)
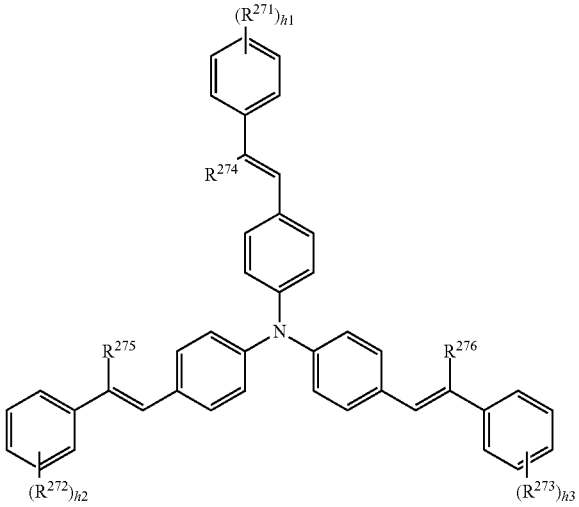
13 Claims, 3 Drawing Sheets
(51) Int. Cl.
*G03G 15/00* (2006.01)
*G03G 21/18* (2006.01)
*G03G 5/087* (2006.01)
(52) U.S. Cl.
CPC ..... *G03G 5/0609* (2013.01); *G03G 5/0614* (2013.01); *G03G 5/0618* (2013.01); *G03G 5/0631* (2013.01); *G03G 5/0648* (2013.01); *G03G 5/0651* (2013.01); *G03G 5/0677* (2013.01); *G03G 5/087* (2013.01); *G03G 15/75* (2013.01); *G03G 21/1803* (2013.01)
(58) Field of Classification Search
CPC .. G03G 5/0614; G03G 5/0616; G03G 5/0618; G03G 5/0631; G03G 5/0646; G03G 5/0648; G03G 4/607; G03G 5/0589
USPC ..... 430/59.6, 96, 73, 58.25, 58.85
See application file for complete search history.
(56) References Cited
U.S. PATENT DOCUMENTS
| | | | | |
|---|---|---|---|---|
| 9,458,291 | B2 * | 10/2016 | Hirata | C08G 64/06 |
| 2016/0116854 | A1 * | 4/2016 | Hirata | C08G 64/06 430/69 |
| 2016/0282732 | A1 * | 9/2016 | Shimizu | G03G 5/0614 |
| 2017/0052464 | A1 * | 2/2017 | Niida | G03G 5/043 |
* cited by examiner

ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2017-114930, filed on Jun. 12, 2017. The contents of this application are incorporated herein by reference in their entirety.

BACKGROUND

The present disclosure relates to an electrophotographic photosensitive member, a process cartridge, and an image forming apparatus.

An electrophotographic photosensitive member is used as an image bearing member in an electrophotographic image forming apparatus (for example, a printer or a multifunction peripheral). The electrophotographic photosensitive member includes a photosensitive layer. A single-layer electrophotographic photosensitive member or a multi-layer electrophotographic photosensitive member is for example used as the electrophotographic photosensitive member. The single-layer electrophotographic photosensitive member includes a photosensitive layer of a single-layer structure having a charge generation function and a charge transport function. The multi-layer electrophotographic photosensitive member includes a photosensitive layer that includes a charge generating layer having the charge generation function and a charge transport layer having the charge transport function.

There is a known polycarbonate copolymer of a specific structure used as a binder for an electrophotographic photosensitive member. This polycarbonate copolymer of the specific structure is produced using p-tert-butylphenol as a chain terminating agent.

SUMMARY

An electrophotographic photosensitive member of the present disclosure includes a conductive substrate and a photosensitive layer having a single-layer structure. The photosensitive layer contains a charge generating material, an electron transport material, a polycarbonate resin, and a hole transport material. The electron transport material includes a compound having a halogen atom and represented by a general formula (1), (2), (3), (4), or (5). The polycarbonate resin has a terminal group having a fluoro group and represented by a general formula (10). The hole transport material includes a compound represented by a general formula (20), (21), (22), (23), (24), (25), (26), or (27). A charge of calcium carbonate as measured by charging the calcium carbonate through friction with the photosensitive layer is at least +6.5 tμC/g. The photosensitive layer has a Vickers hardness of at least 17.0 HV at 45° C.

(1)

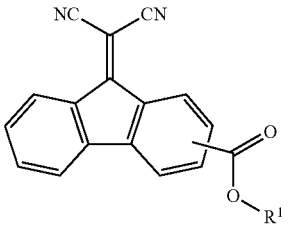

-continued (2)

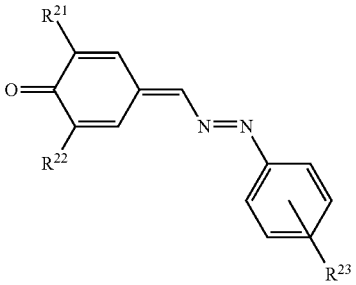

(3)

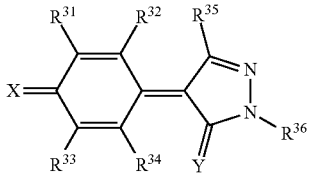

(4)

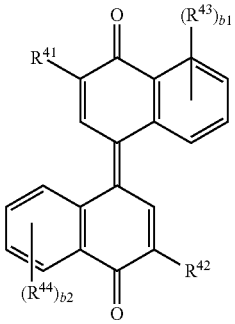

(5)

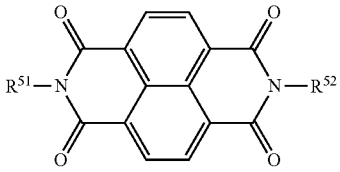

In the general formula (1), $R^1$ represents: an alkyl group having a carbon number of at least 1 and no greater than 8 and at least 1 halogen atom; a cycloalkyl group having a carbon number of at least 3 and no greater than 10 and at least 1 halogen atom; an aryl group having a carbon number of at least 6 and no greater than 14 and at least 1 halogen atom and optionally having an alkyl group having a carbon number of at least 1 and no greater than 6; a heterocyclic group having at least 1 halogen atom; or an aralkyl group having a carbon number of at least 7 and no greater than 20 and at least 1 halogen atom. In the general formula (2), $R^{21}$ and $R^{22}$ each represent, independently of each other, an alkyl group having a carbon number of at least 1 and no greater than 6. $R^{23}$ represents a halogen atom. In the general formula (3), $R^{31}$, $R^{32}$, $R^{33}$, $R^{34}$, $R^{35}$, and $R^{36}$ each represent, independently of one another: a halogen atom; a hydrogen atom; an alkyl group having a carbon number of at least 1 and no greater than 6 and optionally having at least 1 halogen atom; an alkenyl group having a carbon number of at least 2 and no greater than 6 and optionally having at least 1 halogen atom; an alkoxy group having a carbon number of at least 1 and no greater than 6 and optionally having at least 1 halogen atom; an aralkyl group having a carbon number of at least 7 and no greater than 20 and optionally having at least 1 halogen atom; an aryl group having a carbon number of at least 6 and no greater than 14 and optionally having at least 1 halogen atom; a heterocyclic group optionally having at least 1 halogen atom; a cyano group; a nitro group; a hydroxyl group; a carboxyl group; or an amino group, with the proviso that at least one of $R^{31}$, $R^{32}$, $R^{33}$, $R^{34}$, $R^{35}$, and $R^{36}$ represents a halogen atom or a chemical group having at least 1 halogen atom. X represents an oxygen atom, a sulfur atom or $=C(CN)_2$. Y represents an oxygen atom or a sulfur atom. In the general formula (4), $R^{41}$ and $R^{42}$ each represent, independently of each other: an alkyl group having a carbon number of at least 1 and no greater than 8 and at least 1 halogen atom; an aryl group having a carbon number of at least 6 and no greater than 14 and at least 1 halogen atom and optionally having an alkyl group having a carbon number of at least 1 and no greater than 6; an aralkyl group having a carbon number of at least 7 and no greater than 20 and at least 1 halogen atom: or a cycloalkyl group having a carbon number of at least 3 and no greater than 20 and at least 1 halogen atom. $R^{43}$ and $R^{44}$ each represent, independently of each other, an alkyl group having a carbon number of at least 1 and no greater than 6, an aryl group having a carbon number of at least 6 and no greater than 14, a cycloalkyl group having a carbon number of at least 3 and no greater than 20, or a heterocyclic group. Further, b1 and b2 each represent, independently of each other, an integer of at least 0 and no greater than 4. In the general formula (5), $R^{51}$ and $R^{52}$ each represent, independently of each other: an aryl group having a carbon number of at least 6 and no greater than 14 and optionally having at least 1 halogen atom; an aryl group having a carbon number of at least 6 and no greater than 14 and at least 1 alkyl group having a carbon number of at least 1 and no greater than 6, and optionally having at least 1 halogen atom; an aryl group having a carbon number of at least 6 and no greater than 14 and at least 1 benzoyl group and optionally having at least 1 halogen atom; an aralkyl group having a carbon number of at least 7 and no greater than 20 and optionally having at least 1 halogen atom; an alkyl group having a carbon number of at least 1 and no greater than 8 and optionally having at least 1 halogen atom; or a cycloalkyl group having a carbon number of at least 3 and no greater than 10 and optionally having at least 1 halogen atom, with the proviso that at least one of $R^{51}$ and $R^{52}$ represents a chemical group having at least 1 halogen atom.

(10)

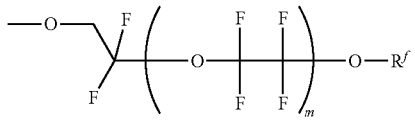

In the general formula (10), $R^f$ represents a straight chain or branched chain perfluoroalkyl group having a carbon number of at least 1 and no greater than 6. Further, m represents an integer of at least 1 and no greater than 3.

(20)

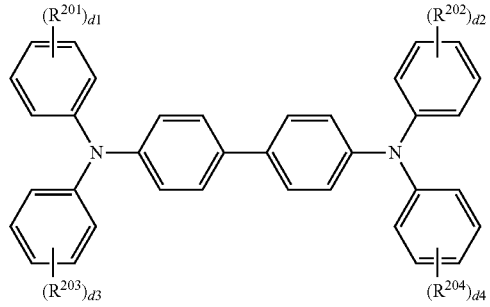

(21)

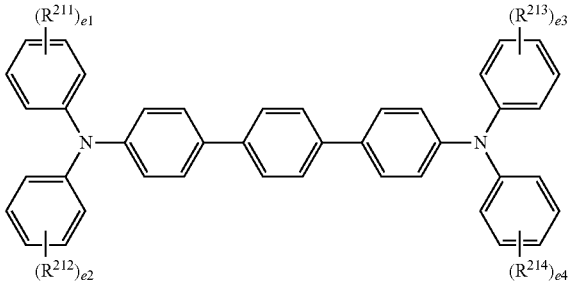

(22)

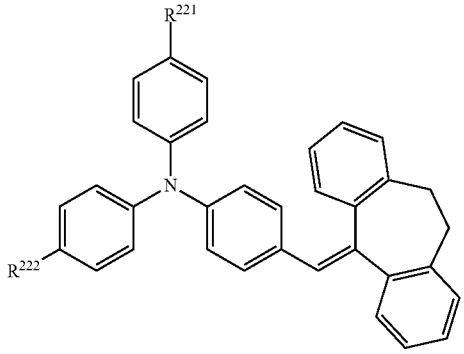

(23)

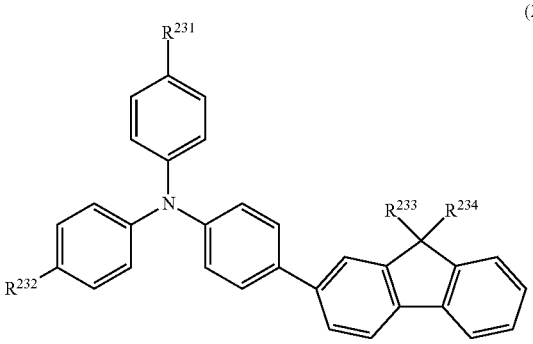

-continued (24)

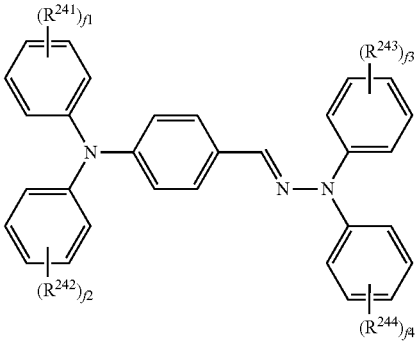

(25)

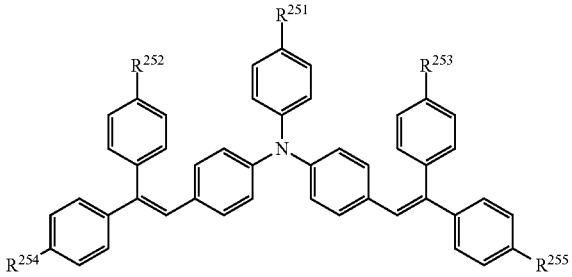

(26)

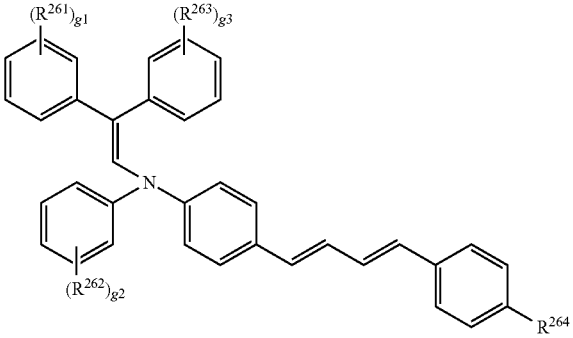

(27)

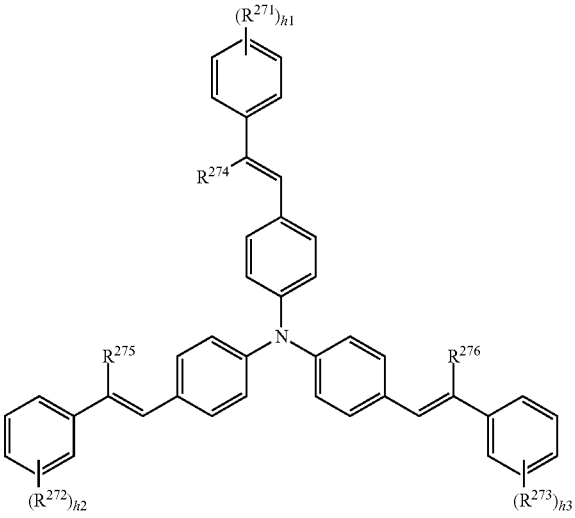

In the general formula (20), $R^{201}$, $R^{202}$, $R^{203}$, and $R^{204}$ each represent, independently of one another, an alkyl group having a carbon number of at least 1 and no greater than 6. Further, d1, d2, d3, and d4 each represent, independently of one another, an integer of at least 0 and no greater than 5. In the general formula (21), $R^{211}$, $R^{212}$, $R^{213}$, and $R^{214}$ each represent, independently of one another, an alkyl group having a carbon number of at least 1 and no greater than 6. Further, e1, e2, e3, and e4 each represent, independently of one another, an integer of at least 0 and no greater than 5. In the general formula (22), $R^{221}$ and $R^{222}$ each represent, independently of each other, a hydrogen atom or an alkyl group having a carbon number of at least 1 and no greater than 6. In the general formula (23), $R^{231}$, $R^{232}$, $R^{233}$, and $R^{234}$ each represent, independently of one another, a hydrogen atom or an alkyl group having a carbon number of at least 1 and no greater than 6. In the general formula (24), $R^{241}$, $R^{242}$, $R^{243}$, and $R^{244}$ each represent, independently of one another, an alkyl group having a carbon number of at least 1 and no greater than 6. Further, f1, f2, f3, and f4 each represent, independently of one another, an integer of at least 0 and no greater than 5. In the general formula (25), $R^{251}$, $R^{252}$, $R^{253}$, $R^{254}$, and $R^{255}$ each represent, independently of one another, a hydrogen atom or an alkyl group having a carbon number of at least 1 and no greater than 6. In the general formula (26), $R^{261}$, $R^{262}$, and $R^{263}$ each represent, independently of one another, an alkyl group having a carbon number of at least 1 and no greater than 6. Further, g1, g2, and g3 each represent, independently of one another, an integer of at least 0 and no greater than 5. $R^{24}$ represents a hydrogen atom or an alkyl group having a carbon number of at least 1 and no greater than 6. In the general formula (27). $R^{271}$, $R^{272}$, and $R^{273}$ each represent, independently of one another, an alkyl group having a carbon number of at least 1 and no greater than 6. Further, h1, h2, and h3 each represent, independently of one another, an integer of at least 0 and no greater than 5. $R^{274}$, $R^{275}$, and $R^{276}$ each represent, independently of one another, a hydrogen atom or an aryl group having a carbon number of at least 6 and no greater than 14.

A process cartridge of the present disclosure includes the above-described electrophotographic photosensitive member.

An image forming apparatus of the present disclosure includes an image bearing member, a charger, a light exposure device, a developing device, and a transfer device. The charger charges a surface of the image bearing member. The light exposure device irradiates the charged surface of the image bearing member with light to form an electrostatic latent image on the surface of the image bearing member. The developing device develops the electrostatic latent image into a toner image. The transfer device transfers the toner image from the image bearing member onto a recording medium. Charging polarity of the charger is positive. The transfer device transfers the toner image from the image bearing member onto the recording medium while the recording medium and the surface of the image bearing member are in contact with each other. The image bearing member is the above-described electrophotographic photosensitive member.

DETAILED DESCRIPTION

Figure 1A:
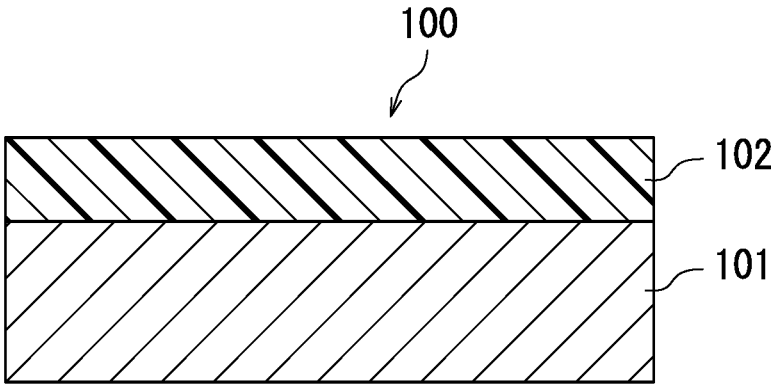
FIGS. 1A, 1B, and 1C are cross-sectional views each illustrating an example of an electrophotographic photosensitive member according to an embodiment of the present disclosure.

The following describes an embodiment of the present disclosure in detail.

However, the present disclosure is by no means limited to the embodiment described below. The present disclosure may be practiced with alterations appropriately made within a scope of the object of the present disclosure. Note that although some overlapping explanations may be omitted as appropriate, such omission does not limit the gist of the present disclosure. In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. A chemical group "optionally having a chemical group" means the same as a chemical group "optionally substituted by a chemical group". A chemical group "having a chemical group" means the same as a chemical group "substituted by a chemical group". A chemical group "optionally having a halogen atom" means the same as a chemical group "optionally substituted by a halogen atom". A chemical group "having a halogen atom" means the same as a chemical group "substituted by a halogen atom".

In the following description, a halogen atom, an alkyl group having a carbon number of at least 1 and no greater than 8, an alkyl group having a carbon number of at least 1 and no greater than 6, an alkyl group having a carbon number of at least 1 and no greater than 4, an alkyl group having a carbon number of at least 1 and no greater than 3, an alkyl group having a carbon number of at least 3 and no greater than 5, an alkoxy group having a carbon number of at least 1 and no greater than 6, an aryl group having a carbon number of at least 6 and no greater than 14, an aryl group having a carbon number of at least 6 and no greater than 10, a cycloalkyl group having a carbon number of at least 3 and no greater than 20, a cycloalkyl group having a carbon number of at least 3 and no greater than 10, a heterocyclic group, an aralkyl group having a carbon number of at least 7 and no greater than 20, and an alkenyl group having a carbon number of at least 2 and no greater than 6 each refer to the following unless otherwise stated.

Examples of halogen atoms (halogen groups) include fluorine atom (fluoro group), chlorine atom (chloro group), bromine atom (bromo group), and iodine atom (iodine group).

The alkyl group having a carbon number of at least 1 and no greater than 8, the alkyl group having a carbon number of at least 1 and no greater than 6, the alkyl group having a carbon number of at least 1 and no greater than 4, the alkyl group having a carbon number of at least 1 and no greater than 3, and the alkyl group having a carbon number of at least 3 and no greater than 5 are each an unsubstituted straight chain or branched chain alkyl group. Examples of the alkyl group having a carbon number of at least 1 and no greater than 8 include methyl group, ethyl group, n-propyl group, isopropyl group, n-butyl group, sec-butyl group, tert-butyl group, n-pentyl group, isopentyl group, neopentyl group, 1,2-dimethylpropyl group, hexyl group, heptyl group, and octyl group. Examples of the alkyl group having a carbon number of at least 1 and no greater than 6 are the alkyl groups each having a carbon number of at least 1 and no greater than 6 among the above-listed examples of the alkyl group having a carbon number of at least 1 and no greater than 8. Examples of the alkyl group having a carbon number of at least 1 and no greater than 4 are the alkyl groups each having a carbon number of at least 1 and no greater than 4 among the above-listed examples of the alkyl group having a carbon number of at least 1 and no greater than 8. Examples of the alkyl group having a carbon number of at least 1 and no greater than 3 are the alkyl groups each having a carbon number of at least 1 and no greater than 3 among the above-listed examples of the alkyl group having a carbon number of at least 1 and no greater than 8. Examples of the alkyl group having a carbon number of at least 3 and no greater than 5 are the alkyl groups each having a carbon number of at least 3 and no greater than 5 among the above-listed examples of the alkyl group having a carbon number of at least 1 and no greater than 8.

The alkoxy group having a carbon number of at least 1 and no greater than 6 is an unsubstituted straight chain or branched chain alkoxy group. Examples of the alkoxy group having a carbon number of at least 1 and no greater than 6 include methoxy group, ethoxy group, n-propoxy group, isopropoxy group, n-butoxy group, sec-butoxy group, tert-butoxy group, n-pentoxy group, isopentoxy group, neopentoxy group, and hexyl group.

The aryl group having a carbon number of at least 6 and no greater than 14 and the aryl group having a carbon number of at least 6 and no greater than 10 are each an unsubstituted aryl group. Examples of the aryl group having a carbon number of at least 6 and no greater than 14 include phenyl group, naphthyl group, indacenyl group, biphenylenyl group, acenaphthylenyl group, anthryl group, and phenanthryl group. Examples of the aryl group having a carbon number of at least 6 and no greater than 10 include phenyl group and naphthyl group.

The cycloalkyl group having a carbon number of at least 3 and no greater than 20 and the cycloalkyl group having a carbon number of at least 3 and no greater than 10 are each an unsubstituted cycloalkyl group. Examples of the cycloalkyl group having a carbon number of at least 3 and no greater than 20 include cyclopropyl group, cyclobutyl group, cyclopentyl group, cyclohexyl group, cycloheptyl group, cyclooctyl group, cyclononyl group, cyclodecyl group, cycloundecyl group, cyclododecyl group, cyclotridecyl group, cyclotetradecyl group, cyclopentadecyl group, cyclohexadecyl group, cyclooctadecyl group, cyclononadecyl group, and cycloicosyl group. Examples of the cycloalkyl group having a carbon number of at least 3 and no greater than 10 are the cycloalkyl groups each having a carbon number of at least 3 and no greater than 10 among the above-listed examples of the cycloalkyl group having a carbon number of at least 3 and no greater than 20.

Examples of the heterocyclic group include heterocyclic groups having at least 5 and no greater than 14 ring members. Examples of the heterocyclic groups having at least 5 and no greater than 14 ring members include: heterocyclic group having a five- or six-member monocyclic ring including at least 1 and no greater than 3 hetero atoms other than carbon atoms; heterocyclic group resulting from condensation of two such heteromonocyclic rings; heterocyclic group resulting from condensation of such a heteromonocyclic ring and a five- or six-member monocyclic hydrocarbon ring; heterocyclic group resulting from condensation of three such heteromonocyclic rings; heterocyclic group resulting from condensation of two such heteromonocyclic rings and a five- or six-member monocyclic hydrocarbon ring; and heterocyclic group resulting from condensation of such a heteromonocyclic ring and two five- or six-member monocyclic hydrocarbon rings. The hetero atoms are at least one type of atom selected from the group consisting of nitrogen atom, sulfur atom, and oxygen atom. Specific examples of the heterocyclic group having at least 5 and no greater than 14 ring members include piperidinyl group, piperazinyl group, morpholinyl group, thiophenyl group, furanyl group, pyrrolyl group, imidazolyl group, pyrazolyl group, isothiazolyl group, isoxazolyl group, oxazolyl group, thiazolyl group, isothiazolyl group, furazanyl group, pyranyl group, pyridyl group, pyridazinyl group, pyrimidinyl group, pyrazinyl group, indolyl group, 1H-indazolyl group, isoindolyl group, chromenyl group, quinolinyl group, isoquinolinyl group, purinyl group, pteridinyl group, triazolyl group, tetrazolyl group, 4H-quinolizinyl group, naphthyridinyl group, benzofuranyl group, 1,3-benzodioxolyl group, benzoxazolyl group, benzothiazolyl group, benzimidazolyl group, carbazolyl group, phenanthridinyl group, acridinyl group, phenazinyl group, and phenanthrolinyl group.

The aralkyl group having a carbon number of at least 7 and no greater than 20 is an unsubstituted aralkyl group. Examples of the aralkyl group having a carbon number of at least 7 and no greater than 20 are alkyl groups each having a carbon number of at least 1 and no greater than 6 and an aryl group having a carbon number of at least 6 and no greater than 14.

The alkenyl group having a carbon number of at least 2 and no greater than 6 is an unsubstituted straight chain or branched chain alkenyl group. The alkenyl group having a carbon number of at least 2 and no greater than 6 has at least 1 and no greater than 3 double bonds. Examples of the alkenyl group having a carbon number of at least 2 and no greater than 6 include ethenyl group, propenyl group, butenyl group, butadienyl group, pentenyl group, hexenyl group, hexadienyl group, and hexatrienyl group.

<Electrophotographic Photosensitive Member>

The present embodiment relates to an electrophotographic photosensitive member (hereinafter may be referred to as a photosensitive member). Use of the photosensitive member of the present embodiment can inhibit generation of white spots in an image being formed. Reasons for this are inferred as follows.

The photosensitive member of the present embodiment includes a photosensitive layer that contains any of compounds represented by general formulas (1), (2), (3), (4), and (5) shown below (hereinafter may be referred to as compounds (1), (2), (3), (4), and (5), respectively) as an electron transport material. The compounds (1) to (5) each have a halogen atom. The photosensitive layer also contains a polycarbonate resin. The polycarbonate resin has a terminal group represented by general formula (10) shown below (hereinafter may be referred to as a terminal group (10)). The terminal group (10) has a fluoro group. Further, the photosensitive layer contains any of compounds represented by general formulas (20), (21), (22), (23), (24), (25), (26), and (27) shown below (hereinafter may be referred to as compounds (20), (21), (22), (23), (24). (25), (26), and (27), respectively) as a hole transport material. As a result of the photosensitive layer containing the specific electron transport material, the specific polycarbonate resin, and the specific hole transport material, it is possible to achieve a charge of calcium carbonate of at least +6.5 μC/g as measured by charging the calcium carbonate through friction with the photosensitive layer. Also, as a result of the photosensitive layer containing the specific electron transport material, the specific polycarbonate resin, and the specific hole transport material, it is possible to achieve a Vickers hardness of the photosensitive layer at 45° C. of at least 17.0 HV. In a situation in which the charge of calcium carbonate as measured by charging the calcium carbonate through friction with the photosensitive layer is at least +6.5 μC/g and the Vickers hardness of the photosensitive layer at 45° C. is at least 17.0 HV, generation of white spots in an image being formed can be effectively inhibited.

Figure 1B:
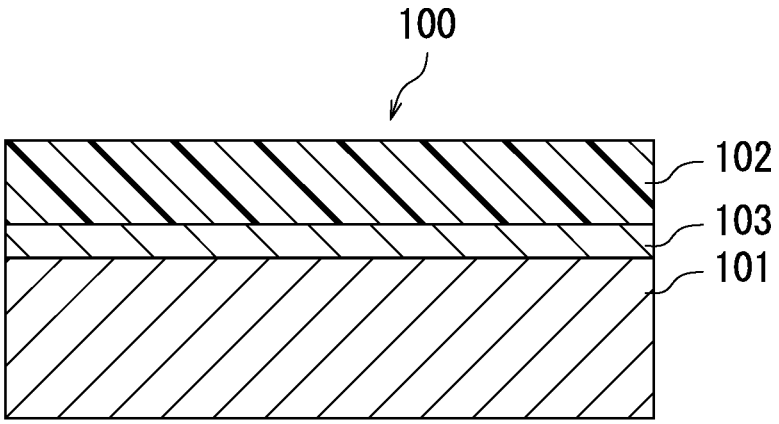
Figure 1C:
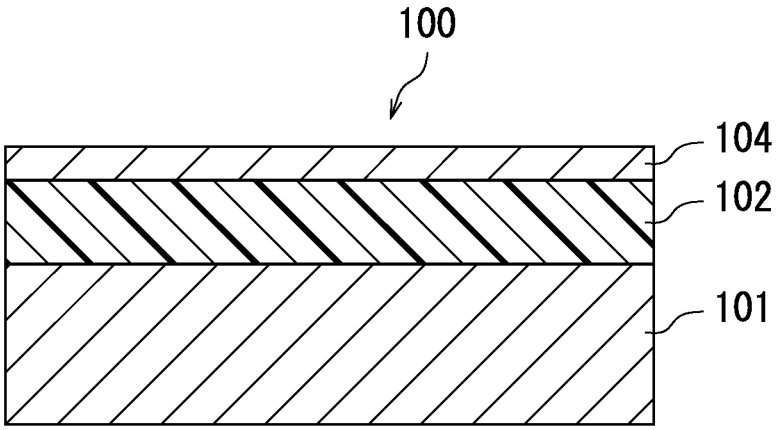

The following describes a structure of a photosensitive member 100 with reference to FIGS. 1A to 1C. FIGS. 1A to 1C are cross-sectional views each illustrating an example of the photosensitive member 100 of the present embodiment.

As illustrated in FIG. 1A, the photosensitive member 100 includes for example a conductive substrate 101 and a photosensitive layer 102. The photosensitive layer 102 has a single-layer structure. The photosensitive member 100 is a single-layer electrophotographic photosensitive member including the photosensitive layer 102 of the single-layer structure.

As illustrated in FIG. 1B, the photosensitive member 100 may include the conductive substrate 101, the photosensitive layer 102, and an intermediate layer 103 (an undercoat layer). The intermediate layer 103 is provided between the conductive substrate 101 and the photosensitive layer 102. The photosensitive layer 102 may be provided directly on the conductive substrate 101, as illustrated in FIG. 1A.

Alternatively, the photosensitive layer 102 may be provided indirectly on the conductive substrate 101 with the intermediate layer 103 therebetween, as illustrated in FIG. 1B.

As illustrated in FIG. 1C, the photosensitive member 100 may include the conductive substrate 101, the photosensitive layer 102, and a protective layer 104. The protective layer 104 is provided on the photosensitive layer 102.

No specific limitation is placed on the thickness of the photosensitive layer 102 as long as the photosensitive layer 102 is capable of sufficiently functioning as a photosensitive layer. The thickness of the photosensitive layer 102 is preferably at least 5 μm and no greater than 100 μm, and more preferably at least 10 μm and no greater than 50 μm.

In order to inhibit generation of white spots in an image being formed, it is preferable that the photosensitive layer 102 is a topmost layer of the photosensitive member 100.

Through the above, the structure of the photosensitive member 100 has been described with reference to FIGS. 1A to 1C. The following describes more details about the photosensitive member.

<Photosensitive Layer>

The photosensitive layer contains a charge generating material, the electron transport material, the polycarbonate resin, and the hole transport material. The photosensitive layer may contain an additive as necessary.

(Charge of Calcium Carbonate)

A charge (i.e., charge per mass) of calcium carbonate as measured by charging the calcium carbonate through friction with the photosensitive layer (hereinafter may be simply referred to as a charge of calcium carbonate) is at least +6.5 μC/g. Calcium carbonate is a major component of paper dust, which is an example of minute components of a recording medium.

In a situation in which the charge of calcium carbonate is less than +6.5 μC/g, white spots are generated in an image being formed. Reasons for this are inferred as follows. In a situation in which the charge of calcium carbonate is less than +6.5 μC/g, minute components of the recording medium are not sufficiently positively charged through friction between the photosensitive member and the recording medium in contact with each other during image formation. Therefore, when a surface of the photosensitive member is positively charged in a charging process of image formation, minute components that are not sufficiently positively charged are electrically attracted to the surface of the photosensitive member. As a result, the minute components of the recording medium tend to adhere to the surface of the photosensitive member, resulting in generation of white spots in an image being formed.

In order to inhibit generation of white spots in an image being formed, the charge of calcium carbonate is preferably at least +11.0 μC/g, and more preferably at least +12.0 μC/g. Although no specific limitation is placed on the upper limit of the charge of calcium carbonate as long as the photosensitive layer is capable of functioning as a photosensitive layer of a photosensitive member, the upper limit is preferably +20.0 μC/g in terms of manufacturing costs.

Figure 2:
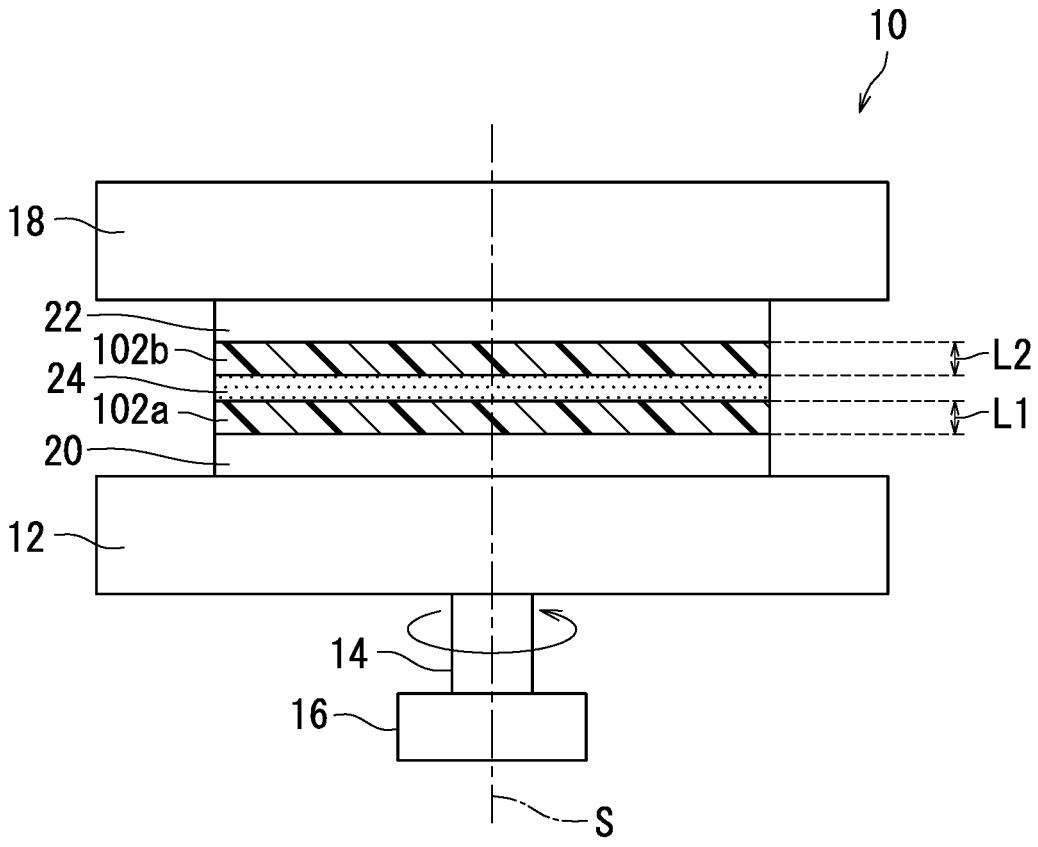
FIG. 2 is a diagram explaining a method for measuring a charge of calcium carbonate by charging the calcium carbonate through friction with a photosensitive layer.

The following describes with reference to FIG. 2 a method for measuring the charge of calcium carbonate by charging the calcium carbonate through friction with the photosensitive layer 102. The charge of calcium carbonate is measured by the first through fourth steps. In the first step, two photosensitive layers 102 are prepared. One of the two photosensitive layers 102 is a first photosensitive layer 102*a*. The other of the two photosensitive layers 102 is a second photosensitive layer 102*b*. The first photosensitive layer 102*a* and the second photosensitive layer 102*b* each have a circular shape of a diameter of 3 cm. In the second step, 0.007 g of calcium carbonate is applied over the first photosensitive layer 102*a*. Through the above, a calcium carbonate layer 24 constituted by calcium carbonate is formed. Then, the second photosensitive layer 102*b* is layered on the calcium carbonate layer 24. In the third step, the first photosensitive layer 102*a* is rotated at a rotational speed of 60 rpm for 60 seconds while the second photosensitive layer 102*b* is kept stationary in an environment at a temperature of 23° C., and a relative humidity of 50%. Through the above, calcium carbonate contained in the calcium carbonate layer 24 is charged through friction with the first photosensitive layer 102*a* and the second photosensitive layer 102*b*. In the fourth step, the charged calcium carbonate is sucked using a charge measuring device. A total electric charge Q and a mass M of the sucked calcium carbonate are measured using the charge measuring device and a charge of calcium carbonate is calculated according to an expression Q/M. Note that the method for measuring the charge of calcium carbonate is more specifically described below in Examples. Through the above, the method for measuring the charge of calcium carbonate by charging the calcium carbonate through friction with the photosensitive layer 102 has been described with reference to FIG. 2.

The charge of calcium carbonate can be adjusted for example by changing the electron transport material and the number and the type of halogen atoms that the electron transport material has. The charge of calcium carbonate can also be adjusted for example by changing the polycarbonate resin, the terminal group of the polycarbonate resin, and the number of fluoro groups that the terminal group of the polycarbonate resin has. Further, the charge of calcium carbonate can also be adjusted for example by changing a combination of the hole transport material, the electron transport material, and the polycarbonate resin.

(Vickers Hardness)

The photosensitive layer has a Vickers hardness of at least 17.0 HV at 45° C. The Vickers hardness of the photosensitive layer at 45° C. refers to a Vickers hardness of the photosensitive layer having a temperature of 45° C. In the following description, the Vickers hardness of the photosensitive layer at 45° C. will be simply referred to as a "Vickers hardness of the photosensitive layer". In a situation in which the photosensitive layer has a Vickers hardness of less than 17.0 HV, white spots are generated in an image being formed. Reasons for this are inferred as follows. In a situation in which the photosensitive layer has a Vickers hardness of less than 17.0 HV, narrow scratches or the like may be made in the photosensitive layer of the photosensitive member through contact between the photosensitive member and another member of the image forming apparatus. When minute components of a recording medium (for example, paper dust) enter the narrow scratches or the like, the minute components entered in the narrow scratches attract other minute components of the recording medium with a result that the other minute components adhere to the surface of the photosensitive member. As a result, white spots are generated in an image being formed.

In order to inhibit generation of white spots in an image being formed, the Vickers hardness of the photosensitive layer is preferably at least 18.5 HV, more preferably at least 19.5 HV, further preferably at least 20.0 HV, and particularly preferably at least 21.0 HV. Although no specific limitation is placed on the upper limit of the Vickers hardness of the photosensitive layer as long as the photosensitive layer is capable of functioning as the photosensitive layer of the photosensitive member, the upper limit is preferably 25.0 HV in terms of manufacturing costs.

The Vickers hardness of the photosensitive layer is measured by a method in accordance with Japanese Industrial Standard (JIS) Z2244. The Vickers hardness is measured using a hardness tester (for example, "Micro Vickers Hardness Tester model DMH-1" manufactured by Matsuzawa Co., Ltd). The Vickers hardness of the photosensitive layer can be measured for example under the following conditions: a temperature of the photosensitive layer of 45° C.; a diamond indenter load (test force) of 10 gf; a time to reach the test force of 5 seconds; a diamond indenter approach speed of 2 mm/second; and a test force holding period of 1 second.

The Vickers hardness of the photosensitive layer can be adjusted for example by changing the hole transport material. It is thought that in a configuration in which the hole transport material has a structure that easily fills voids (gaps) of the polycarbonate resin having the terminal group (10), the photosensitive layer has high density and high Vickers hardness. The Vickers hardness of the photosensitive layer can also be adjusted for example by changing a combination of the hole transport material, the electron transport material, and the polycarbonate resin.

(Electron Transport Material)

The electron transport material includes the compound (1), (2), (3), (4), or (5). The compounds (1) to (5) each have a halogen atom. The halogen atom that each of the compounds (1) to (5) has is preferably a fluorine atom or a chlorine atom, and more preferably a chlorine atom. The following describes the compounds (1) to (5).

[Compound (1)]

The compound (1) is represented by general formula (1) shown below.

(1)

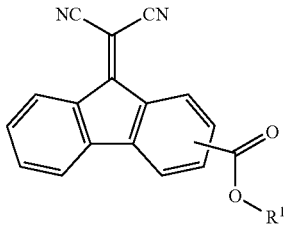

In general formula (1), $R^1$ represents: an alkyl group having a carbon number of at least 1 and no greater than 8 and at least 1 halogen atom; a cycloalkyl group having a carbon number of at least 3 and no greater than 10 and at least 1 halogen atom; an aryl group having a carbon number of at least 6 and no greater than 14 and at least 1 halogen atom and optionally having an alkyl group having a carbon number of at least 1 and no greater than 6; a heterocyclic group having at least 1 halogen atom; or an aralkyl group having a carbon number of at least 7 and no greater than 20 and at least 1 halogen atom.

In order to inhibit generation of white spots in an image being formed, $R^1$ in general formula (1) preferably represents an alkyl group having a carbon number of at least 1 and no greater than 8 and at least 1 halogen atom.

The alkyl group having a carbon number of at least 1 and no greater than 8 represented by $R^1$ in general formula (1) is preferably an alkyl group having a carbon number of at least 1 and no greater than 6, more preferably an alkyl group having a carbon number of at least 3 and no greater than 5, and particularly preferably an n-butyl group. The alkyl group having a carbon number of at least 1 and no greater than 8 represented by $R^1$ has at least 1 halogen atom. The halogen atom that the alkyl group having a carbon number of at least 1 and no greater than 8 represented by $R^1$ has is preferably a chlorine atom or a fluorine atom, and more preferably a chlorine atom.

The number of halogen atoms that the alkyl group having a carbon number of at least 1 and no greater than 8 represented by $R^1$ has is preferably 1 or 2, and more preferably 1.

The compound (1) is preferably a compound represented by chemical formula (1-E1) (hereinafter may be referred to as a compound (1-E1)).

(1-E1)

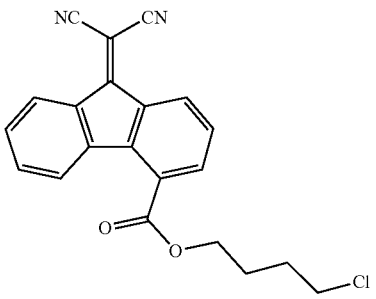

The compound (1) is produced by the following reactions (r1-1) and (r1-2) or a method conforming therewith. A process other than these reactions may be performed as necessary. In reaction formulas representing the reactions (r1-1) and (r1-2), $R^1$ represents the same as $R^1$ in general formula (1). In the following description, compounds represented by chemical formulas (1A), (1B), (1C), and (1D) may be referred to as compounds (1A), (1B), (1C), and (1D), respectively.

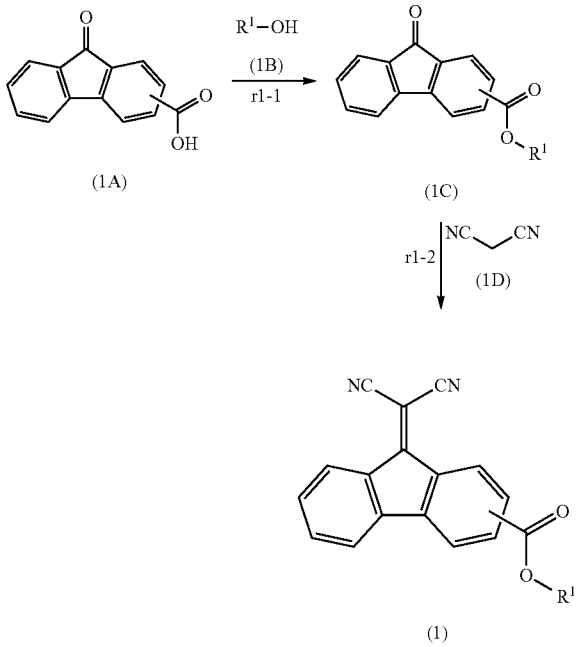

In the reaction (r1-1), 1 mol equivalent of the compound (1A) and 1 mol equivalent of the compound (1B) are caused to react with each other to yield 1 mol equivalent of the compound (1C). The reaction temperature of the reaction (r1-1) is preferably at least 80° C., and no higher than 150° C. The reaction time of the reaction (r1-1) is preferably at least two hours and no longer than ten hours. The reaction (r1-1) may be caused in the presence of a catalyst. An example of the catalyst is an acid catalyst, and a more specific example of the catalyst is a p-toluenesulfonic acid. The reaction (r1-1) may be caused in a solvent. An example of the solvent is toluene.

In the reaction (r1-2), 1 mol equivalent of the compound (1C) and 1 mol equivalent of the compound (1D) (malononitrile) are caused to react with each other to yield 1 mol equivalent of the compound (1). The reaction temperature of the reaction (r1-2) is preferably at least 40° C., and no higher than 120° C. The reaction time of the reaction (r1-2) is preferably at least one hour and no longer than ten hours. The reaction (r1-2) may be caused in the presence of a catalyst. An example of the catalyst is a base catalyst, and a more specific example of the catalyst is piperidine. The reaction (r1-2) may be caused in a solvent. An example of the solvent is a polar solvent, and a more specific example of the solvent is methanol.

[Compound (2)]

The compound (2) is represented by general formula (2) shown below.

(2)

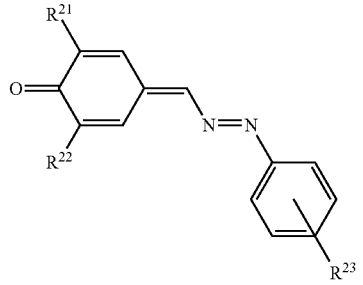

In general formula (2), $R^{21}$ and $R^{22}$ each represent, independently of each other, an alkyl group having a carbon number of at least 1 and no greater than 6. $R^{23}$ represents a halogen atom.

In order to inhibit generation of white spots in an image being formed, it is preferable that in general formula (2). $R^{21}$ and $R^{22}$ each represent, independently of each other, an alkyl group having a carbon number of at least 1 and no greater than 4 and $R^{23}$ represents a halogen atom. The alkyl group having a carbon number of at least 1 and no greater than 4 is preferably a tert-butyl group. The halogen atom is preferably a chlorine atom.

The compound (2) is preferably a compound represented by chemical formula (2-E2) (hereinafter may be referred to as a compound (2-E2)). The compound (2) can be produced by a method appropriately selected from known methods.

(2-E2)

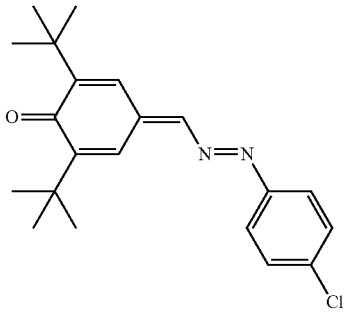

[Compound (3)]

The compound (3) is represented by general formula (3) shown below.

(3)

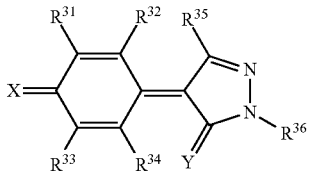

In general formula (3), $R^{3l}$, $R^{32}$, $R^{33}$, $R^{34}$, $R^{35}$, and $R^{36}$ each represent, independently of one another: a halogen atom; a hydrogen atom; an alkyl group having a carbon number of at least 1 and no greater than 6 and optionally having at least 1 halogen atom; an alkenyl group having a carbon number of at least 2 and no greater than 6 and optionally having at least 1 halogen atom an alkoxy group having a carbon number of at least 1 and no greater than 6 and optionally having at least 1 halogen atom; an aralkyl group having a carbon number of at least 7 and no greater than 20 and optionally having at least 1 halogen atom; an aryl group having a carbon number of at least 6 and no greater than 14 and optionally having at least 1 halogen atom; a heterocyclic group optionally having at least 1 halogen atom; a cyano group; a nitro group; a hydroxyl group; a carboxyl group; or an amino group, with the proviso that at least one of $R^{31}$, $R^{32}$, $R^{33}$, $R^{34}$, $R^{35}$, and $R^{36}$ represents a halogen atom or a chemical group having at least 1 halogen atom. X represents an oxygen atom, a sulfur atom or $=C(CN)_2$. Y represents an oxygen atom or a sulfur atom. Note that the chemical group having at least 1 halogen atom is: an alkyl group having a carbon number of at least 1 and no greater than 6 and at least 1 halogen atom; an alkenyl group having a carbon number of at least 2 and no greater than 6 and at least 1 halogen atom; an alkoxy group having a carbon number of at least 1 and no greater than 6 and at least 1 halogen atom; an aralkyl group having a carbon number of at least 7 and no greater than 20 and at least 1 halogen atom; an aryl group having a carbon number of at least 6 and no greater than 14 and at least 1 halogen atom; or a heterocyclic group having at least 1 halogen atom.

In order to inhibit generation of white spots in an image being formed, it is preferable that in general formula (3), $R^{31}$, $R^{32}$, $R^{33}$, $R^{34}$, $R^{35}$, and $R^{36}$ each represent, independently of one another, an alkyl group having a carbon number of at least 1 and no greater than 6 or an aryl group having a carbon number of at least 6 and no greater than 14 and at least 1 halogen atom, with the proviso that at least one of $R^{31}$, $R^{32}$, $R^{33}$, $R^{34}$, $R^{35}$, and $R^{36}$ represents an aryl group having a carbon number of at least 6 and no greater than 14 and at least 1 halogen atom, X represents an oxygen atom, and Y represents an oxygen atom.

The aryl group having a carbon number of at least 6 and no greater than 14 represented by any of $R^{31}$, $R^{32}$, $R^{33}$, $R^{34}$, $R^{35}$, and $R^{36}$ is preferably an aryl group having a carbon number of at least 6 and no greater than 10, and more preferably a phenyl group. The aryl group having a carbon number of at least 6 and no greater than 14 as above may have at least 1 halogen atom. The halogen atom that the aryl group having a carbon number of at least 6 and no greater than 14 has is preferably a fluorine atom or a chlorine atom, and more preferably a chlorine atom. The number of halogen atoms that the aryl group having a carbon number of at least 6 and no greater than 14 has is preferably at least 1 and no greater than 3, and more preferably 2.

The alkyl group having a carbon number of at least 1 and no greater than 6 represented by any of $R^{31}$, $R^{32}$, $R^{33}$, $R^{34}$, $R^{35}$, and $R^{36}$ is preferably an alkyl group having a carbon number of at least 1 and no greater than 4, and more preferably a tert-butyl group or an isopropyl group.

At least one of $R^{31}$, $R^{32}$, $R^{33}$, $R^{34}$, $R^{35}$, and $R^{36}$ represents a chemical group having a halogen atom. It is preferable that one or two of $R^{31}$, $R^{32}$, $R^{3}$, $R^{34}$, $R^{35}$, and $R^{36}$ represent a chemical group having a halogen atom, and it is more preferable that one of $R^{31}$, $R^{32}$, $R^{33}$, $R^{34}$, $R^{35}$, and $R^{36}$ represents a chemical group having a halogen atom.

The compound (3) is preferably a compound represented by chemical formula (3-E3) (hereinafter may be referred to as a compound (3-E3)). The compound (3) can be produced by a method appropriately selected from known methods.

(3-E3)

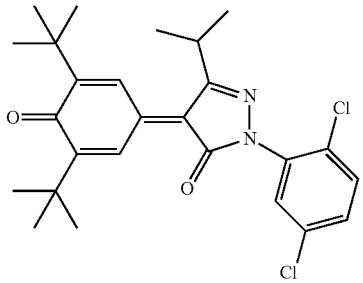

[Compound (4)]

The compound (4) is represented by general formula (4) shown below.

(4)

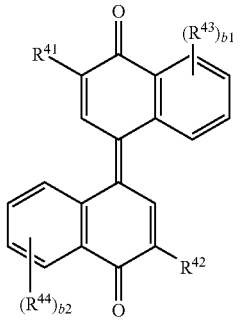

In general formula (4), $R^{41}$ and $R^{42}$ each represent, independently of each other: an alkyl group having a carbon number of at least 1 and no greater than 8 and at least 1 halogen atom an aryl group having a carbon number of at least 6 and no greater than 14 and at least 1 halogen atom and optionally having an alkyl group having a carbon number of at least 1 and no greater than 6; an aralkyl group having a carbon number of at least 7 and no greater than 20 and at least 1 halogen atom: or a cycloalkyl group having a carbon number of at least 3 and no greater than 20 and at least 1 halogen atom. $R^{43}$ and $R^{44}$ each represent, independently of each other, an alkyl group having a carbon number of at least 1 and no greater than 6, an aryl group having a carbon number of at least 6 and no greater than 14, a cycloalkyl group having a carbon number of at least 3 and no greater than 20, or a heterocyclic group. Further, b1 and b2 each represent, independently of each other, an integer of at least 0 and no greater than 4.

When b1 represents an integer of at least 2 and no greater than 4, a plurality of chemical groups $R^{43}$ may be the same as or different from one another. When b2 represents an integer of at least 2 and no greater than 4, a plurality of chemical groups $R^{44}$ may be the same as or different from one another.

In order to inhibit generation of white spots in an image being formed, it is preferable that in general formula (4), $R^{41}$ and $R^{42}$ each represent, independently of each other, an alkyl group having a carbon number of at least 1 and no greater than 8 and at least 1 halogen atom or an aralkyl group having a carbon number of at least 7 and no greater than 20 and at least 1 halogen atom, and b and b2 each represent 0.

The alkyl group having a carbon number of at least 1 and no greater than 8 represented by either or both of $R^{41}$ and $R^{42}$ is preferably an alkyl group having a carbon number of at least 1 and no greater than 4, more preferably a butyl group, and further preferably a tert-butyl group. The alkyl group having a carbon number of at least 1 and no greater than 8 has at least 1 halogen atom. The halogen atom that the alkyl group having a carbon number of at least 1 and no greater than 8 has is preferably a chlorine atom or a fluorine atom, and more preferably a chlorine atom. The number of halogen atoms that the alkyl group having a carbon number of at least 1 and no greater than 8 has is preferably at least 1 and no greater than 3, and more preferably 1.

The aralkyl group having a carbon number of at least 7 and no greater than 20 represented by either or both of $R^{41}$ and $R^{42}$ is preferably an alkyl group having a carbon number of at least 1 and no greater than 6 and an aryl group having a carbon number of at least 6 and no greater than 10, more preferably an alkyl group having a carbon number of at least 1 and no greater than 3 and a phenyl group, and further preferably a 1-phenylethyl group. The aralkyl group having a carbon number of at least 7 and no greater than 20 has at least 1 halogen atom. The halogen atom that the aralkyl group having a carbon number of at least 7 and no greater than 20 has is preferably a chlorine atom or a fluorine atom, and more preferably a chlorine atom. The number of halogen atoms that the aralkyl group having a carbon number of at least 7 and no greater than 20 has is preferably at least 1 and no greater than 3, and more preferably 1. Note that either of an aryl moiety and an alkyl moiety of the aralkyl group having a carbon number of at least 7 and no greater than 20 may have a halogen atom.

The compound (4) is preferably either of a compound represented by chemical formula (4-E4) and a compound represented by chemical formula (4-E5) (hereinafter may be referred to as a compound (4-E4) and a compound (4-E5), respectively).

(4-E4)

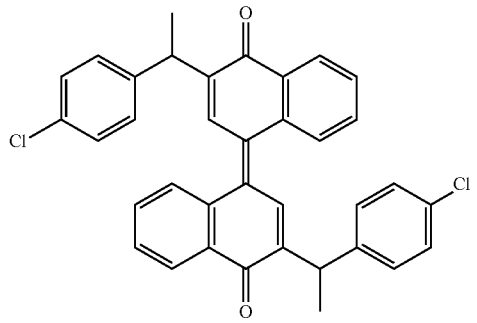

(4-E5)

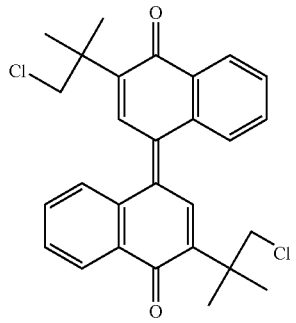

The compound (4) is produced for example by the following reactions (r4-1) to (r4-3) or a method conforming therewith. A process other than these reactions may be performed as necessary. In chemical formulas (4A) to (4F) representing the reactions (r4-1) to (r4-3), $R^{41}$, $R^{42}$, $R^{43}$, $R^{44}$, b1, and b2 represent the same as $R^{41}$, $R^{42}$, $R^{43}$, $R^{44}$, b1, and b2 in general formula (4), respectively. In the following description, compounds represented by chemical formulas (4A), (4B), (4C), (4D), (4E), and (4F) may be referred to as compounds (4A), (4B), (4C), (4D), (4E), and (4F), respectively.

In the reaction (r4-3), 1 mol equivalent of the compound (4C) and 1 mol equivalent of the compound (4F) are caused to react with each other in the presence of an oxidant to yield the compound (4). An example of the oxidant is chloranil. The reaction temperature of the reaction (r4-3) is preferably room temperature (for example, 25° C.). The reaction time of the reaction (r4-3) is preferably at least one hour and no longer than ten hours. An example of a solvent is chloroform.

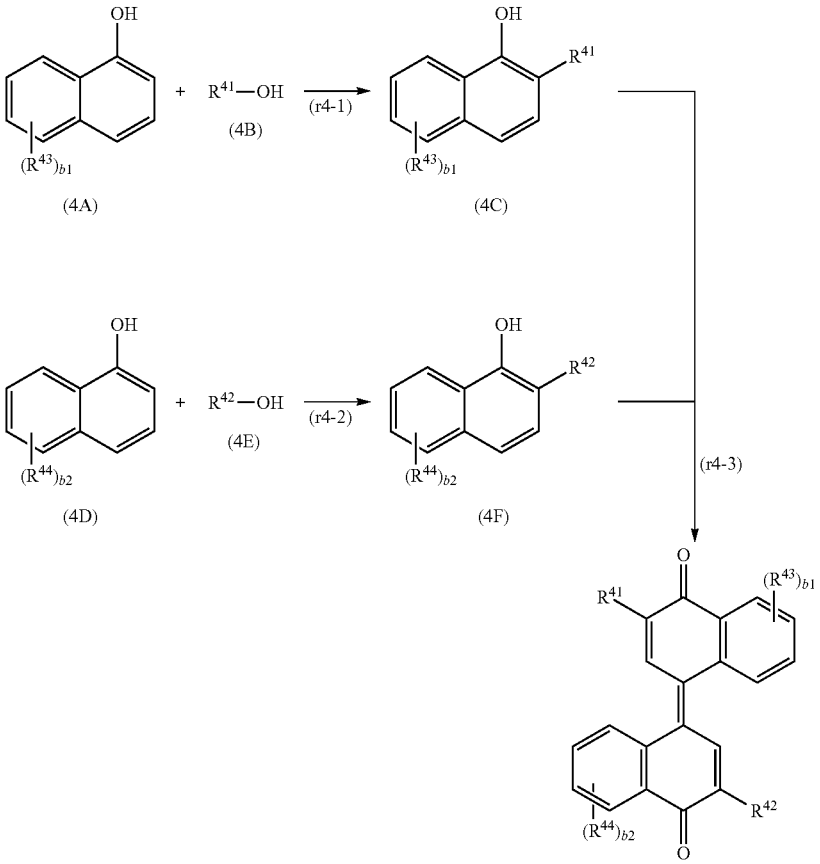

In the reaction (r4-1), 1 mol equivalent of the compound (4A) and 1 mol equivalent of the compound (4B) are caused to react with each other in the presence of a concentrated sulfuric acid to yield 1 mol equivalent of the compound (4C). The reaction temperature of the reaction (r4-1) is preferably room temperature (for example, 25° C.). The reaction time of the reaction (r4-1) is preferably at least one hour and no longer than ten hours. The reaction (r4-1) may be caused in a solvent. An example of the solvent is an acetic acid.

The reaction (r4-2) can be performed in the same manner as the reaction (r4-1) in all aspects other than the following changes. Specifically, 1 mol equivalent of the compound (4D) is used instead of 1 mol equivalent of the compound (4A). Also, 1 mol equivalent of the compound (4E) is used instead of 1 mol equivalent of the compound (4B). As a result, the compound (4F) instead of the compound (4C) is yielded by the reaction (r4-2).

[Compound (5)]

The compound (5) is represented by general formula (5) shown below.

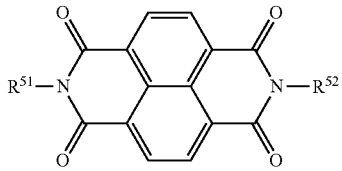

(5)

In general formula (5), $R^{51}$ and $R^{52}$ each represent, independently of each other: an aryl group having a carbon number of at least 6 and no greater than 14 and optionally having at least 1 halogen atom; an aryl group having a carbon number of at least 6 and no greater than 14 and at least 1 alkyl group having a carbon number of at least 1 and no greater than 6, and optionally having at least 1 halogen atom; an aryl group having a carbon number of at least 6 and no greater than 14 and at least 1 benzoyl group and optionally having at least 1 halogen atom; an aralkyl group having a carbon number of at least 7 and no greater than 20 and optionally having at least 1 halogen atom; an alkyl group having a carbon number of at least 1 and no greater than 8 and optionally having at least 1 halogen atom; or a cycloalkyl group having a carbon number of at least 3 and no greater than 10 and optionally having at least 1 halogen atom. At least one of $R^{51}$ and $R^{52}$ represents a chemical group having at least 1 halogen atom. The chemical group having at least 1 halogen atom is: an aryl group having a carbon number of at least 6 and no greater than 14 and at least 1 halogen atom; an aryl group having a carbon number of at least 6 and no greater than 14, at least 1 halogen atom, and at least 1 alkyl group having a carbon number of at least 1 and no greater than 6; an aryl group having a carbon number of at least 6 and no greater than 14, at least 1 halogen atom, and at least 1 benzoyl group; an aralkyl group having a carbon number of at least 7 and no greater than 20 and at least 1 halogen atom; an alkyl group having a carbon number of at least 1 and no greater than 8 and at least 1 halogen atom; or a cycloalkyl group having a carbon number of at least 3 and no greater than 10 and at least 1 halogen atom.

In order to inhibit generation of white spots in an image being formed, it is preferable that in general formula (5), $R^{51}$ and $R^{52}$ each represent, independently of each other: an aryl group having a carbon number of at least 6 and no greater than 14 and at least 1 alkyl group having a carbon number of at least 1 and no greater than 6, and optionally having at least 1 halogen atom; or an aralkyl group having a carbon number of at least 7 and no greater than 20 and optionally having at least 1 halogen atom, with the proviso that at least one of $R^{51}$ and $R^{52}$ represents a chemical group having at least 1 halogen atom.

The following describes a configuration in which $R^{51}$ and $R^{52}$ each represent an aryl group having a carbon number of at least 6 and no greater than 14 and at least 1 alkyl group having a carbon number of at least 1 and no greater than 6, and optionally having at least 1 halogen atom. The aryl group having a carbon number of at least 6 and no greater than 14 represented by either or both of $R^{51}$ and $R^{52}$ is preferably an aryl group having a carbon number of at least 6 and no greater than 10, and more preferably a phenyl group. The aryl group having a carbon number of at least 6 and no greater than 14 has at least 1 alkyl group having a carbon number of at least 1 and no greater than 6. The alkyl group having a carbon number of at least 1 and no greater than 6 that the aryl group having a carbon number of at least 6 and no greater than 14 has is preferably an alkyl group having a carbon number of at least 1 and no greater than 3, and more preferably a methyl group or an ethyl group. The number of alkyl groups having a carbon number of at least 1 and no greater than 6 that the aryl group having a carbon number of at least 6 and no greater than 14 has is preferably at least 1 and no greater than 3, more preferably 1 or 2, and further preferably 2. The aryl group having a carbon number of at least 6 and no greater than 14 may further have at least 1 halogen atom. The halogen atom that the aryl group having a carbon number of at least 6 and no greater than 14 has is preferably a chlorine atom or a fluorine atom, and more preferably a chlorine atom. The number of halogen atoms that the aryl group having a carbon number of at least 6 and no greater than 14 has is preferably at least 1 and no greater than 3, more preferably 1 or 2, and further preferably 2.

The following describes a configuration in which $R^{51}$ and $R^{52}$ each represent an aralkyl group having a carbon number of at least 7 and no greater than 20 and optionally having at least 1 halogen atom. The aralkyl group having a carbon number of at least 7 and no greater than 20 represented by either or both of $R^{51}$ and $R^{52}$ is preferably an alkyl group having a carbon number of at least 1 and no greater than 6 and an aryl group having a carbon number of at least 6 and no greater than 10, more preferably an alkyl group having a carbon number of at least 1 and no greater than 3 and a phenyl group, and further preferably a 1-phenylethyl group. The aralkyl group having a carbon number of at least 7 and no greater than 20 may have at least 1 halogen atom. The halogen atom that the aralkyl group having a carbon number of at least 7 and no greater than 20 has is preferably a chlorine atom or a fluorine atom, and more preferably a chlorine atom. The number of halogen atoms that the aralkyl group having a carbon number of at least 7 and no greater than 20 has is preferably at least 1 and no greater than 3, more preferably 1 or 2, and further preferably 2. Note that either of an aryl moiety and an alkyl moiety of the aralkyl group having a carbon number of at least 7 and no greater than 20 may have a halogen atom.

At least one of $R^{51}$ and $R^{52}$ represents a chemical group having at least 1 halogen atom. It is preferable that one of $R^{51}$ and $R^{52}$ represents a chemical group having at least 1 halogen atom and the other of $R^{1}$ and $R^{52}$ represents a chemical group having no halogen atom.

In order to inhibit generation of white spots in an image being formed, it is more preferable that in general formula (5). $R^{51}$ represents an aralkyl group having a carbon number of at least 7 and no greater than 20 and at least 1 (preferably at least 1 and no greater than 3, more preferably 1 or 2) halogen atom and $R^{52}$ represents an aryl group having a carbon number of at least 6 and no greater than 14 and at least 1 (preferably at least 1 and no greater than 3, more preferably 1 or 2) alkyl group having a carbon number of at least 1 and no greater than 6.

The compound (5) is preferably a compound represented by chemical formula (5-E6) (hereinafter may be referred to as a compound (5-E6)).

(5-E6)

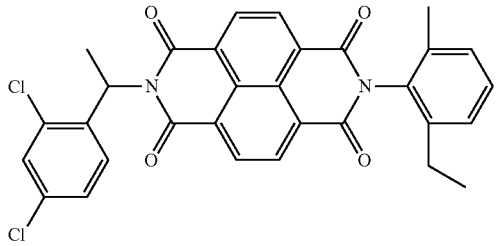

The compound (5) is produced for example by the following reactions (r5-1) to (r5-3) or a method conforming therewith. A process other than these reactions may be performed as necessary. In chemical formulas (5A) to (5E) representing the reactions (r5-1) to (r5-3), $R^{35}$ and $R^{52}$ represent the same as $R^{51}$ and $R^{52}$ in general formula (5), respectively, and $R^{53}$ represents an alkyl group. In the following description, compounds represented by chemical formulas (5A), (5B), (5C), (5D), and (5E) may be referred to as compounds (5A), (5B), (5C), (5D), and (5E), respectively.

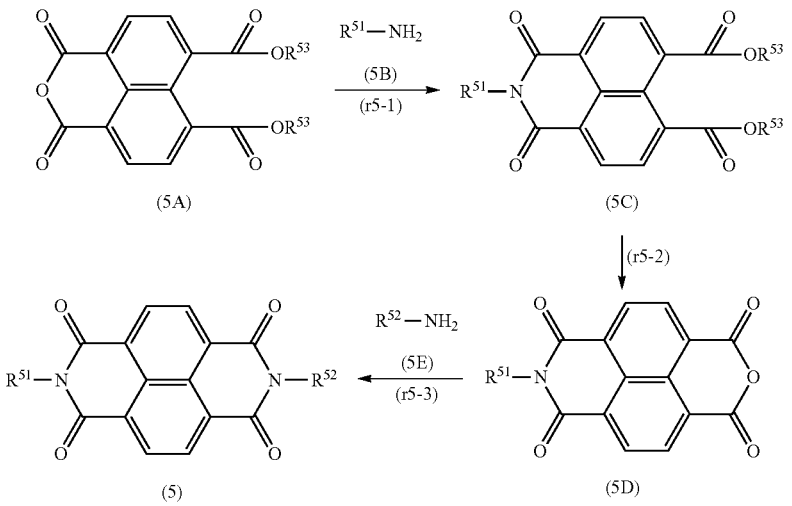

In the reaction (r5-1), 1 mol equivalent of the compound (5A) and 1 mol equivalent of the compound (5B) are caused to react with each other in the presence of a base to yield 1 mol equivalent of the compound (5C). The reaction temperature of the reaction (r5-1) is preferably at least 80° C., and no higher than 150° C. The reaction time of the reaction (r5-1) is preferably at least one hour and no longer than eight hours. The reaction (r5-1) may be caused in a solvent. An example of the solvent is dioxane. In terms of improvement of the yield of the compound (5C), it is preferable that nucleophilicity of the base is low. An example of such a base is N,N-diisopropylethylamine (Hünig's base).

In the reaction (r5-2), 1 mol equivalent of the compound (5C) is caused to react in the presence of an acid to yield 1 mol equivalent of the compound (5D). In the reaction (r5-2), a dicarboxylic acid is formed by hydrolysis of an ester of the compound (5C) in the presence of the acid, and a carboxylic anhydride is formed by cyclization of the dicarboxylic acid. Through the above, the compound (5D) is yielded. The reaction time of the reaction (r5-2) is preferably at least five hours and no longer than 30 hours. The reaction temperature of the reaction (r5-2) is preferably at least 70° C. and no higher than 150° C. The acid is preferably a trifluoroacetic acid, for example. The acid may function as a solvent.

In the reaction (r5-3), 1 mol equivalent of the compound (5D) and 1 mol equivalent of the compound (5E) are caused to react with each other in the presence of a base to yield 1 mol equivalent of the compound (5). The reaction temperature of the reaction (r5-3) is preferably at least 80° C., and no higher than 150° C. The reaction time of the reaction (r5-3) is preferably at least one hour and no longer than eight hours. The reaction (r5-3) may be caused in a solvent. An example of the solvent is dioxane. In terms of improvement of the yield of the compound (5), it is preferable that nucleophilicity of the base is low. An example of such a base is N,N-diisopropylethylamine (Hünig's base).

In a configuration for effectively inhibiting generation of white spots in an image being formed, the electron transport material is preferably the compound (1), (4), or (5), and more preferably the compound (1-E1), (4-E4), (4-E5), or (5-E6).

In another configuration for effectively inhibiting generation of white spots in an image being formed, the electron transport material is preferably the compound (1), (2), or (4), and more preferably the compound (1-E1), (2-E2), or (4-E4).

In order to significantly improve sensitivity characteristics of the photosensitive member while inhibiting generation of white spots in an image being formed, the electron transport material is preferably the compound (2), and more preferably the compound (2-E2).

The photosensitive layer may contain as the electron transport material one of the compounds (1), (2), (3), (4), and (5) alone or a combination of two or more of the compounds (1), (2). (3), (4), and (5). The photosensitive layer may contain only the compound (1), (2), (3), (4) or (5) as the electron transport material. Alternatively, the photosensitive layer may further contain an electron transport material other than the compounds (1) to (5) (hereinafter may be referred to as an additional electron transport material) in addition to the compounds (1) to (5).

Examples of the additional electron transport material include quinone compounds, diimide-based compounds, hydrazone-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride, all of which are other than the compounds (1) to (5). Examples of the quinone compounds include diphenoquinone compounds, azoquinone compounds, anthraquinone compounds, naphthoquinone compounds, nitroanthraquinone compounds, and dinitroanthraquinone compounds. One additional electron transport material may be used alone or two or more additional electron transport materials may be used in combination.

The amount of the electron transport material is preferably at least 20 parts by mass and no greater than 40 parts by mass relative to 100 parts by mass of a binder resin. In a configuration in which the amount of the electron transport material is at least 20 parts by mass relative to 100 parts by mass of the binder resin, sensitivity characteristics of the photosensitive member can be easily improved. In a configuration in which the amount of the electron transport material is no greater than 40 parts by mass relative to 100 parts by mass of the binder resin, the electron transport material can be readily dissolved in a solvent for photosensitive layer formation, and thus a uniform photosensitive layer can be readily formed.

(Binder Resin)

The photosensitive layer contains the polycarbonate resin. The polycarbonate resin is contained as the binder resin in the photosensitive layer. The polycarbonate resin has a terminal group and a main chain.

[Terminal Group]

The polycarbonate resin has the terminal group (10). The terminal group (10) is represented by general formula (10) shown below. The terminal group (10) has a fluoro group.

(10)

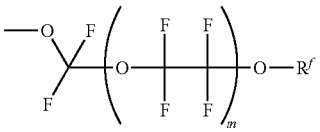

In general formula (10), $R^f$ represents a straight chain or branched chain perfluoroalkyl group having a carbon number of at least 1 and no greater than 6. Further, m represents an integer of at least 1 and no greater than 3.

The straight chain or branched chain perfluoroalkyl group having a carbon number of at least 1 and no greater than 6 represented by $R^f$ is preferably a straight chain or branched chain perfluoroalkyl group having a carbon number of at least 4 and no greater than 6, more preferably a straight chain or branched chain perfluoroalkyl group having a carbon number of 4 or 5, further preferably a branched chain perfluorobutyl group, and particularly preferably a 1,1,2,3,3,3-hexafluoro-2-trifluorometyl-propyl group.

Further, m preferably represents 1 or 2, and more preferably 1.

The terminal group (10) is preferably a terminal group represented by any of chemical formulas (10-1) to (10-6), and more preferably a terminal group represented by chemical formula (10-1). In the following description, the terminal group represented by chemical formula (10-1) may be referred to as a terminal group (10-1).

(10-1)

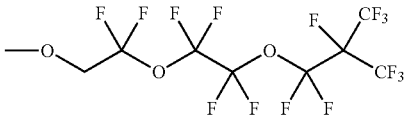

(10-2)

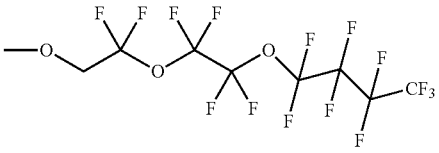

(10-3)

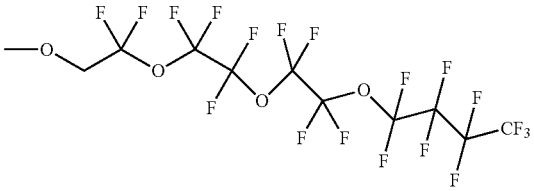

-continued (10-4)

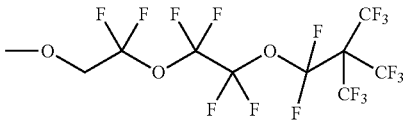

(10-5)

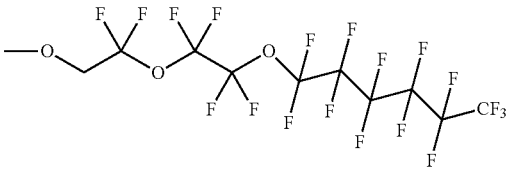

(10-6)

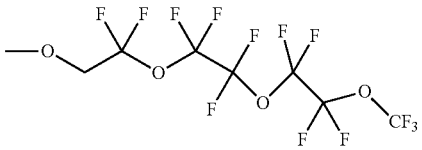

The polycarbonate resin having the terminal group (10) is represented by general formula (PC) shown below.

(PC)

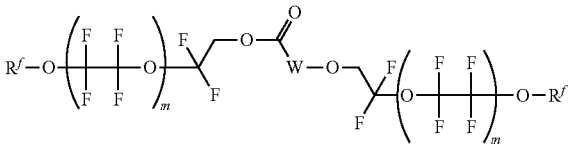

In general formula (PC), W represents the main chain. The main chain includes a polycarbonate bond (—O—CO—O—). $R^f$ and m in general formula (PC) represent the same as $R^f$ and m in general formula (10), respectively. As shown in general formula (PC), the polycarbonate resin has two terminal groups (10), one of which is directly bonded to the main chain and the other of which is bonded to the main chain with a carbonyl group (—CO—) therebetween.

[Main Chain]

The polycarbonate resin has the main chain in addition to the terminal group (10). The main chain preferably has no halogen atom. In a configuration in which the terminal group (10) has a fluoro group and the main chain has no halogen atom, compatibility of the polycarbonate resin with the hole transport material and the electron transport material can be improved to effectively inhibit crystallization of the photosensitive layer. Also, it is thought that in a configuration in which the terminal group (10) has a fluoro group and the main chain has no halogen atom, the main chain tends to be entangled, enabling improvement in crack resistance of the photosensitive layer.

When the main chain has no halogen atom, the main chain preferably includes a repeating unit represented by general formula (11) and a repeating unit represented by general formula (12) (hereinafter may be referred to as a repeating unit (11) and a repeating unit (12), respectively). That is, the polycarbonate resin preferably further has the repeating units (11) and (12) in addition to the terminal group (10).

(11)

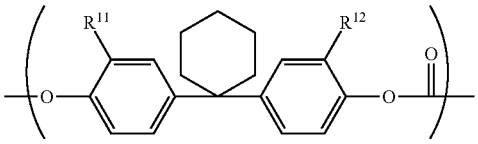

(12)

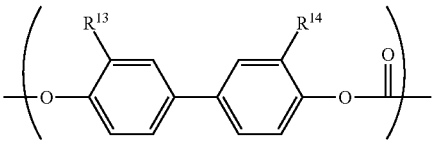

In general formulas (11) and (12), $R^{11}$, $R^{12}$, $R^{13}$, and $R^{14}$ each represent a hydrogen atom; $R^{11}$ and $R^{12}$ each represent a hydrogen atom and $R^{13}$ and $R^{14}$ each represent, independently of each other, an alkyl group having a carbon number of at least 1 and no greater than 6; or $R^{11}$ and $R^{12}$ each represent, independently of each other, an alkyl group having a carbon number of at least 1 and no greater than 6 and $R^{13}$ and $R^{14}$ each represent a hydrogen atom. Note that not all of $R^{11}$, $R^{12}$, $R^{13}$, and $R^{14}$ represent an alkyl group having a carbon number of at least 1 and no greater than 6.

The alkyl group having a carbon number of at least 1 and no greater than 6 represented by any of $R^{11}$, $R^{12}$, $R^{13}$, and $R^{14}$ is preferably an alkyl group having a carbon number of at least 1 and no greater than 3, and more preferably a methyl group.

Preferable examples of the repeating unit (11) include repeating units represented by chemical formulas (11-1) and (11-2) shown below. In the following description, the repeating units represented by chemical formulas (11-1) and (11-2) may be referred to as repeating units (11-1) and (11-2), respectively.

(11-1)

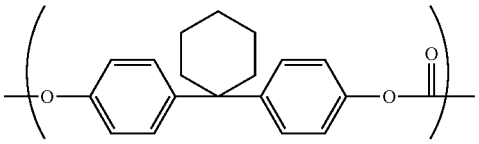

(11-2)

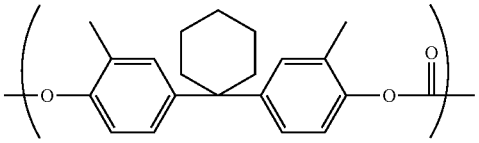

Preferable examples of the repeating unit (12) include repeating units represented by chemical formulas (12-1) and (12-2) shown below. In the following description, the repeating units represented by chemical formulas (12-1) and (12-2) may be referred to as repeating units (12-1) and (12-2), respectively.

(12-1)

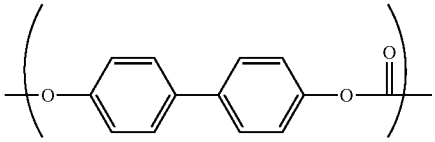

-continued (12-2)

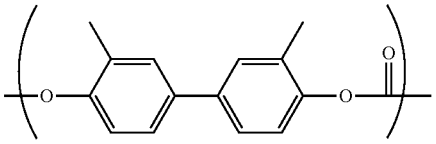

Preferable examples of the polycarbonate resin having the terminal group (10) include a first polycarbonate resin, a second polycarbonate resin, and a third polycarbonate resin. The first polycarbonate resin has the terminal group (10-1) and the repeating units (11-1) and (12-1). The second polycarbonate resin has the terminal group (10-1) and the repeating units (11-2) and (12-1). The third polycarbonate resin has the terminal group (10-1) and the repeating units (11-1) and (12-2).

A ratio of the number of repeating units (11) to a sum of the number of the repeating units (11) and the number of repeating units (12) (hereinafter may be referred to as a ratio p) is preferably at least 0.10 and no greater than 0.90, more preferably at least 0.30 and no greater than 0.70, further preferably at least 0.50 and no greater than 0.70, and particularly preferably 0.60.

A ratio of the number of the repeating units (12) to the sum of the number of the repeating units (11) and the number of the repeating units (12) (hereinafter may be referred to as a ratio q) is preferably at least 0.10 and no greater than 0.90, more preferably at least 0.30 and no greater than 0.70, further preferably at least 0.30 and no greater than 0.50, and particularly preferably 0.40.

Each of the ratios p and q and s is not a value calculated for a single molecular chain, but is an average value of values calculated for the whole polycarbonate resin (a plurality of molecular chains) contained in the photosensitive layer. The ratios p and q can be calculated from a $^{1}$H-NMR spectrum of the polycarbonate resin measured using a proton nuclear magnetic resonance spectrometer.

The viscosity average molecular weight of the polycarbonate resin having the terminal group (10) is preferably at least 25,000, more preferably at least 25,000 and no greater than 60,000, and further preferably at least 30,000 and no greater than 52,500. In a configuration in which the viscosity average molecular weight of the polycarbonate resin having the terminal group (10) is at least 25,000, abrasion resistance of the photosensitive member can be easily improved. In a configuration in which the viscosity average molecular weight of the polycarbonate resin having the terminal group (10) is no greater than 60,000, the polycarbonate resin having the terminal group (10) can be readily dissolved in a solvent for photosensitive layer formation and an application liquid for photosensitive layer formation does not have an excessively high viscosity. As a result, formation of the photosensitive layer is facilitated.

The polycarbonate resin having the terminal group (10) may be a random copolymer in which the repeating units (11) and (12) are randomly arranged. Alternatively, the polycarbonate resin having the terminal group (10) may be an alternating copolymer in which the repeating units (11) and (12) are alternately arranged. Alternatively, the polycarbonate resin having the terminal group (10) may be a periodic copolymer in which at least one repeating unit (11) and at least one repeating unit (12) are periodically arranged. Alternatively, the polycarbonate resin having the terminal group (10) may be a block copolymer including a block of a plurality of repeating units (11) and a block of a plurality of repeating units (12).

The polycarbonate resin having the terminal group (10) may have only the repeating units (11) and (12) as repeating units. Alternatively, the polycarbonate resin having the terminal group (10) may further have a repeating unit other than the repeating units (11) and (12) as an additional repeating unit in addition to the repeating units (11) and (12). The repeating units (11) and (12) preferably account for at least 80% by number of all repeating units, more preferably at least 90% by number, and particularly preferably 100% by number.

The photosensitive layer may contain, as the binder resin, one polycarbonate resin having the terminal group (10) or a combination of two or more polycarbonate resins having the terminal group (10).

The photosensitive layer may contain, as the binder resin, only the polycarbonate resin having the terminal group (10). Alternatively, the photosensitive layer may further contain, as the binder resin, a resin other than the polycarbonate resin having the terminal group (10) in addition to the polycarbonate resin having the terminal group (10).

No specific limitation is placed on a method for producing the polycarbonate resin having the terminal group (10) as long as the polycarbonate resin having the terminal group (10) can be produced. An example of the method for producing the polycarbonate resin having the terminal group (10) is polycondensation of a diol compound for forming a repeating unit, phosgene for forming a repeating unit, and a compound represented by general formula (10a) that is a chain terminating agent (i.e., phosgene method). For example, the polycarbonate resin having the terminal group (10) can be produced by polycondensation of a diol compound represented by general formula (11a), a diol compound represented by general formula (12a), phosgene, and the compound represented by general formula (10a) that is the chain terminating agent. Note that $R^f$ and m in general formula (10a) represent the same as $R^f$ and m in general formula (10), respectively. Also, $R^{11}$, $R^{12}$, $R^{13}$, and $R^{14}$ in general formulas (11a) and (12a) represent the same as $R^{11}$, $R^{12}$, $R^{13}$, and $R^{14}$ in general formulas (11) and (12), respectively. Another example of the method for producing the polycarbonate resin having the terminal group (10) is an ester exchange reaction between a diol compound and diphenyl carbonate.

(10a)

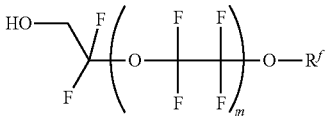

(11a)

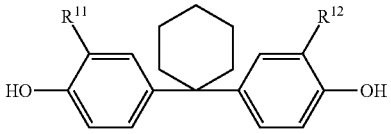

(12a)

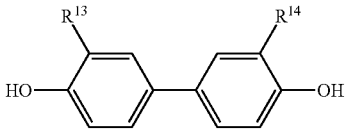

(Hole Transport Material)

The hole transport material includes the compound (20), (21), (22), (23), (24), (25), (26), or (27). The following describes the compounds (20) to (27).

[Compound (20)]

The compound (20) is represented by general formula (20) shown below.

(20)

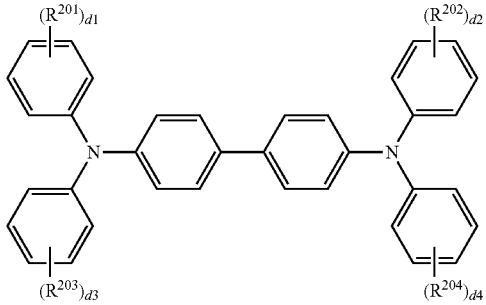

In general formula (20), $R^{201}$, $R^{202}$, $R^{203}$, and $R^{204}$ each represent, independently of one another, an alkyl group having a carbon number of at least 1 and no greater than 6. Further, d1, d2, d3, and d4 each represent, independently of one another, an integer of at least 0 and no greater than 5.

When d1 represents an integer of at least 2 and no greater than 5, a plurality of chemical groups $R^{201}$ may be the same as or different from one another. When d2 represents an integer of at least 2 and no greater than 5, a plurality of chemical groups $R^{202}$ may be the same as or different from one another. When d3 represents an integer of at least 2 and no greater than 5, a plurality of chemical groups $R^{203}$ may be the same as or different from one another. When d4 represents an integer of at least 2 and no greater than 5, a plurality of chemical groups $R^{204}$ may be the same as or different from one another.

The alkyl group having a carbon number of at least 1 and no greater than 6 represented by any of $R^{201}$, $R^{202}$, $R^{203}$, and $R^{204}$ is preferably an alkyl group having a carbon number of at least 1 and no greater than 3, and more preferably a methyl group. Preferably, d1, d2, d3, and d4 each represent, independently of one another, 0 or 1. More preferably, d1 and d2 each represent 1 and d3 and d4 each represent 0.

A preferable example of the compound (20) is a compound represented by chemical formula (20-H1) shown below (hereinafter may be referred to as a compound (20-H1)), (20-H1)

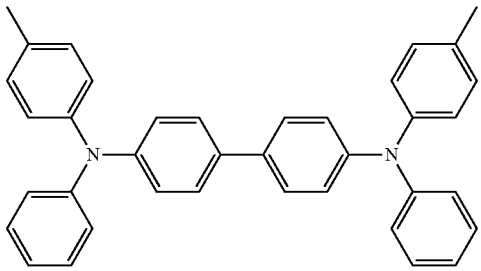

[Compound (21)]

The compound (21) is represented by general formula (21) shown below.

(21)

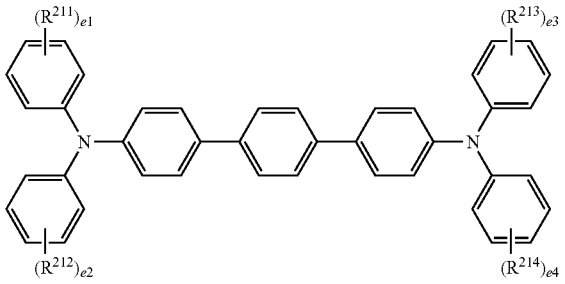

In general formula (21), $R^{211}$, $R^{212}$, $R^{213}$, and $R^{214}$ each represent, independently of one another, an alkyl group having a carbon number of at least 1 and no greater than 6. Further, e1, e2, e3, and e4 each represent, independently of one another, an integer of at least 0 and no greater than 5.

When e1 represents an integer of at least 2 and no greater than 5, a plurality of chemical groups $R^{21}$ may be the same as or different from one another. When e2 represents an integer of at least 2 and no greater than 5, a plurality of chemical groups $R^{212}$ may be the same as or different from one another. When e3 represents an integer of at least 2 and no greater than 5, a plurality of chemical groups $R^{213}$ may be the same as or different from one another. When e4 represents an integer of at least 2 and no greater than 5, a plurality of chemical groups $R^{214}$ may be the same as or different from one another.

The alkyl group having a carbon number of at least 1 and no greater than 6 represented by any of $R^{211}$, $R^{212}$, $R^{213}$, and $R^{214}$ is preferably an alkyl group having a carbon number of at least 1 and no greater than 3, and more preferably a methyl group. Preferably, e1, e2, e3, and e4 each represent, independently of one another, 0 or 1. More preferably, e1 and e3 each represent 1 and e2 and e4 each represent 0.

A preferable example of the compound (21) is a compound represented by chemical formula (21-H2) shown below (hereinafter may be referred to as a compound (21-H2)).

(21-H2)

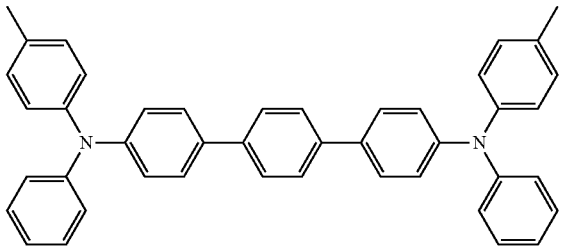

[Compound (22)]

The compound (22) is represented by general formula (22) shown below.

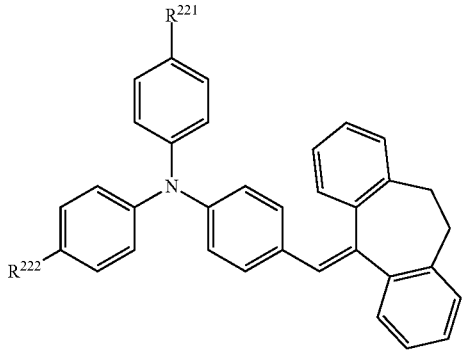

In general formula (22), $R^{221}$ and $R^{222}$ each represent, independently of each other, a hydrogen atom or an alkyl group having a carbon number of at least 1 and no greater than 6.

$R^{221}$ and $R^{222}$ each preferably represent, independently of each other, an alkyl group having a carbon number of at least 1 and no greater than 6, and more preferably an alkyl group having a carbon number of at least 1 and no greater than 3. Further preferably, $R^{221}$ and $R^{222}$ each represent a methyl group.

A preferable example of the compound (22) is a compound represented by chemical formula (22-H3) shown below (hereinafter may be referred to as a compound (22-H3)).

(22-H3)

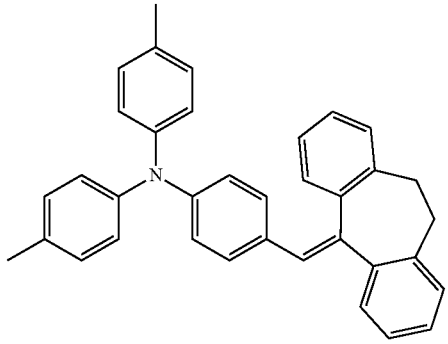

[Compound (23)]

The compound (23) is represented by general formula (23) shown below.

(23)

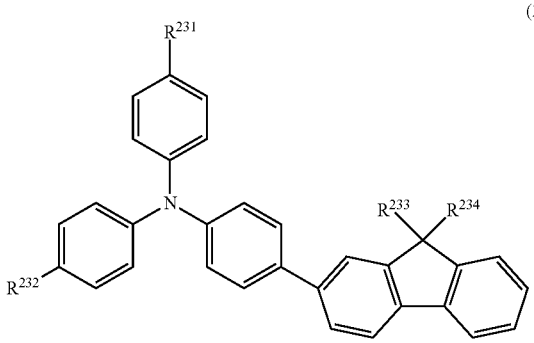

In general formula (23), $R^{231}$, $R^{232}$, $R^{233}$, and $R^{234}$ each represent, independently of one another, a hydrogen atom or an alkyl group having a carbon number of at least 1 and no greater than 6.

$R^{231}$, $R^{232}$, $R^{233}$, and $R^{234}$ each preferably represent, independently of one another, an alkyl group having a carbon number of at least 1 and no greater than 6, and more preferably an alkyl group having a carbon number of at least 1 and no greater than 3. Further preferably, $R^{231}$, $R^{232}$, $R^{233}$, and $R^{234}$ each represent a methyl group.

A preferable example of the compound (23) is a compound represented by chemical formula (23-H4) shown below (hereinafter may be referred to as a compound (23-H4)).

(23-H4)

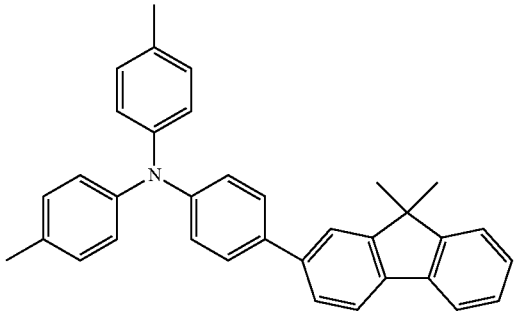

[Compound (24)]

The compound (24) is represented by general formula (24) shown below.

(24)

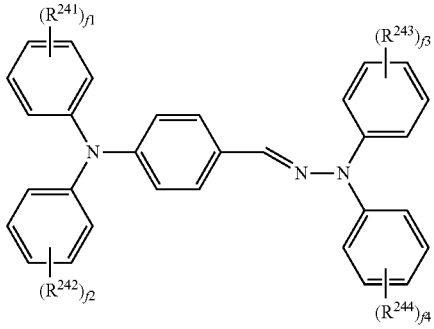

In general formula (24), $R^{241}$, $R^{242}$, $R^{243}$, and $R^{244}$ each represent, independently of one another, an alkyl group having a carbon number of at least 1 and no greater than 6. Further, f1, f2, f3, and f4 each represent, independently of one another, an integer of at least 0 and no greater than 5.

When f1 represents an integer of at least 2 and no greater than 5, a plurality of chemical groups $R^{241}$ may be the same as or different from one another. When f2 represents an integer of at least 2 and no greater than 5, a plurality of chemical groups $R^{242}$ may be the same as or different from one another. When f3 represents an integer of at least 2 and no greater than 5, a plurality of chemical groups $R^{243}$ may be the same as or different from one another. When f4 represents an integer of at least 2 and no greater than 5, a plurality of chemical groups $R^{244}$ may be the same as or different from one another.

The alkyl group having a carbon number of at least 1 and no greater than 6 represented by any of $R^{241}$, $R^{242}$, $R^{243}$, and $R^{244}$ is preferably an alkyl group having a carbon number of at least 1 and no greater than 3, and more preferably a methyl group. Preferably, f1, f2, f3, and f4 each represent, independently of one another, 0 or 1. More preferably, f1 and 12 each represent 1 and f3 and f4 each represent 0.

A preferable example of the compound (24) is a compound represented by chemical formula (24-H5) shown below (hereinafter may be referred to as a compound (24-H5)).

(24-H5)

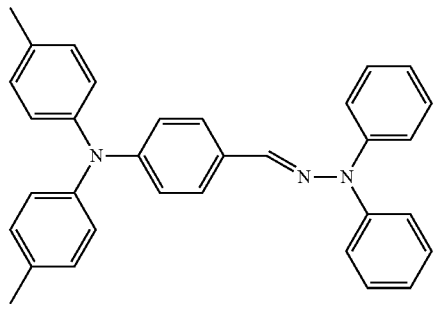

[Compound (25)]

The compound (25) is represented by general formula (25) shown below.

(25)

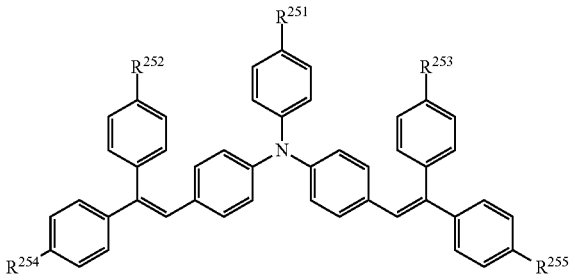

In general formula (25), $R^{25}$, $R^{252}$, $R^{253}$, $R^{254}$, and $R^{255}$ each represent, independently of one another, a hydrogen atom or an alkyl group having a carbon number of at least 1 and no greater than 6.

The alkyl group having a carbon number of at least 1 and no greater than 6 represented by any of $R^{251}$, $R^{252}$, $R^{253}$, $R^{254}$, and $R^{255}$ is preferably an alkyl group having a carbon number of at least 1 and no greater than 3, and more preferably a methyl group.

A preferable example of the compound (25) is a compound represented by chemical formula (25-H6) shown below (hereinafter may be referred to as a compound (25-H6)).

(25-H6)

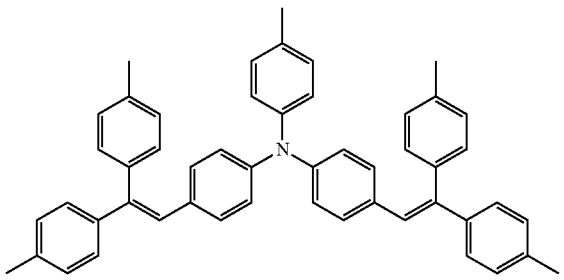

[Compound (26)]

The compound (26) is represented by general formula (26) shown below.

(26)

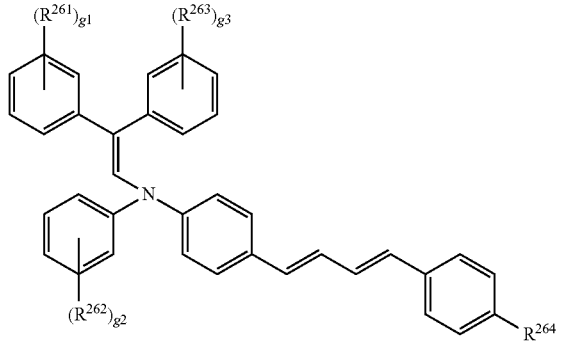

In general formula (26), $R^{261}$, $R^{262}$, and $R^{263}$ each represent, independently of one another, an alkyl group having a carbon number of at least 1 and no greater than 6. Further, g1, g2, and g3 each represent, independently of one another, an integer of at least 0 and no greater than 5. $R^{264}$ represents a hydrogen atom or an alkyl group having a carbon number of at least 1 and no greater than 6.

When g1 represents an integer of at least 2 and no greater than 5, a plurality of chemical groups $R^{261}$ may be the same as or different from one another. When g2 represents an integer of at least 2 and no greater than 5, a plurality of chemical groups $R^{262}$ may be the same as or different from one another. When g3 represents an integer of at least 2 and no greater than 5, a plurality of chemical groups $R^{263}$ may be the same as or different from one another.

The alkyl group having a carbon number of at least 1 and no greater than 6 represented by any of $R^{261}$, $R^{262}$, $R^{263}$, and $R^{264}$ is preferably an alkyl group having a carbon number of at least 1 and no greater than 3, and more preferably a methyl group. Further, g1, g2, and g3 each preferably represent 1 or 0, and more preferably 0. $R^{264}$ preferably represents a hydrogen atom.

A preferable example of the compound (26) is a compound represented by chemical formula (26-H7) shown below (hereinafter may be referred to as a compound (26-H7)).

(26-H7)

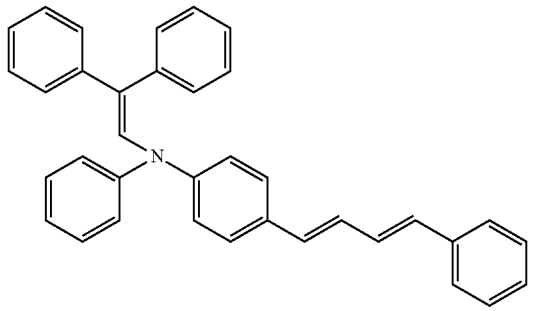

[Compound (27)]

The compound (27) is represented by general formula (27) shown below.

(27)

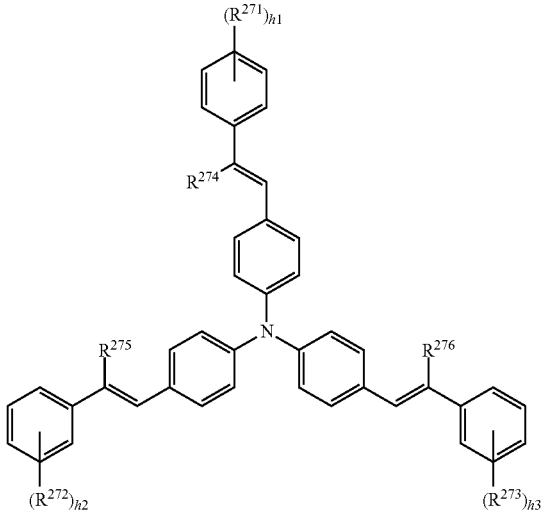

In general formula (27), $R^{271}$, $R^{272}$, and $R^{273}$ each represent, independently of one another, an alkyl group having a carbon number of at least 1 and no greater than 6. Further, h1, h2, and h3 each represent, independently of one another, an integer of at least 0 and no greater than 5. $R^{274}$, $R^{275}$, and $R^{276}$ each represent, independently of one another, a hydrogen atom or an aryl group having a carbon number of at least 6 and no greater than 14.

When h1 represents an integer of at least 2 and no greater than 5, a plurality of chemical groups $R^{271}$ may be the same as or different from one another. When h2 represents an integer of at least 2 and no greater than 5, a plurality of chemical groups $R^{272}$ may be the same as or different from one another. When h3 represents an integer of at least 2 and no greater than 5, a plurality of chemical groups $R^{273}$ may be the same as or different from one another.

The alkyl group having a carbon number of at least 1 and no greater than 6 represented by any of $R^{271}$, $R^{272}$, and $R^{273}$ is preferably an alkyl group having a carbon number of at least 1 and no greater than 3, and more preferably a methyl group. Further, h1, h2, and h3 each preferably represent, independently of one another, 0 or 1. The aryl group having a carbon number of at least 6 and no greater than 14 represented by any of $R^{274}$, $R^{275}$, and $R^{276}$ is preferably an aryl group having a carbon number of at least 6 and no greater than 10, and more preferably a phenyl group.

Preferable examples of the compound (27) include compounds represented by chemical formulas (27-H8) and (27-H9) shown below (hereinafter may be referred to as compounds (27-H8) and (27-H9), respectively).

(27-H8)

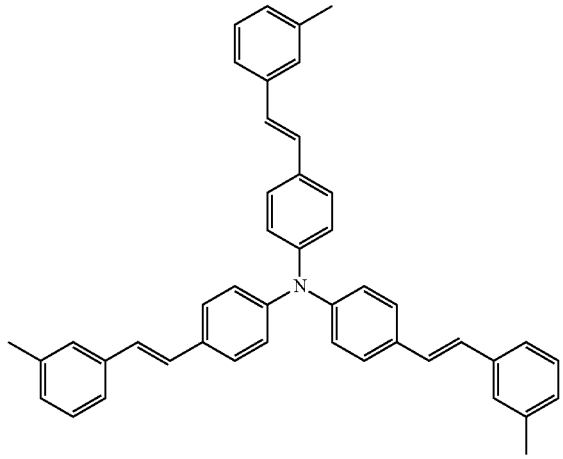

(27-H9)

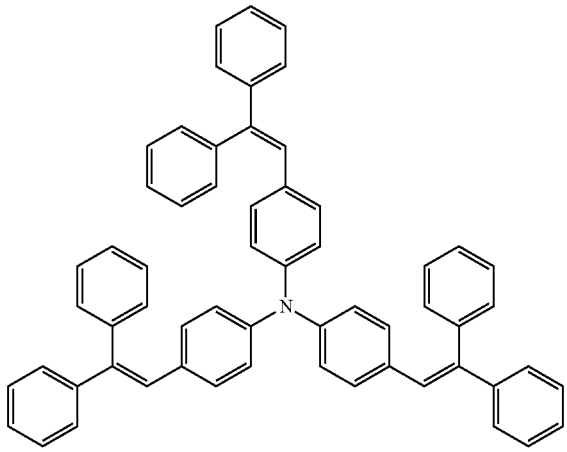

In order to inhibit generation of white spots in an image being formed, the hole transport material is preferably the compound (20), (22), (23), (25), or (27), and more preferably the compound (20-H1), (22-H3), (23-H4), (25-H6), or (27-H8).

In order to significantly improve sensitivity characteristics of the photosensitive member while inhibiting generation of white spots in an image being formed, the hole transport material is preferably the compound (27), and more preferably the compound (27-H9).

The photosensitive layer may contain, as the hole transport material, one of the compounds (20), (21), (22), (23), (24), (25), (26), and (27) alone or a combination of two or more of the compounds (20), (21), (22), (23), (24), (25), (26), and (27). The photosensitive layer may contain, as the hole transport material, only the compound (20), (21), (22), (23), (24), (25), (26), or (27). Alternatively, the photosensitive layer may further contain a hole transport material other than the compounds (20) to (27) (hereinafter may be referred to as an additional hole transport material) in addition to the compounds (20) to (27).

Examples of the additional hole transport material include triphenylamine derivatives, diamine derivatives (specific examples include N,N,N',N'-tetraphenylbenzidine derivative, N,N,N',N'-tetraphenylphenylenediamine derivative, N,N,N',N'-tetraphenylnaphthylenediamine derivative, N,N,N',N'-tetraphenylphenantolylenediamine derivative, and di(aminophenylethenyl)benzene derivative), oxadiazole-based compounds (specific examples include 2,5-di(4-methylaminophenyl)-1,3,4-oxadiazole), styryl-based compounds (specific examples include 9-(4-diethylaminostyryl)anthracene), carbazole-based compounds (specific examples include polyvinyl carbazole), organic polysilane compounds, pyrazoline-based compounds (specific examples include 1-phenyl-3-(p-dimethylaminophenyl)pyrazoline), hydrazone-based compounds, indole-based compounds, oxazole-based compounds, isoxazole-based compounds, thiazole-based compounds, thiadiazole-based compounds, imidazole-based compounds, pyrazole-based compounds, and triazole-based compounds, all of which are other than the compounds (20) to (27). One additional hole transport material may be used alone or two or more additional hole transport materials may be used in combination.

The amount of the hole transport material contained in the photosensitive layer is preferably at least 10 parts by mass and no greater than 200 parts by mass relative to 100 parts by mass of the binder resin, and more preferably at least 10 parts by mass and no greater than 100 parts by mass.

(Combination of Materials)

In order to inhibit generation of white spots in an image being formed, it is preferable to employ any of the following combinations of a polycarbonate resin and an electron transport material. It is more preferable to employ any of the following combinations of a polycarbonate resin and an electron transport material and use X-form metal-free phthalocyanine as a charge generating material. The preferable combinations are those in which:

the polycarbonate resin is the first polycarbonate resin and the electron transport material is the compound (2);

the polycarbonate resin is the second polycarbonate resin and the electron transport material is the compound (2);

the polycarbonate resin is the third polycarbonate resin and the electron transport material is the compound (2);

the polycarbonate resin is the second polycarbonate resin and the electron transport material is the compound (1);

the polycarbonate resin is the second polycarbonate resin and the electron transport material is the compound (3);

the polycarbonate resin is the second polycarbonate resin and the electron transport material is the compound (4); or the polycarbonate resin is the second polycarbonate resin and the electron transport material is the compound (5).

In order to inhibit generation of white spots in an image being formed, it is more preferable to employ any of the following combinations of a polycarbonate resin and an electron transport material. It is still more preferable to employ any of the following combinations of a polycarbonate resin and an electron transport material and use the X-form metal-free phthalocyanine as a charge generating material. The preferable combinations are those in which:

the polycarbonate resin is the first polycarbonate resin and the electron transport material is the compound (2-E2);

the polycarbonate resin is the second polycarbonate resin and the electron transport material is the compound (2-E2);

the polycarbonate resin is the third polycarbonate resin and the electron transport material is the compound (2-E2);

the polycarbonate resin is the second polycarbonate resin and the electron transport material is the compound (1-E1);

the polycarbonate resin is the second polycarbonate resin and the electron transport material is the compound (3-E3);

the polycarbonate resin is the second polycarbonate resin and the electron transport material is the compound (4-E4);

the polycarbonate resin is the second polycarbonate resin and the electron transport material is the compound (4-E5); or the polycarbonate resin is the second polycarbonate resin and the electron transport material is the compound (5-E6).

In order to inhibit generation of white spots in an image being formed, it is preferable to employ any of the following combinations of a polycarbonate resin, an electron transport material, and a hole transport material. It is more preferable to employ any of the following combinations of a polycarbonate resin, an electron transport material, and a hole transport material and use the X-form metal-free phthalocyanine as a charge generating material. The preferable combinations are those in which:

the polycarbonate resin is the first polycarbonate resin, the electron transport material is the compound (2), and the hole transport material is the compound (20);

the polycarbonate resin is the second polycarbonate resin, the electron transport material is the compound (2), and the hole transport material is the compound (20);

the polycarbonate resin is the third polycarbonate resin, the electron transport material is the compound (2), and the hole transport material is the compound (20);

the polycarbonate resin is the second polycarbonate resin, the electron transport material is the compound (2), and the hole transport material is the compound (21);

the polycarbonate resin is the second polycarbonate resin, the electron transport material is the compound (2), and the hole transport material is the compound (22);

the polycarbonate resin is the second polycarbonate resin, the electron transport material is the compound (2), and the hole transport material is the compound (23);

the polycarbonate resin is the second polycarbonate resin, the electron transport material is the compound (2), and the hole transport material is the compound (24);

the polycarbonate resin is the second polycarbonate resin, the electron transport material is the compound (2), and the hole transport material is the compound (25);

the polycarbonate resin is the second polycarbonate resin, the electron transport material is the compound (2), and the hole transport material is the compound (26);

the polycarbonate resin is the second polycarbonate resin, the electron transport material is the compound (2), and the hole transport material is the compound (27);

the polycarbonate resin is the second polycarbonate resin, the electron transport material is the compound (1), and the hole transport material is the compound (25);

the polycarbonate resin is the second polycarbonate resin, the electron transport material is the compound (3), and the hole transport material is the compound (25);

the polycarbonate resin is the second polycarbonate resin, the electron transport material is the compound (4), and the hole transport material is the compound (25);

the polycarbonate resin is the second polycarbonate resin, the electron transport material is the compound (1), and the hole transport material is the compound (20);

the polycarbonate resin is the second polycarbonate resin, the electron transport material is the compound (3), and the hole transport material is the compound (20);

the polycarbonate resin is the second polycarbonate resin, the electron transport material is the compound (4), and the hole transport material is the compound (20);

the polycarbonate resin is the second polycarbonate resin, the electron transport material is the compound (4), and the hole transport material is the compound (20); or the polycarbonate resin is the second polycarbonate resin, the electron transport material is the compound (5), and the hole transport material is the compound (20).

In order to inhibit generation of white spots in an image being formed, it is more preferable to employ any of the following combinations of a polycarbonate resin, an electron transport material, and a hole transport material. It is still more preferable to employ any of the following combinations of a polycarbonate resin, an electron transport material, and a hole transport material and use the X-form metal-free phthalocyanine as a charge generating material. The preferable combinations are those in which:

the polycarbonate resin is the first polycarbonate resin, the electron transport material is the compound (2-E2), and the hole transport material is the compound (20-H1);

the polycarbonate resin is the second polycarbonate resin, the electron transport material is the compound (2-E2), and the hole transport material is the compound (20-H1);

the polycarbonate resin is the third polycarbonate resin, the electron transport material is the compound (2-E2), and the hole transport material is the compound (20-H1);

the polycarbonate resin is the second polycarbonate resin, the electron transport material is the compound (2-E2), and the hole transport material is the compound (21-H2);

the polycarbonate resin is the second polycarbonate resin, the electron transport material is the compound (2-E2), and the hole transport material is the compound (22-H3);

the polycarbonate resin is the second polycarbonate resin, the electron transport material is the compound (2-E2), and the hole transport material is the compound (23-H4);

the polycarbonate resin is the second polycarbonate resin, the electron transport material is the compound (2-E2), and the hole transport material is the compound (24-H5);

the polycarbonate resin is the second polycarbonate resin, the electron transport material is the compound (2-E2), and the hole transport material is the compound (25-H6);

the polycarbonate resin is the second polycarbonate resin, the electron transport material is the compound (2-E2), and the hole transport material is the compound (26-H7);

the polycarbonate resin is the second polycarbonate resin, the electron transport material is the compound (2-E2), and the hole transport material is the compound (27-H8);

the polycarbonate resin is the second polycarbonate resin, the electron transport material is the compound (2-E2), and the hole transport material is the compound (27-H9);

the polycarbonate resin is the second polycarbonate resin, the electron transport material is the compound (1-E1), and the hole transport material is the compound (25-H6);

the polycarbonate resin is the second polycarbonate resin, the electron transport material is the compound (3-E3), and the hole transport material is the compound (25-H6);

the polycarbonate resin is the second polycarbonate resin, the electron transport material is the compound (4-E4), and the hole transport material is the compound (25-H6);

the polycarbonate resin is the second polycarbonate resin, the electron transport material is the compound (1-E1), and the hole transport material is the compound (20-H1);

the polycarbonate resin is the second polycarbonate resin, the electron transport material is the compound (3-E3), and the hole transport material is the compound (20-H1):

the polycarbonate resin is the second polycarbonate resin, the electron transport material is the compound (4-E4), and the hole transport material is the compound (20-H1);

the polycarbonate resin is the second polycarbonate resin, the electron transport material is the compound (4-E5), and the hole transport material is the compound (20-H1); or the polycarbonate resin is the second polycarbonate resin, the electron transport material is the compound (5-E6), and the hole transport material is the compound (20-H1).

In order to inhibit generation of white spots in an image being formed particularly effectively, the following first or second configuration is preferable. In order to significantly improve sensitivity characteristics of the photosensitive member while inhibiting generation of white spots in an image being formed, the following third configuration is preferable.

First, the first configuration will be described. In the first configuration, the electron transport material is the compound (1), (4), or (5).

In order to inhibit generation of white spots in an image being formed particularly effectively, it is preferable that the polycarbonate resin is the second polycarbonate resin and the electron transport material is the compound (1), (4), or (5). It is more preferable that the polycarbonate resin is the second polycarbonate resin and the electron transport material is the compound (1-E1), (4-E4), (4-E5), or (5-E6).

In order to inhibit generation of white spots in an image being formed particularly effectively, it is preferable that the polycarbonate resin is the second polycarbonate resin, the electron transport material is the compound (1), (4), or (5), and the hole transport material is the compound (20) or (25). It is more preferable that the polycarbonate resin is the second polycarbonate resin, the electron transport material is the compound (1-E1), (4-E4), (4-E5), or (5-E6), and the hole transport material is the compound (20-H1) or (25-H6).

In order to inhibit generation of white spots in an image being formed particularly effectively, it is further preferable to employ any of the following combinations of a polycarbonate resin, an electron transport material, and a hole transport material. It is particularly preferable to employ any of the following combinations of a polycarbonate resin, an electron transport material, and a hole transport material and use the X-form metal-free phthalocyanine as a charge generating material. The preferable combinations are those in which:

the polycarbonate resin is the second polycarbonate resin, the electron transport material is the compound (1), and the hole transport material is the compound (25);

the polycarbonate resin is the second polycarbonate resin, the electron transport material is the compound (4), and the hole transport material is the compound (25);

the polycarbonate resin is the second polycarbonate resin, the electron transport material is the compound (1), and the hole transport material is the compound (20);

the polycarbonate resin is the second polycarbonate resin, the electron transport material is the compound (4), and the hole transport material is the compound (20); or the polycarbonate resin is the second polycarbonate resin, the electron transport material is the compound (5), and the hole transport material is the compound (20).

In order to inhibit generation of white spots in an image being formed particularly effectively, it is still further preferable to employ any of the following combinations of a polycarbonate resin, an electron transport material, and a hole transport material. It is particularly preferable to employ any of the following combinations of a polycarbonate resin, an electron transport material, and a hole transport material and use the X-form metal-free phthalocyanine as a charge generating material. The preferable combinations are those in which:

the polycarbonate resin is the second polycarbonate resin, the electron transport material is the compound (1-E1), and the hole transport material is the compound (25-H6);

the polycarbonate resin is the second polycarbonate resin, the electron transport material is the compound (4-E4), and the hole transport material is the compound (25-H6);

the polycarbonate resin is the second polycarbonate resin, the electron transport material is the compound (1-E1), and the hole transport material is the compound (20-H1);

the polycarbonate resin is the second polycarbonate resin, the electron transport material is the compound (4-E4), and the hole transport material is the compound (20-H1);

the polycarbonate resin is the second polycarbonate resin, the electron transport material is the compound (4-E5), and the hole transport material is the compound (20-H1); or the polycarbonate resin is the second polycarbonate resin, the electron transport material is the compound (5-E6), and the hole transport material is the compound (20-H1). Through the above, the first configuration has been described.

Next, the second configuration will be described. In the second configuration, the electron transport material is the compound (1), (2), or (4).

In order to inhibit generation of white spots in an image being formed particularly effectively, it is preferable that the polycarbonate resin is the second polycarbonate resin and the electron transport material is the compound (1), (2), or (4). It is more preferable that the polycarbonate resin is the second polycarbonate resin and the electron transport material is the compound (1-E1), (2-E2), or (4-E4).

In order to inhibit generation of white spots in an image being formed particularly effectively, it is preferable that the polycarbonate resin is the second polycarbonate resin, the electron transport material is the compound (1). (2), or (4), and the hole transport material is the compound (20), (22), (23), (25), or (27). It is more preferable that the polycarbonate resin is the second polycarbonate resin, the electron transport material is the compound (1-E1), (2-E2), or (4-E4), and the hole transport material is the compound (20-H1), (22-H3), (23-H4), (25-H6), or (27-H8).

In order to inhibit generation of white spots in an image being formed particularly effectively, it is further preferable to employ any of the following combinations of a polycarbonate resin, an electron transport material, and a hole transport material. It is particularly preferable to employ any of the following combinations of a polycarbonate resin, an electron transport material, and a hole transport material and use the X-form metal-free phthalocyanine as a charge generating material. The preferable combinations are those in which:

the polycarbonate resin is the second polycarbonate resin, the electron transport material is the compound (2), and the hole transport material is the compound (22);

the polycarbonate resin is the second polycarbonate resin, the electron transport material is the compound (2), and the hole transport material is the compound (23);

the polycarbonate resin is the second polycarbonate resin, the electron transport material is the compound (2), and the hole transport material is the compound (25);

the polycarbonate resin is the second polycarbonate resin, the electron transport material is the compound (2), and the hole transport material is the compound (27);

the polycarbonate resin is the second polycarbonate resin, the electron transport material is the compound (1), and the hole transport material is the compound (25); or the polycarbonate resin is the second polycarbonate resin, the electron transport material is the compound (4), and the hole transport material is the compound (20).

In order to inhibit generation of white spots in an image being formed particularly effectively, it is still further preferable to employ any of the following combinations of a polycarbonate resin, an electron transport material, and a hole transport material. It is particularly preferable to employ any of the following combinations of a polycarbonate resin, an electron transport material, and a hole transport material and use the X-form metal-free phthalocyanine as a charge generating material. The preferable combinations are those in which:

the polycarbonate resin is the second polycarbonate resin, the electron transport material is the compound (2-E2), and the hole transport material is the compound (22-H3);

the polycarbonate resin is the second polycarbonate resin, the electron transport material is the compound (2-E2), and the hole transport material is the compound (23-H4);

the polycarbonate resin is the second polycarbonate resin, the electron transport material is the compound (2-E2), and the hole transport material is the compound (25-H6);

the polycarbonate resin is the second polycarbonate resin, the electron transport material is the compound (2-E2), and the hole transport material is the compound (27-H8);

the polycarbonate resin is the second polycarbonate resin, the electron transport material is the compound (1-E1), and the hole transport material is the compound (25-H6); or the polycarbonate resin is the second polycarbonate resin, the electron transport material is the compound (4-E4), and the hole transport material is the compound (20-H1).

In order to inhibit generation of white spots in an image being formed particularly effectively, it is particularly preferable that the polycarbonate resin is the second polycarbonate resin, the electron transport material is the compound (2), and the hole transport material is the compound (23). For the same reason as above, it is further preferable that the polycarbonate resin is the second polycarbonate resin, the electron transport material is the compound (2-E2), and the hole transport material is the compound (23-H4). Through the above, the second configuration has been described.

Next, the third configuration will be described. In the third configuration, the electron transport material is the compound (2).

In order to significantly improve sensitivity characteristics of the photosensitive member while inhibiting generation of white spots in an image being formed, it is preferable that the polycarbonate resin is the second polycarbonate resin and the electron transport material is the compound (2). It is more preferable that the polycarbonate resin is the second polycarbonate resin and the electron transport material is the compound (2-E2).

In order to significantly improve sensitivity characteristics of the photosensitive member while inhibiting generation of white spots in an image being formed, it is further preferable that the polycarbonate resin is the second polycarbonate resin, the electron transport material is the compound (2), and the hole transport material is the compound (27). It is still further preferable that the polycarbonate resin is the second polycarbonate resin, the electron transport material is the compound (2-E2), and the hole transport material is the compound (27-H9). It is particularly preferable that the polycarbonate resin is the second polycarbonate resin, the electron transport material is the compound (2-E2), the hole transport material is the compound (27-H9), and the charge generating material is the X-form metal-free phthalocyanine. Through the above, the third configuration has been described.

(Charge Generating Material)

No specific limitation is placed on the charge generating material as long as the charge generating material can be used in the photosensitive member. Examples of the charge generating material include phthalocyanine-based pigment, perylene-based pigment, bisazo pigment, tris-azo pigment, dithioketopyrrolopyrrole pigment, metal-free naphthalocyanine pigment, metal naphthalocyanine pigment, squaraine pigment, indigo pigment, azulenium pigment, cyanine pigment, powders of inorganic photoconductive materials (specific examples include selenium, selenium-tellurium, selenium-arsenic, cadmium sulfide, and amorphous silicon), pyrylium pigment, anthanthrone-based pigment, triphenylmethane-based pigment, threne-based pigment, toluidine-based pigment, pyrazoline-based pigment, and quinacridone-based pigment. One charge generating material may be used alone or two or more charge generating materials may be used in combination.

Examples of the phthalocyanine-based pigment include metal-free phthalocyanine and metal phthalocyanine. Examples of the metal phthalocyanine include titanyl phthalocyanine, hydroxygallium phthalocyanine, and chlorogallium phthalocyanine. The metal-free phthalocyanine is represented by chemical formula (CGM2), for example. Titanyl phthalocyanine is represented by chemical formula (CGM1), for example.

(CGM1)

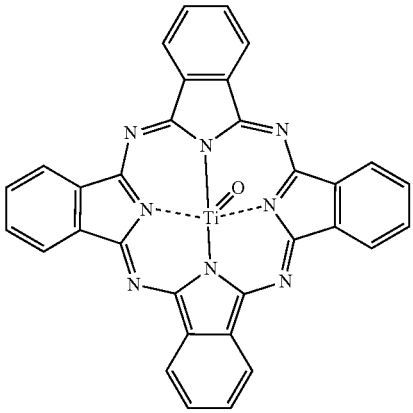

(CGM2)

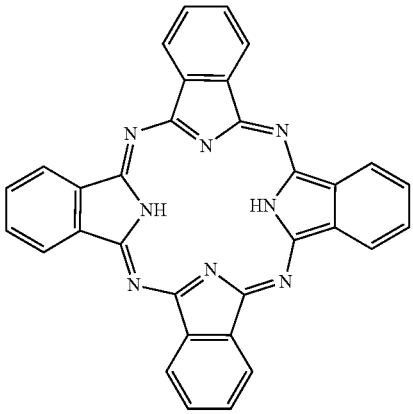

The phthalocyanine-based pigment may be crystalline or non-crystalline. No specific limitation is placed on the crystal structure (specific examples include α-form, β-form, Y-form, V-form, and II-form) of the phthalocyanine-based pigment. Phthalocyanine-based pigments having various crystal structures can be used. Examples of crystalline metal-free phthalocyanine include metal-free phthalocyanine having the X-form crystal structure (hereinafter may be referred to as X-form metal-free phthalocyanine). Examples of crystalline titanyl phthalocyanine include titanyl phthalocyanines having the α-form, β-form, and Y-form crystal structures (hereinafter may be referred to as α-form, β-form, and Y-form titanyl phthalocyanines, respectively).

For image forming apparatuses employing, for example, a digital optical system (for example, a laser beam printer or facsimile machine including a light source such as a semiconductor laser), a photosensitive member having sensitivity in a wavelength range of 700 nm or longer is preferably used. Phthalocyanine-based pigments are preferable as the charge generating material in terms of their high quantum yield in the wavelength range of 700 nm or longer. Metal-free phthalocyanine and titanyl phthalocyanine are more preferable. The X-form metal-free phthalocyanine and the Y-form titanyl phthalocyanine are further preferable.

The Y-form titanyl phthalocyanine has a main peak for example at a Bragg angle (2θ±0.2°) of 27.2° in a CuKα characteristic X-ray diffraction spectrum. The main peak in the CuKα characteristic X-ray diffraction spectrum is a peak having the largest or second largest intensity in a Bragg angle (2θ±0.2) range of at least 3 and no greater than 40.

The following describes an example of a method for measuring the CuKα characteristic X-ray diffraction spectrum. A sample (titanyl phthalocyanine) is loaded into a sample holder of an X-ray diffraction spectrometer (e.g., "RINT (registered Japanese trademark) 1100" manufactured by Rigaku Corporation) and an X-ray diffraction spectrum is measured using a Cu X-ray tube under conditions of a tube voltage of 40 kV, a tube current of 30 mA, and a wavelength of CuKα characteristic X-rays of 1.542 Å. The measurement range (2θ) is for example at least 3° and no greater than 40° (start angle: 3°, stop angle: 40°), and the scanning rate is for example 10°/minute.

For photosensitive members adopted in image forming apparatuses including a short-wavelength laser light source (for example, a laser light source having a wavelength of at least 350 nm and no longer than 550 nm), an anthanthrone-based pigment is preferably used as the charge generating material.

The amount of the charge generating material is preferably at least 0.1 parts by mass and no greater than 50 parts by mass relative to 100 parts by mass of the binder resin contained in the photosensitive layer, more preferably at least 0.5 parts by mass and no greater than 30 parts by mass, and particularly preferably at least 0.5 parts by mass and no greater than 4.5 parts by mass.

(Additives)

Examples of additives that can be used include antidegradant (specific examples include antioxidant, radical scavenger, singlet quencher, and ultraviolet absorbing agent), softener, surface modifier, extender, thickener, dispersion stabilizer, wax, acceptor, donor, surfactant, plasticizer, sensitizer, and leveling agent. Examples of the antioxidant include hindered phenol (specific examples include di(tert-butyl)p-cresol), hindered amine, paraphenylenediamine, arylalkane, hydroquinone, spirochromane, spiroindanone, derivatives of the aforementioned materials, organosulfur compounds, and organophosphorus compounds.

<Conductive Substrate>

No specific limitation is placed on the conductive substrate as long as the conductive substrate can be used in the photosensitive member. It is only required that at least a surface portion of the conductive substrate is formed from an electrically conductive material. An example of the conductive substrate is a substrate formed from an electrically conductive material. Another example of the conductive substrate is a substrate coated with an electrically conductive material. Examples of the electrically conductive material include aluminum, iron, copper, tin, platinum, silver, vanadium, molybdenum, chromium, cadmium, titanium, nickel, palladium, indium, stainless steel, and brass.

One of the above-listed electrically conductive materials may be used alone or two or more of the above-listed electrically conductive materials may be used in combination (for example, as an alloy). Among the above-listed electrically conductive materials, aluminum or an aluminum alloy is preferable in terms of favorable charge mobility from the photosensitive layer to the conductive substrate.

The shape of the conductive substrate is appropriately selected according to a configuration of an image forming apparatus. Examples of the shape of the conductive substrate include a sheet-like shape and a drum-like shape. Also, the thickness of the conductive substrate is appropriately selected according to the shape of the conductive substrate.

<Intermediate Layer>

The intermediate layer (undercoat layer) contains for example inorganic particles and a resin for intermediate layer use (an intermediate layer resin). The presence of the intermediate layer is thought to cause a smooth flow of an electric current generated by irradiation of the photosensitive member with light, resulting in suppression of an increase in resistance while maintaining insulation to such an extent that occurrence of a leakage current can be prevented.

Examples of the inorganic particles include particles of metals (specific examples include aluminum, iron, and copper), particles of metal oxides (specific examples include titanium oxide, alumina, zirconium oxide, tin oxide, and zinc oxide), and particles of non-metal oxides (specific examples include silica). One type of the above-listed inorganic particles may be used alone or two or more types of the above-listed inorganic particles may be used in combination.

No specific limitation is placed on the intermediate layer resin as long as it can be used for intermediate layer formation. The intermediate layer may contain an additive. Examples of the additive that may be contained in the intermediate layer are the same as those that may be contained in the photosensitive layer.

<Method for Producing Photosensitive Member>

A photosensitive member is produced for example as described below. The photosensitive member is produced by applying an application liquid for photosensitive layer formation onto a conductive substrate and drying the applied application liquid for photosensitive layer formation. The application liquid for photosensitive layer formation is prepared by dissolving or dispersing a charge generating material, an electron transport material, a binder resin, a hole transport material, and an optionally added component (for example, an additive) in a solvent.

No specific limitation is placed on the solvent contained in the application liquid for photosensitive layer formation as long as the respective components to be contained in the application liquid can be dissolved or dispersed therein. Examples of the solvent include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, diethylene glycol dimethyl ether, and propylene glycol monomethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. One of the above-listed solvents is used alone or two or more of the above-listed solvents are used in combination. In order to improve workability during production of the photosensitive member, a non-halogenated solvent (solvent other than halogenated hydrocarbons) is preferably used.

The application liquid is prepared by mixing the components to disperse the components in the solvent. Mixing or dispersion may be performed using for example a bead mill, a roll mill, a ball mill, an attritor, a paint shaker or an ultrasonic disperser.

The application liquid for photosensitive layer formation may contain for example a surfactant in order to improve dispersibility of the respective components.

No specific limitation is placed on an application method of the application liquid for photosensitive layer formation as long as the application liquid can be uniformly applied over the conductive substrate. Examples of the application method include blade coating, dip coating, spray coating, spin coating, and bar coating.

No specific limitation is placed on a drying method of the application liquid for photosensitive layer formation as long as the solvent contained in the application liquid can be evaporated. Specific examples of the drying method include thermal treatment (hot-air drying) using a high-temperature dryer or a reduced pressure dryer. The temperature of the thermal treatment is for example at least 40° C., and no higher than 150° C. The time of the thermal treatment is for example at least 3 minutes and no longer than 120 minutes.

Either or both of an intermediate layer formation process and a protective layer formation process may be included in the method for producing the photosensitive member, as necessary. Respective methods appropriately selected from known methods are adopted in the intermediate layer formation process and the protective layer formation process.

<Image Forming Apparatus>

The following describes an image forming apparatus including the photosensitive member of the present embodiment. The following describes with reference to FIG. 3 a tandem color image forming apparatus as an embodiment of the image forming apparatus including the photosensitive member of the present embodiment.

Figure 3:
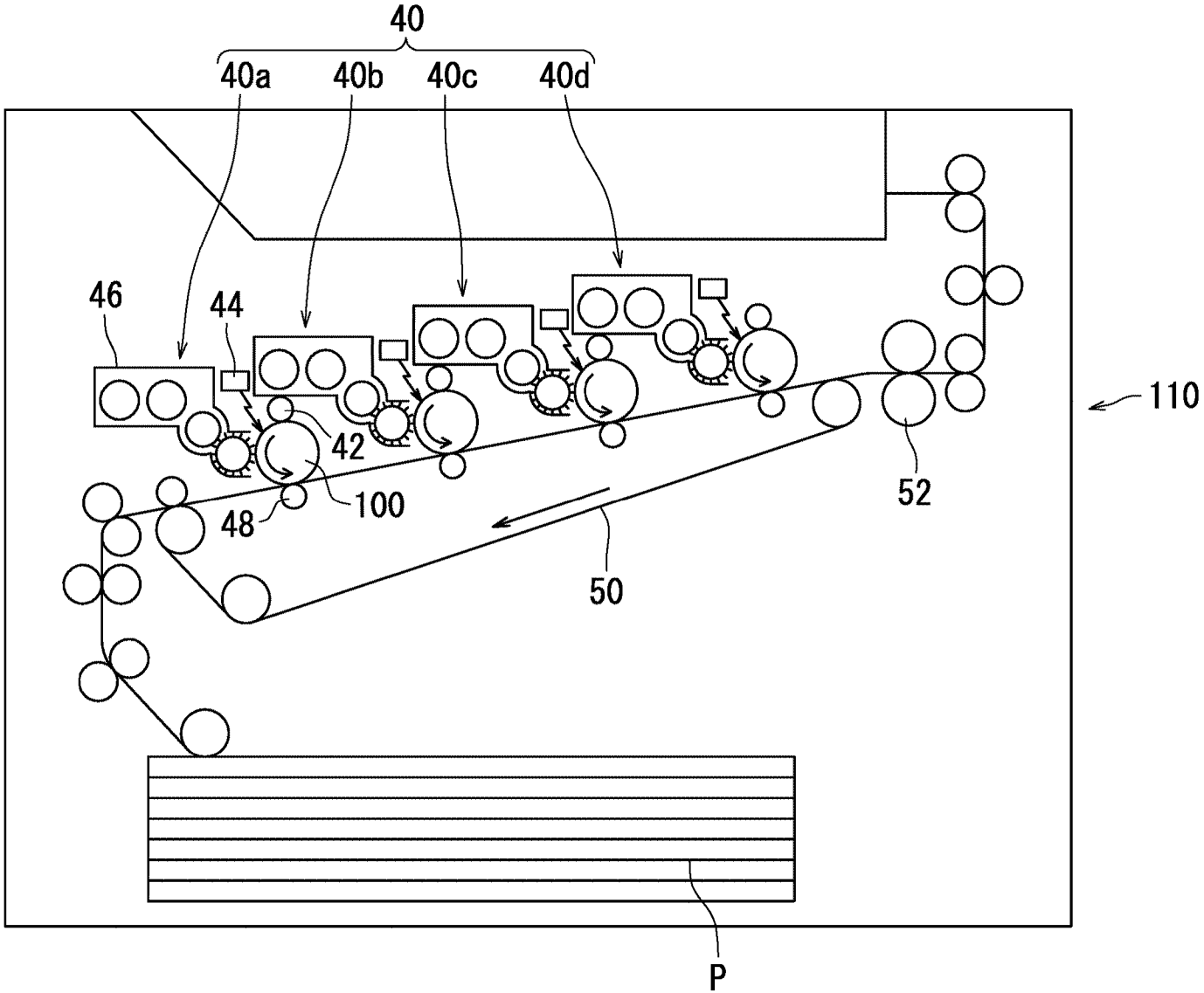
FIG. 3 is a diagram illustrating an example of a configuration of an image forming apparatus including the electrophotographic photosensitive member according to the embodiment of the present disclosure.

An image forming apparatus 110 illustrated in FIG. 3 includes image forming units 40*a*, 40*b*, 40*c*, and 40*d*, a transfer belt 50, and a fixing device 52. In the following description, each of the image forming units 40*a*. 40*b*, 40*c*, and 40*d* will be referred to as an image forming unit 40 when there is no need to distinguish the respective image forming units from one another.

The image forming unit 40 includes an image bearing member, a charger 42, a light exposure device 44, a developing device 46, and a transfer device 48. The image bearing member is the photosensitive member 100 of the present embodiment. The photosensitive member 100 is located at the center of the image forming unit 40. The photosensitive member 100 is rotatable in a direction indicated by an arrow (i.e., counterclockwise). The charger 42, the light exposure device 44, the developing device 46, and the transfer device 48 are arranged around the photosensitive member 100 in the stated order from the upstream starting from the charger 42 in the rotation direction of the photosensitive member 100. Note that the image forming unit 40 may further include a non-illustrated cleaner or a non-illustrated static eliminator.

The image forming units 40*a* to 40*d* superimpose toner images in respective colors (for example, four colors of black, cyan, magenta, and yellow) on one another in order on a recording medium P placed on the transfer belt 50.

The charger 42 charges a surface (for example, a circumferential surface) of the photosensitive member 100. Charging polarity of the charger 42 is positive. That is, the charger 42 positively charges the surface of the photosensitive member 100. When the photosensitive member 100 of the present embodiment and the recording medium P come into contact with each other and friction is caused therebetween, minute components of the recording medium P (for example, paper dust) are positively charged to a level equal to or higher than a desired level. When the surface of the photosensitive member 100 is positively charged by the charger 42, the surface of the photosensitive member 100 and the minute components of the recording medium P positively charged through triboelectric charging electrically repel each other. As a result, the minute components of the recording medium P hardly adhere to the surface of the photosensitive member 100 and generation of white spots in an image being formed can be effectively inhibited.

The charger 42 is a charging roller. The charging roller charges the surface of the photosensitive member 100 while in contact therewith. A contact charging process is adopted in the image forming apparatus 110. In image forming apparatuses adopting the contact charging process, a charging roller in contact with a surface of a photosensitive member usually presses minute components of a recording medium against the surface of the photosensitive member. Therefore, the minute components of the recording medium tend to firmly adhere to the surface of the photosensitive member. However, the image forming apparatus 110 includes the photosensitive member 100 of the present embodiment. Use of the photosensitive member 100 of the present embodiment can inhibit generation of white spots that would be caused by adhesion of minute components. Therefore, even in a configuration in which the image forming apparatus 110 includes the charging roller as the charger 42, minute components hardly adhere to the surface of the photosensitive member 100 and generation of white spots in an image being formed can be inhibited.

An example of chargers adopting the contact charging process other than the charging roller is a charging brush. Note that the charger may adopt a non-contact charging process. Examples of chargers adopting the non-contact charging process include a corotron charger and a scorotron charger.

The light exposure device 44 irradiates the charged surface of the photosensitive member 100 with light. Through the above, an electrostatic latent image is formed on the surface of the photosensitive member 100. The electrostatic latent image is formed on the basis of image data input to the image forming apparatus 110.

The developing device 46 develops the electrostatic latent image into a toner image by supplying toner to the surface of the photosensitive member 100. The photosensitive member 100 is the image bearing member that bears the toner image thereon. The toner may be used as a one-component developer. Alternatively, the toner may be mixed with a desired carrier for use thereof in a two-component developer. In a situation in which the toner is used as the one-component developer, the developing device 46 supplies the toner, which is the one-component developer, to the electrostatic latent image formed on the photosensitive member 100. In a situation in which the toner is used in the two-component developer, the developing device 46 supplies to the electrostatic latent image formed on the photosensitive member 100 the toner of the two-component developer containing the toner and the carrier.

The developing device 46 is capable of developing the electrostatic latent image into a toner image while in contact with the surface of the photosensitive member 100. That is, a contact development process can be adopted in the image forming apparatus 110. In image forming apparatuses adopting the contact development process, a developing device in contact with a surface of a photosensitive member usually presses minute components of a recording medium against the surface of the photosensitive member. Therefore, the minute components of the recording medium tend to firmly adhere to the surface of the photosensitive member. However, the image forming apparatus 110 includes the photosensitive member 100 of the present embodiment. Use of the photosensitive member 100 of the present embodiment can inhibit generation of white spots that would be caused by adhesion of minute components of the recording medium P. Therefore, even in a configuration in which the image forming apparatus 110 includes the developing device 46 adopting the contact development process, minute components hardly adhere to the surface of the photosensitive member 100 and generation of white spots in an image being formed can be inhibited.

The developing device 46 is capable of cleaning the surface of the photosensitive member 100. That is, a blade cleaner-less process can be adopted in the image forming apparatus 110. In this configuration, the developing device 46 is capable of removing residual components on the surface of the photosensitive member 100. In image forming apparatuses including a cleaner (for example, a cleaning blade), residual components on a surface of an image bearing member are usually scraped off by the cleaner. However, in image forming apparatuses adopting the blade cleaner-less process, residual components on the surface of the image bearing member are not scraped off. Therefore, in the image forming apparatuses adopting the blade cleaner-less process, the residual components usually tend to remain on the surface of the image bearing member. However, generation of white spots that would be caused by adhesion of minute components of the recording medium P (for example, paper dust) can be inhibited through use of the photosensitive member 100 of the present embodiment. Therefore, even in a configuration in which the blade cleaner-less process is adopted in the image forming apparatus 110 including the photosensitive member 100 as above, residual components, particularly the minute components of the recording medium P, hardly remain on the surface of the photosensitive member 100. As a result, generation of white spots in an image being formed can be inhibited in the image forming apparatus 110.

In order that the developing device 46 efficiently cleans the surface of the photosensitive member 100 while performing development, it is preferable that the following conditions (a) and (b) are satisfied.

Condition (a): The contact development process is adopted and peripheral speed (rotational speed) is different between the photosensitive member 100 and the developing device 46.

Condition (b): The surface potential of the photosensitive member 100 and the electric potential of a development bias satisfy the following expressions (b-1) and (b-2).

$$0\ (V) < \text{electric potential } (V) \text{ of development bias} < \text{surface potential } (V) \text{ of region of photosensitive member 100 that is not exposed to light} \quad \text{(b-1)}$$

electric potential ($V$) of development bias>surface potential ($V$) of region of photosensitive member 100 that is exposed to light>0 ($V$) (b-2)

In a situation in which the contact development process is adopted and the peripheral speed is different between the photosensitive member 100 and the developing device 46, as described in condition (a), the surface of the photosensitive member 100 comes into contact with the developing device 46 and components adhering to the surface of the photosensitive member 100 are removed by friction between the surface of the photosensitive member 100 and the developing device 46. The peripheral speed of the developing device 46 is preferably higher than that of the photosensitive member 100.

The condition (b) is a condition to be satisfied in a configuration in which a reversal development process is adopted as the development process. In order to improve sensitivity characteristics of the photosensitive member 100, which is a single-layer photosensitive member, it is preferable that the charging polarity of toner, the surface potential of a region of the photosensitive member 100 that is not exposed to light, the surface potential of a region of the photosensitive member 100 that is exposed to light, and the electric potential of the development bias are all positive. Note that the surface potential of the region of the photosensitive member 100 that is not exposed to light and the surface potential of the region of the photosensitive member 100 that is exposed to light are measured after a toner image is transferred from the photosensitive member 100 to the recording medium P by the transfer device 48 and before the surface of the photosensitive member 100 is charged by the charger 42 in the next rotation of the photosensitive member 100.

In a situation in which the expression (b-1) of the condition (b) is satisfied, electrostatic repelling force acting between toner remaining on the photosensitive member 100 (hereinafter may be referred to as residual toner) and the region of the photosensitive member 100 that is not exposed to light is stronger than electrostatic repelling force acting between the residual toner and the developing device 46. Therefore, residual toner remaining on the region of the photosensitive member 100 that is not exposed to light moves from the surface of the photosensitive member 100 to the developing device 46 and is collected.

In a situation in which the expression (b-2) of the condition (b) is satisfied, electrostatic repelling force acting between the residual toner and the region of the photosensitive member 100 that is exposed to light is weaker than the electrostatic repelling force acting between the residual toner and the developing device 46. Therefore, residual toner remaining on the region of the photosensitive member 100 that is exposed to light is held on the surface of the photosensitive member 100. Toner held on the region of the photosensitive member 100 that is exposed to light is directly used for image formation.

The transfer belt 50 conveys the recording medium P to a site between the photosensitive member 100 and the transfer device 48. The transfer belt 50 is an endless belt. The transfer belt 50 is capable of circulating in a direction indicated by an arrow (i.e., clockwise).

The transfer device 48 transfers the toner image developed by the developing device 46 from the surface of the photosensitive member 100 onto the recording medium P. The transfer device 48 transfers the toner image from the surface of the photosensitive member 100 onto the recording medium P while the recording medium P and the surface of the photosensitive member 100 are in contact with each other. That is, a direct transfer process is adopted in the image forming apparatus 110. In image forming apparatuses adopting the direct transfer process, a photosensitive member and a recording medium usually come into contact with each other with a result that minute components of the recording medium (for example, paper dust) tend to adhere to a surface of the photosensitive member. However, use of the photosensitive member 100 of the present embodiment can inhibit adhesion of minute components of the recording medium P to the surface of the photosensitive member 100. As a result, generation of white spots in an image being formed can be effectively inhibited. An example of the transfer device 48 is a transfer roller.

The fixing device 52 applies heat and/or pressure to the unfixed toner image transferred onto the recording medium P by the transfer device 48. The fixing device 52 is for example a heating roller and/or a pressure roller. Through application of heat and/or pressure to the toner image, the toner image is fixed to the recording medium P. As a result, an image is formed on the recording medium P.

Through the above, an example of the image forming apparatus has been described. However, the image forming apparatus is not limited to the image forming apparatus 110 described above. Although the image forming apparatus 110 described above is a color image forming apparatus, the image forming apparatus may be a monochrome image forming apparatus. In this case, the image forming apparatus may include a single image forming unit only, for example. Although the image forming apparatus 110 described above is a tandem image forming apparatus, the image forming apparatus may be a rotary image forming apparatus, for example.

<Process Cartridge>

The following describes an example of a process cartridge including the photosensitive member 100 of the present embodiment, continuously referring to FIG. 3. The process cartridge is a cartridge used for image formation. The process cartridge corresponds to each of the image forming units 40*a* to 40*d*. The process cartridge includes the photosensitive member 100. The process cartridge may further include at least one device selected from the group consisting of the charger 42, the light exposure device 44, the developing device 46, and the transfer device 48 in addition to the photosensitive member 100. The process cartridge may further include either or both of a non-illustrated cleaner and a non-illustrated static eliminator. The process cartridge is attachable to and detachable from the image forming apparatus 110. Therefore, the process cartridge is easy to handle and can be easily and quickly replaced together with the photosensitive member 100 when sensitivity characteristics of the photosensitive member 100 or the like degrades. Through the above, the process cartridge including the photosensitive member 100 of the present embodiment has been described with reference to FIG. 3.

Use of the above-described photosensitive member of the present embodiment can inhibit generation of white spots in an image being formed. Also, use of the process cartridge or the image forming apparatus that includes the photosensitive member of the present embodiment can inhibit generation of white spots in an image being formed.

EXAMPLES

The following more specifically describes the present disclosure using examples. However, the present disclosure is by no means limited to the scope of the examples.

<Materials for Forming Photosensitive Layer>

The following charge generating material, hole transport materials, electron transport materials, and binder resins were prepared as materials for forming photosensitive layers of photosensitive members.

(Charge Generating Material)

X-form metal-free phthalocyanine was prepared as the charge generating material. The X-form metal-free phthalocyanine was metal-free phthalocyanine having the X-form crystal structure and represented by chemical formula (CGM2) shown in the embodiment.

(Hole Transport Materials)

The compounds (20-H1), (21-H2), (22-H3), (23-H4), (24-H5), (25-H6), (26-H7), (27-H8), and (27-H9) described in the embodiment were prepared as the hole transport materials. Also, compounds represented by chemical formulas (H10), (H11), (H12), and (H13) shown below (hereinafter may be referred to as compounds (H10), (H11), (H12), and (H13), respectively) were prepared as hole transport materials to be used in comparative examples.

(H10)

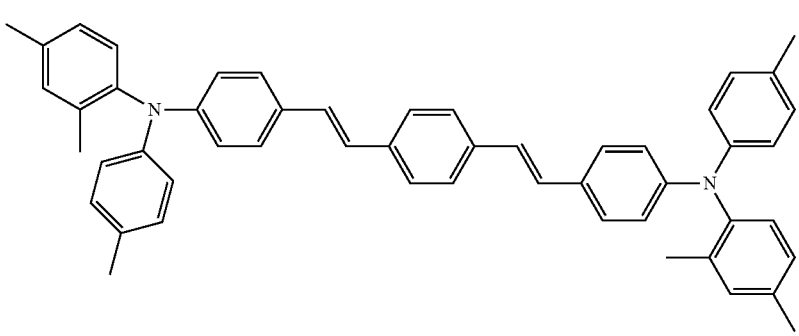

(H11)

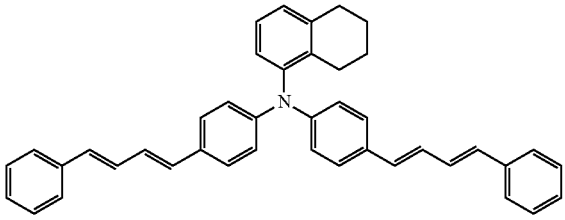

(H12)

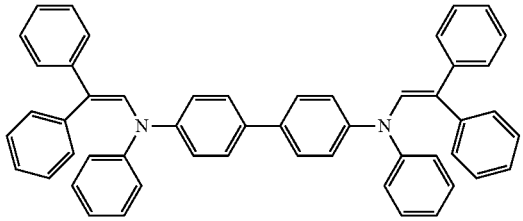

(H13)

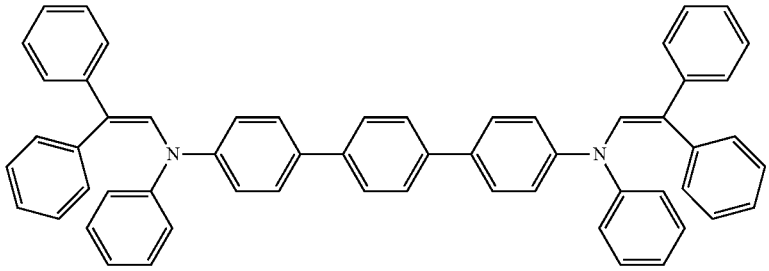

(Electron Transport Materials)

The compounds (1-E1), (2-E2), (3-E3), (4-E4). (4-E5), and (5-E6) described in the embodiment were prepared as the electron transport materials. Also, compounds represented by chemical formulas (E7), (E8), (E9), (E10), and (E11) shown below (hereinafter may be referred to as compounds (E7), (E8), (E9), (E10), and (E11), respectively) were prepared as electron transport materials to be used in the comparative examples.

(E7)

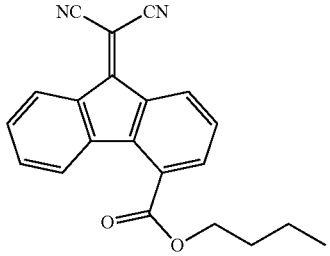

(E8)

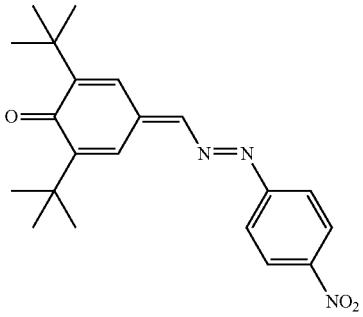

(E9)

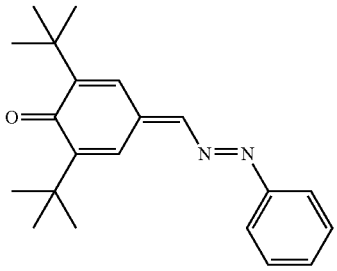

(E10)

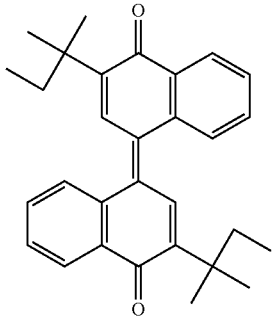

-continued (E11)

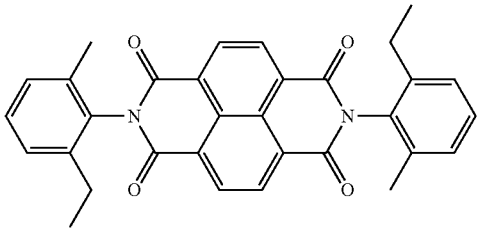

(Binder Resins)

The following polycarbonate resins (R-1) to (R-3) were prepared as the binder resins. Also, the following polycarbonate resins (R-4) to (R-7) were prepared as binder resins to be used in the comparative examples.

[Polycarbonate Resin (R-1)]

The polycarbonate (R-1) had the terminal group (10-1). The polycarbonate resin (R-1) had only the repeating units (11-1) and (12-1) as repeating units. The ratio p was 0.60 and the ratio q was 0.40. The polycarbonate resin (R-1) had a viscosity average molecular weight of 52,300.

(R-1)

(11-1)

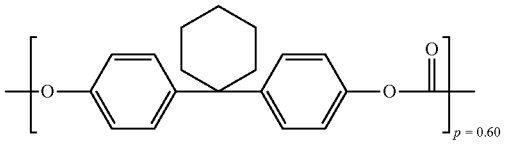

(12-1)

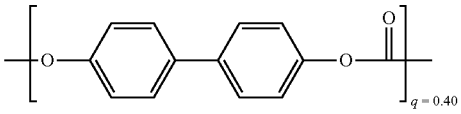

(10-1)

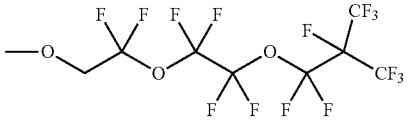

[Polycarbonate Resin (R-2)]

The polycarbonate resin (R-2) had the terminal group (10-1). The polycarbonate resin (R-2) had only the repeating units (11-2) and (12-1) as repeating units. The ratio p was 0.60 and the ratio q was 0.40. The polycarbonate resin (R-2) had a viscosity average molecular weight of 32,400.

(R-2)

(11-2)

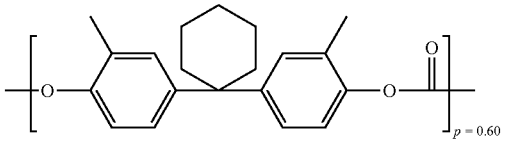

(12-1)

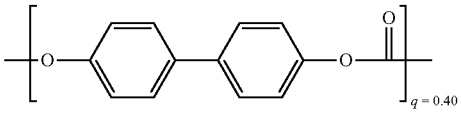

-continued (10-1)

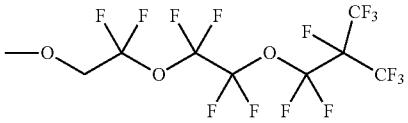

[Polycarbonate Resin (R-3)]

The polycarbonate resin (R-3) had the terminal group (10-1). The polycarbonate resin (R-3) had only the repeating units (11-1) and (12-2) as repeating units. The ratio p was 0.60 and the ratio q was 0.40. The polycarbonate resin (R-3) had a viscosity average molecular weight of 38,600.

(R-3)

(11-1)

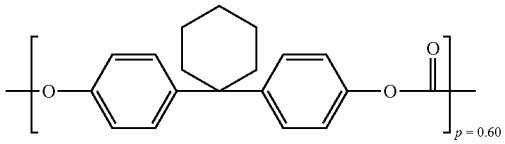

(12-2)

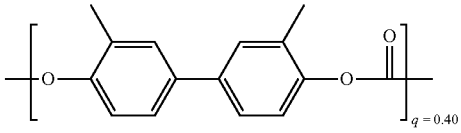

(10-1)

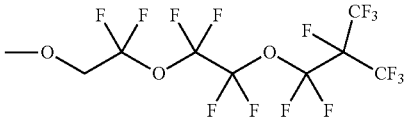

[Polycarbonate Resin (R-4)]

The polycarbonate (R-4) had a terminal group represented by chemical formula (13) (hereinafter referred to as a terminal group (13)). The polycarbonate resin (R-4) had only the repeating units (11-1) and (12-1) as repeating units. The ratio p was 0.60 and the ratio q was 0.40. The polycarbonate resin (R-4) had a viscosity average molecular weight of 32,000.

(R-4)

(11-1)

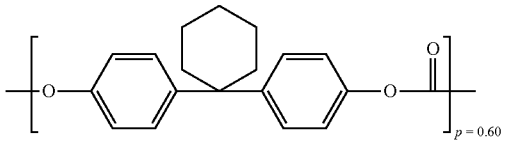

(12-1)

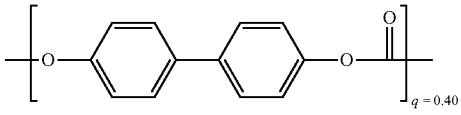

(13)

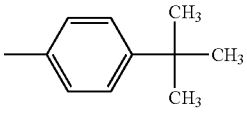

[Polycarbonate Resin (R-5)]

The polycarbonate resin (R-5) had the terminal group (13). The polycarbonate resin (R-5) had only the repeating units (11-2) and (12-1) as repeating units. The ratio p was 0.60 and the ratio q was 0.40. The polycarbonate resin (R-5) had a viscosity average molecular weight of 31,600.

(R-5)

(11-2)

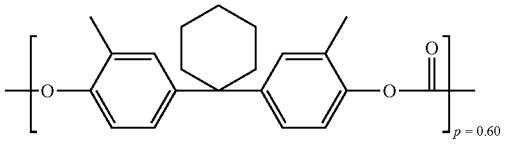

(12-1)

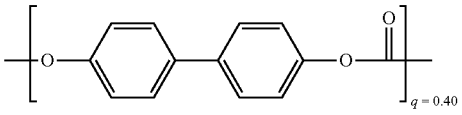

(13)

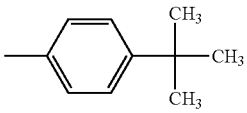

[Polycarbonate Resin (R-6)]

The polycarbonate resin (R-6) had the terminal group (13). The polycarbonate resin (R-6) had only the repeating units (11-1) and (12-2) as repeating units. The ratio p was 0.60 and the ratio q was 0.40. The polycarbonate resin (R-6) had a viscosity average molecular weight of 48,900.

(R-6)

(11-1)

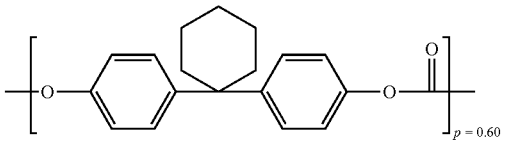

(12-2)

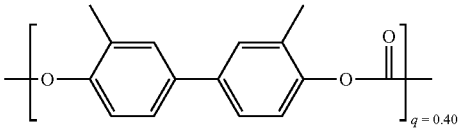

(13)

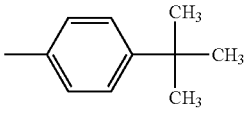

[Polycarbonate Resin (R-7)]

The polycarbonate resin (R-7) had the terminal group (13). The polycarbonate resin (R-7) had only the repeating unit (14) as a repeating unit. The polycarbonate resin (R-7) had a viscosity average molecular weight of 29,200.

(R-7)

(14)

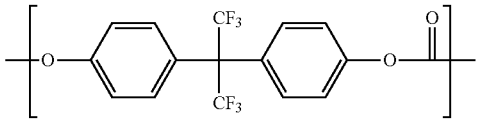

(13)

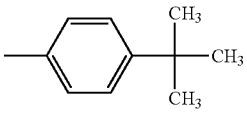

<Production of Photosensitive Member>

Photosensitive members (A-1) to (A-19) and (B-1) to (B-13) were produced using the materials for photosensitive layer formation.

(Production of Photosensitive Member (A-1))

A vessel was charged with 2 parts by mass of the X-form metal-free phthalocyanine as the charge generating material, 50 parts by mass of the compound (20-H1) as the hole transport material, 30 parts by mass of the compound (2-E2) as the electron transport material, 100 parts by mass of the polycarbonate resin (R-1) as the binder resin, and 600 parts by mass of tetrahydrofuran as a solvent. The vessel contents were mixed for 12 hours using a ball mill to disperse the materials in the solvent. Through the above, an application liquid for photosensitive layer formation was prepared. The application liquid for photosensitive layer formation was applied by dip coating onto a drum-shaped aluminum support (diameter: 30 mm, entire length: 238.5 mm) as a conductive substrate. The applied application liquid for photosensitive layer formation was dried with hot air at 120° C. for 80 minutes. Through the above, a photosensitive layer of a single-layer structure (film thickness: 30 μm) was formed on the conductive substrate. As a result, the photosensitive member (A-1) was obtained.

(Production of Photosensitive Members (A-2) to (A-19) and (B-1) to (B-13)

The photosensitive members (A-2) to (A-19) and (B-1) to (B-13) were produced in the same manner as that in production of the photosensitive member (A-1) in all aspects other than the following changes. Although the polycarbonate resin (R-1) was used as the binder resin in production of the photosensitive member (A-1), a binder resin indicated in Table 1 or 2 was used in production of each of the photosensitive members (A-2) to (A-19) and (B-1) to (B-13). Although the compound (2-E2) was used as the electron transport material in production of the photosensitive member (A-1), an electron transport material indicated in Table 1 or 2 was used in production of each of the photosensitive members (A-2) to (A-19) and (B-1) to (B-13). Although the compound (20-H1) was used as the hole transport material in production of the photosensitive member (A-1), a hole transport material indicated in Table 1 or 2 was used in production of each of the photosensitive members (A-2) to (A-19) and (B-1) to (B-13).

<Measurement of Charge of Calcium Carbonate>

A charge of calcium carbonate was measured for each of the photosensitive members (A-1) to (A-19) and (B-1) to (B-13).

The following describes a method for measuring a charge of calcium carbonate by charging the calcium carbonate through friction with the photosensitive layer 102 with reference to FIG. 2 again. The charge of calcium carbonate was measured by the first through fourth steps described below. A jig 10 was used in measurement of the charge of calcium carbonate.

The jig 10 includes a first table 12, a rotary shaft 14, a rotary driving device 16 (for example, a motor), and a second table 18. The rotary driving device 16 causes the rotary shaft 14 to rotate. The rotary shaft 14 rotates about a rotation axis S thereof. The first table 12 rotates together with the rotary shaft 14 about the rotation axis S. The second table 18 is fixed and does not rotate.

(First Step)

In the first step, two photosensitive layers 102 were prepared. In the following description, one of the photosensitive layers 102 will be referred to as a first photosensitive layer 102*a* and the other of the photosensitive layers 102 will be referred to as a second photosensitive layer 102*b*. First, a first film 20 with the first photosensitive layer 102*a* formed thereon was prepared. The first photosensitive layer 102*a* had a film thickness L1 of 30 μm. Also, a second film 22 with the second photosensitive layer 102*b* formed thereon was prepared. The second photosensitive layer 102*b* had a film thickness L2 of 30 μm. Overhead projector (OHP) films were used as the first film 20 and the second film 22. The first film 20 and the second film 22 each had a circular shape having a diameter of 3 cm. The application liquid for photosensitive layer formation used in production of the photosensitive member (A-1) was applied over the first film 20 and the second film 22. The applied application liquid for photosensitive layer formation was dried with hot air at 120° C. for 80 minutes. Through the above, the first film 20 with the first photosensitive layer 102*a* formed thereon and the second film 22 with the second photosensitive layer 102*b* formed thereon were obtained.

(Second Step)

In the second step, 0.007 g of calcium carbonate was applied over the first photosensitive layer 102*a*. Through the above, a calcium carbonate layer 24 made from calcium carbonate was formed on the first photosensitive layer 102*a*. Then, the second photosensitive layer 102*b* was placed on the calcium carbonate layer 24. Specifically, the second step was performed as described below.

First, the first film 20 was secured to the first table 12 using a double sided tape. Then, 0.007 g of calcium carbonate was applied over the first photosensitive layer 102*a* on the first film 20. Through the above, the calcium carbonate layer 24 made from calcium carbonate was formed on the first photosensitive layer 102*a*. The second film 22 was secured to the second table 18 using a double sided tape such that the calcium carbonate layer 24 was in contact with the second photosensitive layer 102*b*. As a result, the first table 12, the first film 20, the first photosensitive layer 102*a*, the calcium carbonate layer 24, the second photosensitive layer 102*b*, the second film 22, and the second table 18 were arranged in the stated order from bottom to top. The first table 12, the first film 20, the first photosensitive layer 102*a*, the second photosensitive layer 102*b*, the second film 22, and the second table 18 were arranged such that respective centers thereof coincide with the rotation axis S.

(Third Step)

In the third step, the first photosensitive layer 102*a* was rotated at a rotational speed of 60 rpm for 60 seconds while the second photosensitive layer 102*b* was kept stationary in an environment at a temperature of 23° C., and a relative humidity of 50%. Specifically, the rotary shaft 14, the first table 12, the first film 20, and the first photosensitive layer 102*a* were rotated about the rotation axis S at a rotational speed of 60 rpm for 60 seconds by driving the rotary driving device 16. Through the above, calcium carbonate contained in the calcium carbonate layer 24 was charged through friction with the first photosensitive layer 102*a* and the second photosensitive layer 102*b*.

(Fourth Step)

In the fourth step, the calcium carbonate charged in the third step was collected from the jig 10 and sucked using a charge measuring device (compact draw-off charge measurement system "MODEL 212HS" manufactured by TREK, INC.). A total electric charge Q (unit: +μC) and a mass M (unit: g) of the sucked calcium carbonate were measured using the charge measuring device. A charge (triboelectric charge, unit: +μC/g) of the calcium carbonate was calculated according to an expression "charge=Q/M".

Through the above, the method for measuring the charge of calcium carbonate by charging the calcium carbonate through friction with the photosensitive layer 102 has been described with reference to FIG. 2. Other than the following change, a charge of calcium carbonate was measured for each of the photosensitive members (A-2) to (A-19) and (B-1) to (B-13) by the same method as that used in measurement of the charge of calcium carbonate for the photosensitive member (A-1). In the first step, respective application liquids for photosensitive layer formation used in production of the photosensitive members (A-2) to (A-19) and (B-1) to (B-13) were used instead of the application liquid for photosensitive layer formation used in production of the photosensitive member (A-1).

The charge of calcium carbonate calculated for each of the photosensitive members (A-1) to (A-19) and (B-1) to (B-13) is indicated in Table 1 or 2. A larger positive value of the charge of calcium carbonate indicates that calcium carbonate was positively charged more easily relative to the photosensitive layer.

<Measurement of Vickers Hardness>

A Vickers hardness of the photosensitive layer was measured for each of the photosensitive members (A-1) to (A-19) and (B-1) to (B-13). The Vickers hardness of the photosensitive layer was measured by a method in accordance with Japanese Industrial Standard (JIS) Z2244. First, the photosensitive member was heated using a heater to increase the temperature of the photosensitive layer up to 45° C. Next, a Vickers hardness of the photosensitive layer was measured using a hardness tester ("Micro Vickers Hardness Tester model DMH-1" manufactured by Matsuzawa Co., Ltd) while the temperature of the photosensitive layer was kept at 45° C. The hardness tester had a diamond indenter. The Vickers hardness of the photosensitive layer was measured under the following conditions of: a diamond indenter load (test force) of 10 gf; a time to reach the test force of 5 seconds; a diamond indenter approach speed of 2 mm/second; and a test force holding period of 1 second. The measured Vickers hardness of the photosensitive layer is indicated in Table 1 or 2.

<Evaluation of Sensitivity Characteristics>

Sensitivity characteristics were evaluated for each of the photosensitive members (A-1) to (A-19) and (B-1) to (B-13). The sensitivity characteristics were evaluated in an environment at a temperature of 23° C., and a relative humidity of 50%. First, a surface of the photosensitive member was charged to +600 V using a drum sensitivity test device (product of Gen-Tech, Inc.). Then, monochromatic light (wavelength: 780 nm, half-width: 20 nm, light intensity: 1.5 μJ/cm$^2$) was obtained from white light emitted from a halogen lamp using a bandpass filter. The surface of the photosensitive member was irradiated with the obtained monochromatic light. A surface potential of the photosensitive member was measured when 0.5 seconds elapsed from termination of the irradiation. The measured surface potential was taken to be a post-irradiation electric potential ($V_L$, unit: +V). The measured post-irradiation electric potential ($V_L$) of each photosensitive member is indicated in Table 1 or 2. A smaller positive value of the post-irradiation electric potential ($V_L$) indicates better sensitivity characteristics of the photosensitive member.

<Evaluation of Image Characteristics>

Image characteristics were evaluated for each of the photosensitive members (A-1) to (A-19) and (B-1) to (B-13). The image characteristics were evaluated in an environment at a temperature of 32.5° C., and a relative humidity of 80%. An image forming apparatus ("Monochrome Printer FS-1300D" manufactured by KYOCERA Document Solutions Inc.) was modified to be used as an evaluation apparatus. Specifically, Monochrome Printer FS-1300D was modified to employ a contact development process rather than a non-contact development process, employ a bladeless cleaning process rather than a blade cleaning process, and adopt a charging roller rather than a scorotron charger. Note that the evaluation apparatus employed a direct transfer process. A recording medium used was "KYOCERA Document Solutions brand paper VM-A4" (A4 size) sold by KYOCERA Document Solutions Inc. A one-component developer (test sample) was used in evaluation performed using the evaluation apparatus.

An image I (an image with a coverage rate of 1%) was continuously printed on each of 20,000 sheets of the paper (recording mediums) using the evaluation apparatus under conditions of a rotational speed of the photosensitive member of 168 mm/second and a charge potential of +630 V. Then, an image II (a black solid image in A4 size) was printed on a sheet of the paper (recording medium). The recording medium with the image II formed thereon was observed with unaided eyes and the number of white spots observed in the image II was counted. The number of white spots in the image II tends to increase with an increase of minute components (for example, paper dust) of the recording medium adhering to the surface of the photosensitive member. The number of white spots observed in the image II is indicated in Table 1 or 2.

In Tables 1 and 2, HTM, ETM, Resin, and $V_L$ represent the hole transport material, the electron transport material, the binder resin, and the post-irradiation electric potential, respectively.

TABLE 1

| | Photosensitive member | Photosensitive layer Resin Type | ETM Type | HTM Type | Vickers hardness (HV) | Charge of calcium carbonate (+μC/g) | Sensitivity characteristics $V_L$ (+V) | Image characteristics Number of white spots |
|---|---|---|---|---|---|---|---|---|
| Example 1 | A-1 | R-1 | 2-E2 | 20-H1 | 18.2 | 12.1 | 121 | 13 |
| Example 2 | A-2 | R-2 | 2-E2 | 20-H1 | 18.6 | 11.6 | 124 | 15 |
| Example 3 | A-3 | R-3 | 2-E2 | 20-H1 | 18.6 | 11.9 | 123 | 12 |
| Example 4 | A-4 | R-2 | 2-E2 | 21-H2 | 18.0 | 11.5 | 130 | 13 |
| Example 5 | A-5 | R-2 | 2-E2 | 22-H3 | 20.2 | 12.1 | 134 | 10 |
| Example 6 | A-6 | R-2 | 2-E2 | 23-H4 | 20.4 | 12.3 | 135 | 9 |
| Example 7 | A-7 | R-2 | 2-E2 | 24-H5 | 19.6 | 12.0 | 131 | 11 |
| Example 8 | A-8 | R-2 | 2-E2 | 25-H6 | 18.5 | 12.2 | 129 | 10 |
| Example 9 | A-9 | R-2 | 2-E2 | 26-H7 | 18.5 | 11.7 | 124 | 13 |
| Example 10 | A-10 | R-2 | 2-E2 | 27-H8 | 19.7 | 11.9 | 130 | 10 |
| Example 11 | A-11 | R-2 | 2-E2 | 27-H9 | 18.4 | 12.2 | 116 | 11 |
| Example 12 | A-12 | R-2 | 1-E1 | 25-H6 | 18.7 | 12.3 | 130 | 10 |
| Example 13 | A-13 | R-2 | 3-E3 | 25-H6 | 19.1 | 11.8 | 130 | 12 |
| Example 14 | A-14 | R-2 | 4-E4 | 25-H6 | 18.7 | 12.3 | 132 | 11 |
| Example 15 | A-15 | R-2 | 1-E1 | 20-H1 | 18.8 | 11.6 | 125 | 13 |
| Example 16 | A-16 | R-2 | 3-E3 | 20-H1 | 19.6 | 12.6 | 136 | 11 |
| Example 17 | A-17 | R-2 | 4-E4 | 20-H1 | 18.5 | 12.8 | 132 | 10 |
| Example 18 | A-18 | R-2 | 4-E5 | 20-H1 | 18.3 | 11.9 | 134 | 10 |
| Example 19 | A-19 | R-2 | 5-E6 | 20-H1 | 18.0 | 12.2 | 132 | 10 |

TABLE 2

| | Photosensitive member | Photosensitive layer Resin Type | ETM Type | HTM Type | Vickers hardness (HV) | Charge of calcium carbonate (+μC/g) | Sensitivity characteristics $V_L$ (+V) | Image characteristics Number of white spots |
|---|---|---|---|---|---|---|---|---|
| Comparative example 1 | B-1 | R-4 | 2-E2 | 20-H1 | 18.3 | 6.0 | 124 | 57 |
| Comparative example 2 | B-2 | R-5 | 2-E2 | 20-H1 | 18.9 | 6.2 | 123 | 60 |
| Comparative example 3 | B-3 | R-6 | 2-E2 | 20-H1 | 18.3 | 5.9 | 120 | 62 |
| Comparative example 4 | B-4 | R-1 | E7 | 20-H1 | 18.5 | 6.4 | 125 | 38 |
| Comparative example 5 | B-5 | R-1 | E8 | 20-H1 | 18.6 | 6.3 | 123 | 36 |
| Comparative example 6 | B-6 | R-1 | E9 | 20-H1 | 18.7 | 6.4 | 140 | 35 |
| Comparative example 7 | B-7 | R-1 | E10 | 20-H1 | 18.5 | 6.4 | 126 | 36 |
| Comparative example 8 | R-8 | R-1 | E11 | 20-H1 | 17.9 | 6.3 | 124 | 40 |
| Comparative example 9 | B-9 | R-1 | 2-E2 | H10 | 13.1 | 11.2 | 120 | 54 |
| Comparative example 10 | B-10 | R-1 | 2-E2 | H11 | 12.9 | 11.5 | 118 | 53 |
| Comparative example 11 | B-11 | R-1 | 2-E2 | H12 | 15.8 | 11.2 | 126 | 22 |
| Comparative example 12 | B-12 | R-1 | 2-E2 | H13 | 15.0 | 11.3 | 136 | 26 |
| Comparative example 13 | B-13 | R-7 | 2-E2 | 20-H1 | Unmeasurable | Unmeasurable | Unmeasurable | Unmeasurable |

The photosensitive members (A-1) to (A-19) each included a conductive substrate and a photosensitive layer of a single-layer structure. The photosensitive layer contained a charge generating material, an electron transport material, a binder resin, and a hole transport material. The electron transport material was the compound (1), (2), (3), (4), or (5). Specifically, the electron transport material was the compound (1-E1), (2-E2), (3-E3), (4-E4), (4-E5), or (5-E6). The binder resin was a polycarbonate resin having the terminal group (10). Specifically, the binder resin was the polycarbonate resin (R-1), (R-2), or (R-3). The hole transport material was the compound (20), (21), (22), (23), (24), (25), (26), or (27). Specifically, the hole transport material was the compound (20-H1), (21-H2), (22-H3), (23-H4), (24-H5), (25-H6), (26-H7), (27-H8), or (27-H9). A charge of calcium carbonate as measured by charging the calcium carbonate through friction with the photosensitive layer was at least +6.5 μC/g. The photosensitive layer had a Vickers hardness of at least 17.0 HV. Therefore, with respect to each of the photosensitive members (A-1) to (A-19), the number of white spots in the formed image was small as indicated in Table 1, which shows that generation of white spots was inhibited. Also, generation of white spots in an image being formed could be inhibited through use of the photosensitive members (A-1) to (A-19) without impairment of the sensitivity characteristics of the photosensitive members.

The photosensitive layer of each of the photosensitive members (A-5), (A-6), (A-8), (A-10), (A-12), and (A-17) contained the second polycarbonate resin (specifically, the polycarbonate resin (R-2)) as the binder resin. The electron transport material was the compound (1), (2), or (4). Specifically, the electron transport material was the compound (1-E1), (2-E2), or (4-E4). The hole transport material was the compound (20), (22), (23), (25), or (27). Specifically, the hole transport material was the compound (20-H1), (22-H3). (23-H4), (25-H6), or (27-H8). Therefore, with respect to each of the photosensitive members (A-5). (A-6), (A-8), (A-10). (A-12), and (A-17), the number of white spots in the formed image was no greater than 10 as indicated in Table 1, which shows that generation of white spots was inhibited particularly effectively.

The photosensitive layer of the photosensitive member (A-11) contained the second polycarbonate resin (specifically, the polycarbonate resin (R-2)) as the binder resin. The electron transport material was the compound (2). Specifically, the electron transport material was the compound (2-E2). The hole transport material was the compound (27). Specifically, the hole transport material was the compound (27-H9). Therefore, the photosensitive member (A-11) had a post-irradiation electric potential of +116 V as indicated in Table 1. The photosensitive member (A-11) had particularly excellent sensitivity characteristics and inhibited generation of white spots in an image being formed.

By contrast, the binder resin contained in each of the photosensitive members (B-1) to (B-3) was not a polycarbonate resin having the terminal group (10). The polycarbonate resins (R-4) to (R-6) respectively contained in the photosensitive members (B-1) to (B-3) did not have the terminal group (10). Also, a charge of calcium carbonate as measured by charging the calcium carbonate through friction with the photosensitive layer of each of the photosensitive members (B-1) to (B-3) was less than +6.5 μC/g.

The electron transport material contained in each of the photosensitive members (B-4) to (B-8) was none of the compounds (1), (2), (3), (4), and (5). The compounds (E7) to (E11) respectively contained in the photosensitive members (B-4) to (B-8) were not encompassed by compounds represented by general formulas (1). (2), (3), (4), and (5). Also, a charge of calcium carbonate as measured by charging the calcium carbonate through friction with the photosensitive layer of each of the photosensitive members (B-4) to (B-8) was less than +6.5 μC/g.

The hole transport material contained in each of the photosensitive members (B-9) to (B-12) was none of the compounds (20), (21), (22), (23), (24), (25). (26), and (27). The compounds (H10) to (H13) respectively contained in the photosensitive members (B-9) to (B-12) were not encompassed by compounds represented by general formulas (20), (21), (22), (23), (24), (25), (26), and (27). Also, the photosensitive layer of each of the photosensitive members (B-9) to (B-12) had a Vickers hardness of less than 17.0 HV.

Therefore, with respect to each of the photosensitive members (B-1) to (B-12), a large number of white spots was observed in the formed image as indicated in Table 2, which shows that generation of white spots was not inhibited.

The binder resin contained in the photosensitive member (B-13) was not a polycarbonate resin having the terminal group (10). Specifically, the polycarbonate resin (R-7) contained in the photosensitive member (B-13) did not have the terminal group (10). Further, the main chain of the polycarbonate resin (R-7) was constituted by a repeating unit having a halogen atom. Therefore, the photosensitive layer of the photosensitive member (B-13) was crystallized. The crystallization of the photosensitive layer is thought to be caused due to low compatibility of the polycarbonate resin (R-7) with the hole transport material and the electron transport material. Since the photosensitive layer was crystallized, the Vickers hardness of the photosensitive layer, the charge of calcium carbonate, the post-irradiation electric potential, and the number of white spots in the formed image could not be measured for the photosensitive member (B-13).

The above results show that use of the photosensitive member according to the present disclosure inhibits generation of white spots in an image being formed. Also, the above results show that use of the process cartridge and the image forming apparatus according to the present disclosure inhibits generation of white spots in an image being formed.

What is claimed is:

1. An electrophotographic photosensitive member comprising a conductive substrate and a photosensitive layer having a single-layer structure, wherein the photosensitive layer contains a charge generating material, an electron transport material, a polycarbonate resin, and a hole transport material, the electron transport material includes a compound having a halogen atom and represented by a chemical formula (4-E4), (4-E5), or (5-E6), the polycarbonate resin has a terminal group having a fluoro group and represented by a general formula (10), the hole transport material includes a compound represented by a general formula (20), (21), (22), (23), (24), (25), (26), or (27), a charge of calcium carbonate as measured by charging the calcium carbonate through friction with the photosensitive layer is at least +6.5 μC/g, and the photosensitive layer has a Vickers hardness of at least 17.0 HV at 45° C., (4-E4)

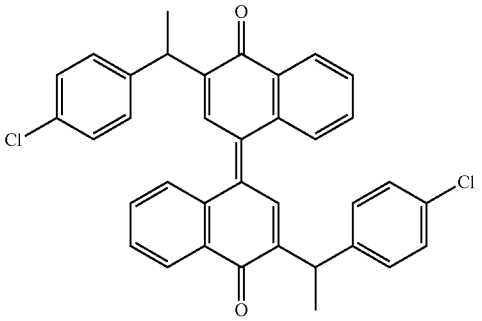

(4-E5)

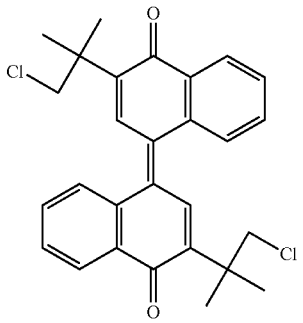

(5-E6)

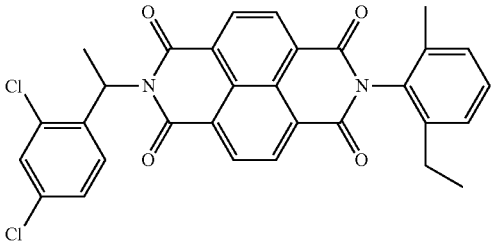

(10)

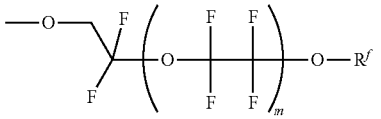

where in the general formula (10), $R^f$ represents a straight chain or branched chain perfluoroalkyl group having a carbon number of at least 1 and no greater than 6, and m represents an integer of at least 1 and no greater than 3,
(20)
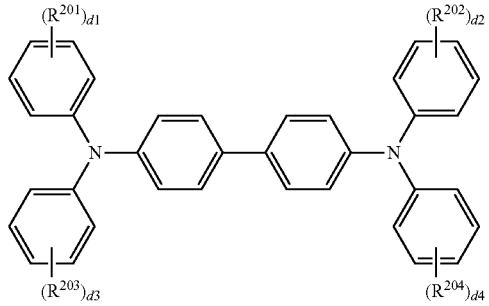
(21)
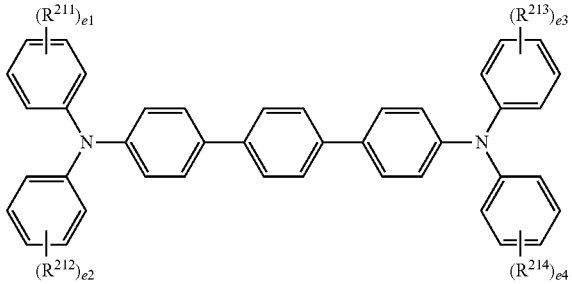
(22)
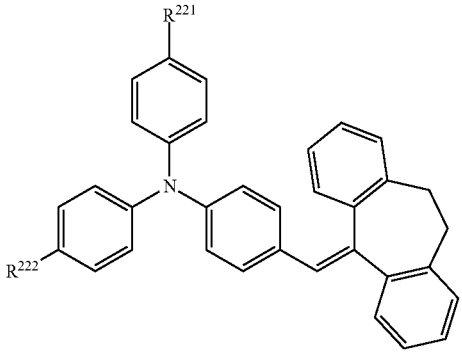
(23)
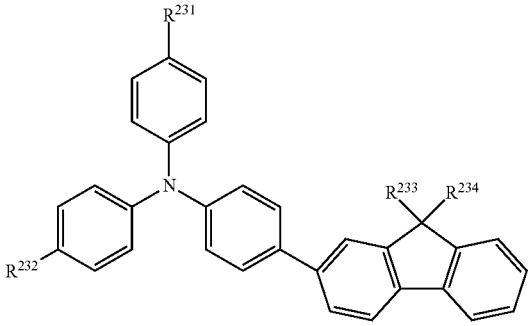
-continued
(24)
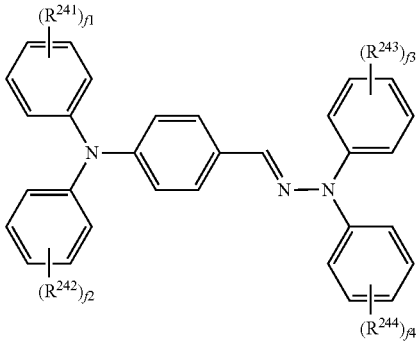
(25)
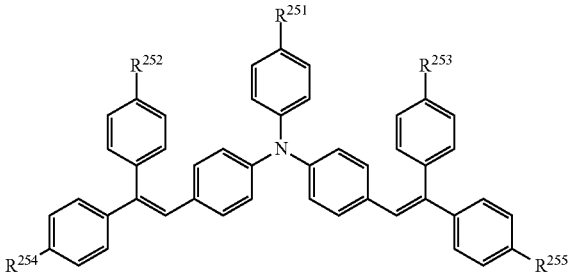
(26)
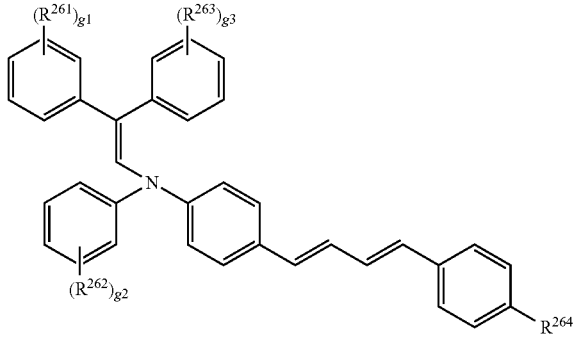
(27)
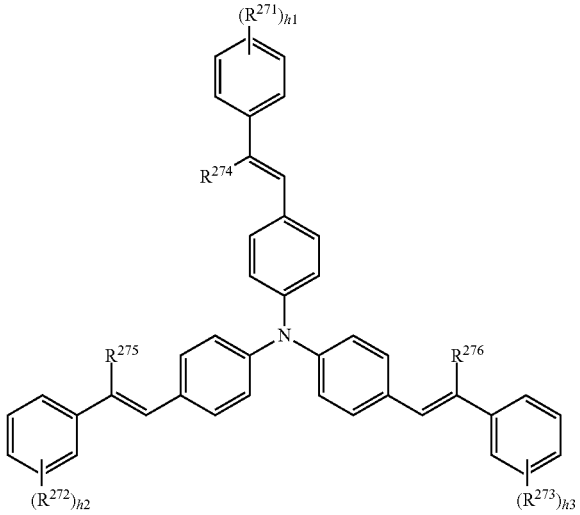

where in the general formula (20), $R^{201}$, $R^{202}$, $R^{203}$, and $R^{204}$ each represent, independently of one another, an alkyl group having a carbon number of at least 1 and no greater than 6, and d1, d2, d3, and d4 each represent, independently of one another, an integer of at least 0 and no greater than 5, in the general formula (21), $R^{211}$, $R^{212}$, $R^{213}$, and $R^{214}$ each represent, independently of one another, an alkyl group having a carbon number of at least 1 and no greater than 6, and e1, e2, e3, and e4 each represent, independently of one another, an integer of at least 0 and no greater than 5, in the general formula (22), $R^{221}$ and $R^{222}$ each represent, independently of each other, a hydrogen atom or an alkyl group having a carbon number of at least 1 and no greater than 6, in the general formula (23), $R^{231}$, $R^{232}$, $R^{233}$, and $R^{234}$ each represent, independently of one another, a hydrogen atom or an alkyl group having a carbon number of at least 1 and no greater than 6, in the general formula (24), $R^{241}$, $R^{242}$, $R^{243}$, and $R^{244}$ each represent, independently of one another, an alkyl group having a carbon number of at least 1 and no greater than 6, and f1, f2, f3, and f4 each represent, independently of one another, an integer of at least 0 and no greater than 5, in the general formula (25), $R^{251}$, $R^{252}$, $R^{253}$, $R^{254}$, and $R^{255}$ each represent, independently of one another, a hydrogen atom or an alkyl group having a carbon number of at least 1 and no greater than 6, in the general formula (26): $R^{261}$, $R^{262}$, and $R^{263}$ each represent, independently of one another, an alkyl group having a carbon number of at least 1 and no greater than 6; g1, g2, and g3 each represent, independently of one another, an integer of at least 0 and no greater than 5; and $R^{264}$ represents a hydrogen atom or an alkyl group having a carbon number of at least 1 and no greater than 6, and in the general formula (27): $R^{271}$, $R^{272}$, and $R^{273}$, each represent, independently of one another, an alkyl group having a carbon number of at least 1 and no greater than 6; h1, h2, and h3 each represent, independently of one another, an integer of at least 0 and no greater than 5; and $R^{274}$, $R^{275}$, and $R^{276}$ each represent, independently of one another, a hydrogen atom or an aryl group having a carbon number of at least 6 and no greater than 14.

2. The electrophotographic photosensitive member according to claim 1, wherein the polycarbonate resin further has a repeating unit represented by a general formula (11) and a repeating unit represented by a general formula (12), (11)

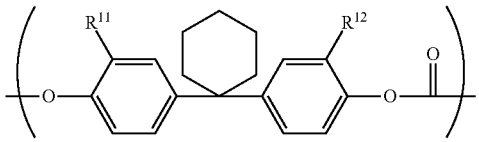

(12)

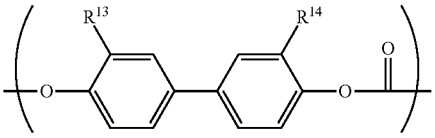

where in the general formulas (11) and (12), $R^{11}$, $R^{12}$, $R^{13}$ and $R^{14}$ each represent a hydrogen atom, $R^{11}$ and $R^{12}$ each represent a hydrogen atom and $R^{13}$ and $R^{14}$ each represent, independently of each other, an alkyl group having a carbon number of at least 1 and no greater than 6, or $R^{11}$ and $R^{12}$ each represent, independently of each other, an alkyl group having a carbon number of at least 1 and no greater than 6 and $R^{13}$ and $R^{14}$ each represent a hydrogen atom.

3. The electrophotographic photosensitive member according to claim 1, wherein the general formula (10) is represented by a chemical formula (10-1), and the polycarbonate resin is any one of:

a first polycarbonate resin having a terminal group represented by the chemical formula (10-1), a repeating unit represented by a chemical formula (11-1), and a repeating unit represented by a chemical formula (12-1);

a second polycarbonate resin having the terminal group represented by the chemical formula (10-1), a repeating unit represented by a chemical formula (11-2), and the repeating unit represented by the chemical formula (12-1); and a third polycarbonate resin having the terminal group represented by the chemical formula (10-1), the repeating unit represented by the chemical formula (11-1), and a repeating unit represented by a chemical formula (12-2)

(10-1)

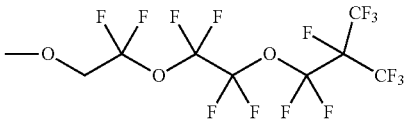

(11-1)

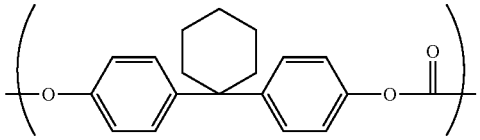

(11-2)

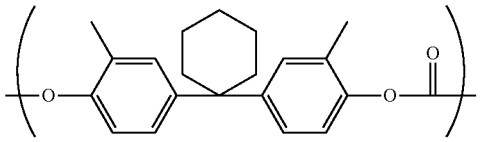

(12-1)

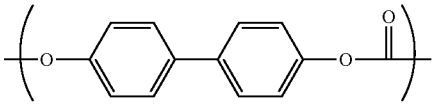

(12-2)

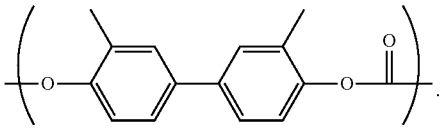

4. The electrophotographic photosensitive member according to claim 3, wherein the polycarbonate resin is the second polycarbonate resin, the electron transport material includes the compound represented by the chemical formula (4-E4) or (4-E5), and the hole transport material includes the compound represented by the general formula (20), (22), (23), (25), or (27).

5. The electrophotographic photosensitive member according to claim 4, wherein the electron transport material includes the compound represented by the chemical formula (4-E4), the compound represented by the general formula (20) is a compound represented by a chemical formula (20-H1), the compound represented by the general formula (22) is a compound represented by a chemical formula (22-H3), the compound represented by the general formula (23) is a compound represented by a chemical formula (23-H4), the compound represented by the general formula (25) is a compound represented by a chemical formula (25-H6), and the compound represented by the general formula (27) is a compound represented by a chemical formula (27-H8)

(20-H1)

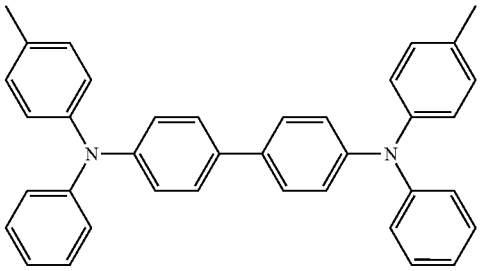

(22-H3)

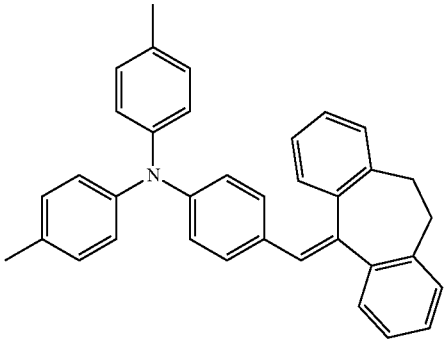

(23-H4)

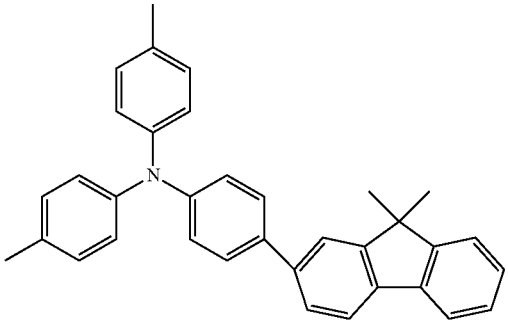

-continued (25-H6)

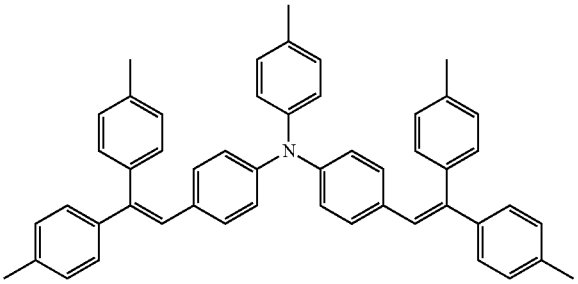

(27-H8)

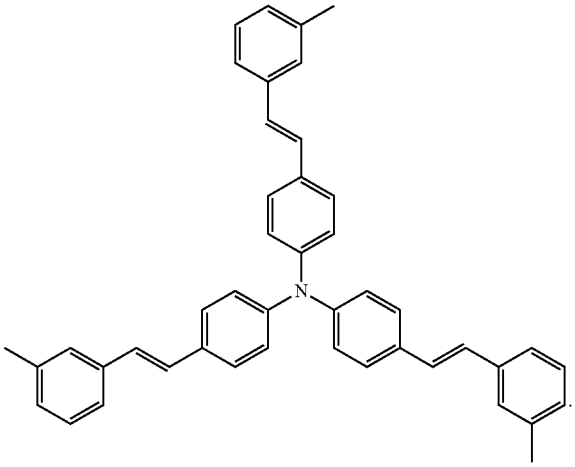

6. A process cartridge comprising the electrophotographic photosensitive member according to claim 1.

7. An image forming apparatus comprising:

an image bearing member;

a charger configured to charge a surface of the image bearing member;

a light exposure device configured to irradiate the charged surface of the image bearing member with light to form an electrostatic latent image on the surface of the image bearing member;

a developing device configured to develop the electrostatic latent image into a toner image; and a transfer device configured to transfer the toner image from the image bearing member onto a recording medium, wherein charging polarity of the charger is positive, the transfer device transfers the toner image from the image bearing member onto the recording medium while the recording medium and the surface of the image bearing member are in contact with each other, and the image bearing member is the electrophotographic photosensitive member according to claim 1.

8. The image forming apparatus according to claim 7, wherein the developing device develops the electrostatic latent image into the toner image while in contact with the surface of the image bearing member.

9. The image forming apparatus according to claim 7, wherein the developing device cleans the surface of the image bearing member.

10. The image forming apparatus according to claim 7, wherein the charger is a charging roller.

11. An electrophotographic photosensitive member comprising a conductive substrate and a photosensitive layer having a single-layer structure, wherein the photosensitive layer contains a charge generating material, an electron transport material, a polycarbonate resin, and a hole transport material, the polycarbonate resin has a terminal group having a fluoro group and represented by a chemical formula (10-1), a repeating unit represented by a chemical formula (11-2), and a repeating unit represented by a chemical formula (12-1), the electron transport material includes a compound having a halogen atom and represented by a general formula (2), the hole transport material includes a compound represented by a general formula (27), a charge of calcium carbonate as measured by charging the calcium carbonate through friction with the photosensitive layer is at least +6.5 μC/g, and the photosensitive layer has a Vickers hardness of at least 17.0 HV at 45° C., (10-1)

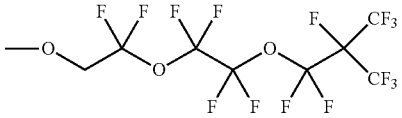

(11-2)

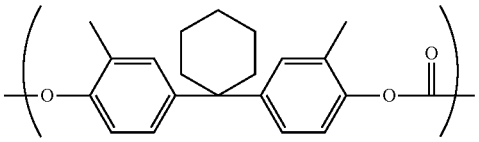

(12-1)

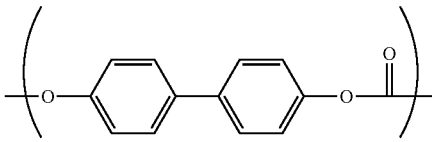

-continued (2)

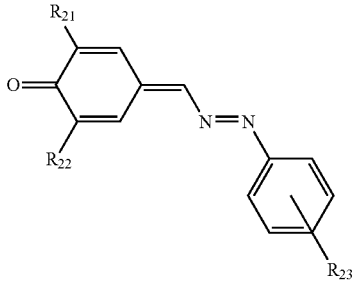

where in the general formula (2), $R^{21}$ and $R^{22}$ each represent, independently of each other, an alkyl group having a carbon number of at least 1 and no greater than 6, and $R^{23}$ represents a halogen atom, and (27)

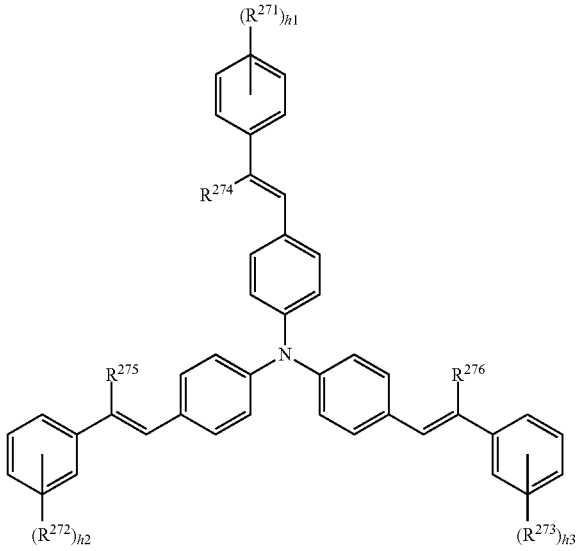

in the general formula (27): $R^{271}$, $R^{272}$, and $R^{273}$ each represent, independently of one another, an alkyl group having a carbon number of at least 1 and no greater than 6; h1, h2, and h3 each represent, independently of one another, an integer of at least 0 and no greater than 5; and $R^{274}$, $R^{275}$, and $R^{276}$ each represent, independently of one another, a hydrogen atom or an aryl group having a carbon number of at least 6 and no greater than 14.

12. The electrophotographic photosensitive member according to claim 11, wherein the compound represented by the general formula (2) is a compound represented by a chemical formula (2-E2), and the compound represented by the general formula (27) is a compound represented by a chemical formula (27-H9)

(2-E2)
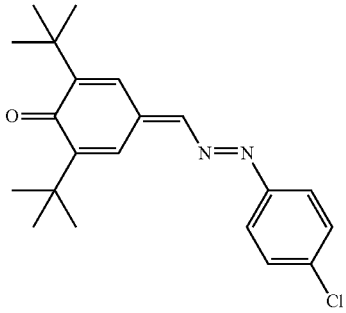
(27-H9)
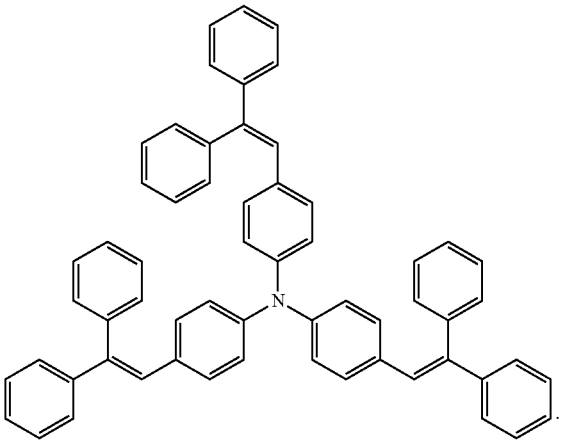
13. The electrophotographic photosensitive member according to claim 11, wherein
the compound represented by the general formula (2) is a compound represented by a chemical formula (2-E2), and
the compound represented by the general formula (27) is a compound represented by a chemical formula (27-H8)
(2-E2)
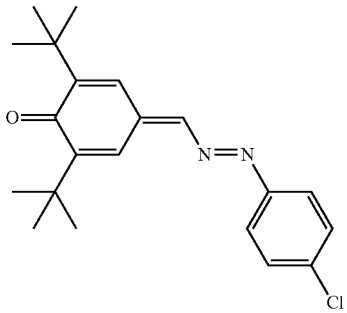
(27-H8)
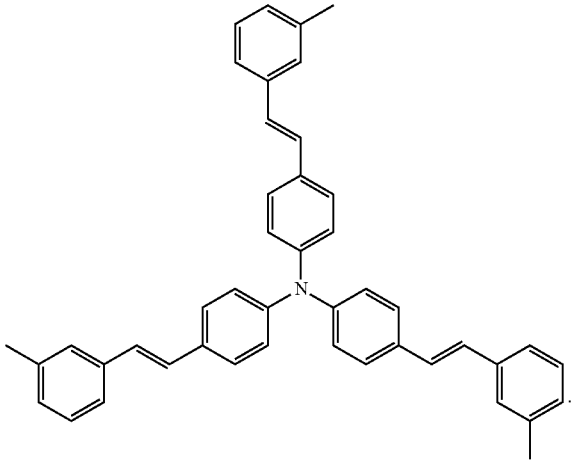
* * * * *